US008810613B2

(12) United States Patent
Higashi et al.

(10) Patent No.: US 8,810,613 B2
(45) Date of Patent: Aug. 19, 2014

(54) DRIVING METHOD FOR IMAGE DISPLAY APPARATUS AND DRIVING METHOD FOR IMAGE DISPLAY APPARATUS ASSEMBLY

(75) Inventors: Amane Higashi, Aichi (JP); Akira Sakaigawa, Kanagawa (JP); Masaaki Kabe, Kanagawa (JP); Yasuo Takahashi, Tokyo (JP)

(73) Assignee: Japan Display West Inc., Aichi (JP)

( * ) Notice: Subject to any disclaimer, the term of this patent is extended or adjusted under 35 U.S.C. 154(b) by 434 days.

(21) Appl. No.: 13/006,831

(22) Filed: Jan. 14, 2011

(65) Prior Publication Data

US 2011/0181633 A1 Jul. 28, 2011

(30) Foreign Application Priority Data

Jan. 28, 2010 (JP) ..... 2010-017296

(51) Int. Cl.
*G09G 5/02* (2006.01)

(52) U.S. Cl.
USPC ..... 345/691; 345/89

(58) Field of Classification Search
CPC ..... G09G 5/02
USPC ..... 345/89, 690–694; 349/106, 109
See application file for complete search history.

(56) References Cited

U.S. PATENT DOCUMENTS

| | | | | |
|---|---|---|---|---|
| 5,929,843 | A | 7/1999 | Tanioka | |
| 6,989,876 | B2 * | 1/2006 | Song et al. | 349/109 |
| 7,277,075 | B1 * | 10/2007 | Hirano et al. | 345/89 |
| 7,362,393 | B2 | 4/2008 | Kim et al. | |
| 7,483,095 | B2 * | 1/2009 | Roth et al. | 349/106 |
| 2004/0114046 | A1 | 6/2004 | Lee et al. | |
| 2004/0222999 | A1 | 11/2004 | Choi et al. | |
| 2005/0099426 | A1 | 5/2005 | Primerano et al. | |
| 2007/0159492 | A1 | 7/2007 | Lo et al. | |
| 2009/0315921 | A1 | 12/2009 | Sakaigawa et al. | |
| 2009/0322802 | A1 | 12/2009 | Noguchi et al. | |

FOREIGN PATENT DOCUMENTS

| | | |
|---|---|---|
| CN | 101620844 A | 1/2010 |
| JP | 04-130395 | 5/1992 |
| JP | 05-241551 | 9/1993 |

(Continued)

OTHER PUBLICATIONS

Japanese Office Action issued in connection with related counterpart Japanese Patent Application No. JP2010-017296 dated Oct. 8, 2013.

(Continued)

*Primary Examiner* — Quan-Zhen Wang
*Assistant Examiner* — Yuk Chow
(74) *Attorney, Agent, or Firm* — Dentons US LLP

(57) ABSTRACT

Disclosed herein is a driving method for an image display apparatus which includes an image display panel and a signal processing section. Each of the pixels includes a first subpixel for displaying a first primary color, a second subpixel for displaying a second primary color, a third subpixel for displaying a third primary color and a fourth subpixel for displaying a fourth color. The signal processing section is capable of calculating a first subpixel output signal, a second subpixel output signal, and a third subpixel output signal. The driving method includes the step, further carried out by the signal processing section, of calculating a fourth subpixel output signal based on a fourth subpixel control second signal and a fourth subpixel control first signal, and outputting the calculated fourth subpixel output signal to the fourth subpixel of the (p,q)th pixel.

5 Claims, 20 Drawing Sheets

(56) References Cited

FOREIGN PATENT DOCUMENTS

| | | |
|---|---|---|
| JP | 2004-199071 | 7/2004 |
| JP | 3805150 | 5/2006 |
| JP | 2007-514184 | 5/2007 |
| JP | 2008-170692 | 7/2008 |
| WO | 2004/086128 | 10/2004 |

OTHER PUBLICATIONS

Taiwan Office Action issued in connection with related Taiwan Patent Application No. 100101438 dated Dec. 18, 2013.
Chinese Office Action issued in connection with related Chinese Patent Application No. 201110025447.0 dated Jun. 4, 2014.

* cited by examiner

| | | | |
|---|---|---|---|
| (a) | R(255) | R(0) | R(255) |
| | G(255) | G(0) | G(255) |
| | B(255) | B(0) | B(255) |
| | W(255) | W(0) | W(255) |
| | R(255) | R(0) | R(255) |
| | G(255) | G(0) | G(255) |
| | B(255) | B(0) | B(255) |
| | W(255) | W(0) | W(255) |
| | R(255) | R(0) | R(255) |
| | G(255) | G(0) | G(255) |
| | B(255) | B(0) | B(255) |
| | W(255) | W(0) | W(255) |
| | R(255) | R(0) | R(255) |
| | G(255) | G(0) | G(255) |
| | B(255) | B(0) | B(255) |
| | W(255) | W(0) | W(255) |
| | R(255) | R(0) | R(255) |
| | G(255) | G(0) | G(255) |
| | B(255) | B(0) | B(255) |
| | W(255) | W(0) | W(255) |
| | R(255) | R(0) | R(255) |
| | G(255) | G(0) | G(255) |
| | B(255) | B(0) | B(255) |
| | W(255) | W(0) | W(255) |
| (b) | R(0) | R(255) | R(0) |
| | G(0) | G(255) | G(0) |
| | B(0) | B(255) | B(0) |
| | W(0) | W(255) | W(0) |
| | R(0) | R(255) | R(0) |
| | G(0) | G(255) | G(0) |
| | B(0) | B(255) | B(0) |
| | W(0) | W(255) | W(0) |
| | R(0) | R(255) | R(0) |
| | G(0) | G(255) | G(0) |
| | B(0) | B(255) | B(0) |
| | W(0) | W(255) | W(0) |
| | R(0) | R(255) | R(0) |
| | G(0) | G(255) | G(0) |
| | B(0) | B(255) | B(0) |
| | W(0) | W(255) | W(0) |
| | R(0) | R(255) | R(0) |
| | G(0) | G(255) | G(0) |
| | B(0) | B(255) | B(0) |
| | W(0) | W(255) | W(0) |
| (c) | R(255) | R(255) | R(255) |
| | G(255) | G(255) | G(255) |
| | B(255) | B(255) | B(255) |
| | W(255) | W(255) | W(255) |
| | R(255) | R(255) | R(255) |
| | G(255) | G(255) | G(255) |
| | B(255) | B(255) | B(255) |
| | W(255) | W(255) | W(255) |
| | R(255) | R(255) | R(255) |
| | G(255) | G(255) | G(255) |
| | B(255) | B(255) | B(255) |
| | W(255) | W(255) | W(255) |
| | R(255) | R(255) | R(255) |
| | G(255) | G(255) | G(255) |
| | B(255) | B(255) | B(255) |
| | W(255) | W(255) | W(255) |
| | R(255) | R(255) | R(255) |
| | G(255) | G(255) | G(255) |
| | B(255) | B(255) | B(255) |
| | W(255) | W(255) | W(255) |

DRIVING METHOD FOR IMAGE DISPLAY APPARATUS AND DRIVING METHOD FOR IMAGE DISPLAY APPARATUS ASSEMBLY

BACKGROUND OF THE INVENTION

1. Field of the Invention

This invention relates to a driving method for an image display apparatus and a driving method for an image display apparatus assembly.

2. Description of the Related Art

In recent years, an image display apparatus such as, for example, a color liquid crystal display apparatus has a problem in increase of the power consumption involved in enhancement of performances. Particularly as enhancement in definition, increase of the color reproduction range and increase in luminance advance, for example, in a color liquid crystal display apparatus, the power consumption of a backlight increases. Attention is paid to an apparatus which solves the problem just described. The apparatus has a four-subpixel configuration which includes, in addition to three subpixels including a red displaying subpixel for displaying red, a green displaying subpixel for displaying green and a blue displaying subpixel for displaying blue, for example, a white displaying subpixel for displaying white. The white displaying subpixel enhances the brightness. Since the four-subpixel configuration can achieve a high luminance with power consumption similar to that of display apparatus in related arts, if the luminance may be equal to that of display apparatus in related arts, then it is possible to decrease the power consumption of the backlight and improvement of the display quality can be anticipated.

For example, a color image display apparatus disclosed in Japanese Patent No. 3167026 (hereinafter referred to as Patent Document 1) includes:

means for producing three different color signals from an input signal using an additive primary color process; and means for adding the color signals of the three hues at equal ratios to produce an auxiliary signal and supplying totaling four display signals including the auxiliary signal and three different color signals obtained by subtracting the auxiliary signal from the signals of the three hues to a display unit.

It is to be noted that a red displaying subpixel, a green displaying subpixel and a blue displaying subpixel are driven by the three different color signals while a white displaying subpixel is driven by the auxiliary signal.

Meanwhile, Japanese Patent No. 3805150 (hereinafter referred to as Patent Document 2) discloses a liquid crystal display apparatus which includes a liquid crystal panel wherein a red outputting subpixel, a green outputting subpixel, a blue outputting subpixel and a luminance subpixel form on main pixel unit so that color display can be carried out, including:

calculation means for calculating, using digital values Ri, Gi and Bi of a red inputting subpixel, a green inputting subpixel and a blue inputting subpixel obtained from an input image signal, a digital value W for driving the luminance subpixel and digital values Ro, Go and Bo for driving the red inputting subpixel, green inputting subpixel and blue inputting subpixel;

the calculation means calculating such values of the digital values Ro, Go and Bo as well as W which satisfy a relationship of $$Ri:Gi:Bi=(Ro+W):(Go+W):(Bo+W)$$

and with which enhancement of the luminance from that of the configuration which includes only the red inputting subpixel, green inputting subpixel and blue inputting subpixel is achieved by the addition of the luminance subpixel.

Further, PCT/KR 2004/000659 (hereinafter referred to as Patent Document 3) discloses a liquid crystal display apparatus which includes first pixels each configured from a red displaying subpixel, a green displaying subpixel and a blue displaying subpixel and second pixels each configured from a red displaying subpixel, a green displaying subpixel and a white displaying subpixel and wherein the first and second pixels are arrayed alternately in a first direction and the first and second pixels are arrayed alternately also in a second direction. The Patent Document 3 further discloses a liquid crystal display apparatus wherein the first and second pixels are arrayed alternatively in the first direction while, in the second direction, the first pixels are arrayed adjacent each other and besides the second pixels are arrayed adjacent each other.

SUMMARY OF THE INVENTION

Incidentally, in the apparatus disclosed in Patent Document 1 and Patent Document 2, it is necessary to configure one pixel from four subpixels. This decreases the area of an aperture region of the red displaying subpixel or red outputting subpixel, green displaying subpixel or green outputting subpixel and blue displaying subpixel or blue outputting subpixel, resulting in decrease of the maximum light transmission amount through the aperture regions. Therefore, there are instances where intended increase in luminance of the entire pixel may not be achieved although the white displaying subpixel or luminance subpixel is additionally provided.

Meanwhile, in the apparatus disclosed in Patent Document 3, the second pixel includes a white displaying subpixel in place of the blue displaying subpixel. Further, an output signal to the white displaying subpixel is an output signal to a blue displaying subpixel assumed to exist before the replacement with the white displaying subpixel. Therefore, optimization of output signals to the blue displaying subpixel which composes the first pixel and the white displaying subpixel which composes the second pixel is not achieved. Further, since variation in color or variation in luminance occurs, there is a problem also in that the picture quality is deteriorated significantly.

Therefore, it is desirable to provide a driving method for an image display apparatus which can achieve optimization of output signals to individual subpixels and can achieve increase of the luminance with certainty and a driving method for an image display apparatus assembly which includes an image display apparatus of the type described.

According to an embodiment of the present invention, there is provided a driving method for an image display apparatus which includes an image display panel wherein totaling $P_0 \times Q_0$ pixels arrayed in a two-dimensional matrix including $P_0$ pixels arrayed in a first direction and $Q_0$ pixels arrayed in a second direction and a signal processing section, each of the pixels including a first subpixel for displaying a first primary color, a second subpixel for displaying a second primary color, a third subpixel for displaying a third primary color and a fourth subpixel for displaying a fourth color, the signal processing section being capable of:

calculating a first subpixel output signal to each of the pixels based on an first subpixel input signal to the pixel and outputting the first subpixel output signal to the first subpixel;

calculating a second subpixel output signal to the pixel based on a second subpixel input signal to the pixel and outputting the second subpixel output signal to the second subpixel; and calculating a third subpixel output signal to the pixel based on a third subpixel input signal to the pixel and outputting the third subpixel output signal to the third subpixel;

the driving method including the step, further carried out by the signal processing section, of calculating a fourth subpixel output signal based on a fourth subpixel control second signal calculated from the first subpixel input signal, second subpixel input signal and third subpixel input signal to a (p,q)th, where p is 1, 2, . . . , $P_0$ and q is 1, 2, . . . , $Q_0$ when the pixels are counted along the second direction, pixel and a fourth subpixel control first signal calculated from the first subpixel input signal, second subpixel input signal and third subpixel input signal to an adjacent pixel positioned adjacent the (p,q)th pixel along the second direction, and outputting the calculated fourth subpixel output signal to the fourth subpixel of the (p,q)th pixel.

According to an embodiment of the present invention, there is provided a driving method for an image display apparatus which includes an image display panel wherein totaling P×Q pixel groups arrayed in a two-dimensional matrix including P pixel groups arrayed in a first direction and Q pixel groups arrayed in a second direction and a signal processing section, each of the pixel groups being configured from a first pixel and a second pixel along the first direction, the first pixel including a first subpixel for displaying a first primary color, a second subpixel for displaying a second primary color and a third subpixel for displaying a third primary color, the second pixel including a first subpixel for displaying the first primary color, a second subpixel for displaying the second primary color and a fourth subpixel for displaying a fourth color, the signal processing section being capable of calculating a first subpixel output signal to the first pixel based at least on a first subpixel input signal to the first pixel and outputting the first subpixel output signal to the first subpixel of the first pixel, calculating a second subpixel output signal to the first pixel based at least on a second subpixel input signal to the first pixel and outputting the second subpixel output signal to the second subpixel of the first pixel, calculating a first subpixel output signal to the second pixel based at least on a first subpixel input signal to the second pixel and outputting the first subpixel output signal to the first subpixel of the second pixel, and calculating a second subpixel output signal to the second pixel based at least on a second subpixel input signal to the second pixel and outputting the second subpixel output signal to the second subpixel of the second pixel, the driving method including the steps, further carried out by the signal processing section, of:

calculating a fourth subpixel output signal based on a fourth subpixel control second signal calculated from the first subpixel input signal, second subpixel input signal and third subpixel input signal to a (p,q)th, where p is 1, 2, . . . , P and q is 1, 2, . . . , Q when the pixels are counted along the second direction, second pixel and a fourth subpixel control first signal calculated from the first subpixel input signal, second subpixel input signal and third subpixel input signal to an adjacent pixel positioned adjacent the (p,q)th pixel along the second direction, and outputting the calculated fourth subpixel output signal to the fourth subpixel of the (p,q)th second pixel; and further calculating a third subpixel output signal based at least on the third subpixel input signal to the (p,q)th second pixel and the third subpixel input signal to the (p,q)th first pixel and outputting the third subpixel output signal to the third subpixel.

According to an embodiment of the present invention, there is provided a driving method for an image display apparatus assembly which includes:

(A) an image display apparatus which includes an image display panel wherein totaling $P_0 \times Q_0$ pixels arrayed in a two-dimensional matrix including $P_0$ pixels arrayed in a first direction and $Q_0$ pixels arrayed in a second direction and a signal processing section; and (B) a planar light source apparatus for illuminating the image display apparatus from the rear side;

each of the pixels including a first subpixel for displaying a first primary color, a second subpixel for displaying a second primary color, a third subpixel for displaying a third primary color and a fourth subpixel for displaying a fourth color;

the signal processing section being capable of:

calculating a first subpixel output signal to each of the pixels based on an first subpixel input signal to the pixel and outputting the first subpixel output signal to the first subpixel;

calculating a second subpixel output signal to the pixel based on a second subpixel input signal to the pixel and outputting the second subpixel output signal to the second subpixel; and calculating a third subpixel output signal to the pixel based on a third subpixel input signal to the pixel and outputting the third subpixel output signal to the third subpixel;

the driving method including the step, further carried out by the signal processing section, of calculating a fourth subpixel output signal based on a fourth subpixel control second signal calculated from the first subpixel input signal, second subpixel input signal and third subpixel input signal to a (p,q)th, where p is 1, 2, . . . , $P_0$ and q is 1, 2, . . . , $Q_0$ when the pixels are counted along the second direction, pixel and a fourth subpixel control first signal calculated from the first subpixel input signal, second subpixel input signal and third subpixel input signal to an adjacent pixel positioned adjacent the (p,q)th pixel along the second direction, and outputting the calculated fourth subpixel output signal to the fourth subpixel of the (p,q)th pixel.

According to another embodiment of the present invention, there is provided a driving method for an image display apparatus assembly which includes:

(A) an image display apparatus which includes an image display panel wherein totaling P×Q pixel groups arrayed in a two-dimensional matrix including P pixel groups arrayed in a first direction and Q pixel groups arrayed in a second direction and a signal processing section; and (B) a planar light source apparatus for illuminating the image display apparatus from the rear side;

each of the pixel groups being configured from a first pixel and a second pixel along the first direction;

the first pixel including a first subpixel for displaying a first primary color, a second subpixel for displaying a second primary color and a third subpixel for displaying a third primary color;

the second pixel including a first subpixel for displaying the first primary color, a second subpixel for displaying the second primary color and a fourth subpixel for displaying a fourth color;

the signal processing section being capable of:

calculating a first subpixel output signal to the first pixel based at least on a first subpixel input signal to the first pixel and outputting the first subpixel output signal to the first subpixel of the first pixel;

calculating a second subpixel output signal to the first pixel based at least on a second subpixel input signal to the first pixel and outputting the second subpixel output signal to the second subpixel of the first pixel;

calculating a first subpixel output signal to the second pixel based at least on a first subpixel input signal to the second pixel and outputting the first subpixel output signal to the first subpixel of the second pixel; and calculating a second subpixel output signal to the second pixel based at least on a second subpixel input signal to the second pixel and outputting the second subpixel output signal to the second subpixel of the second pixel;

the driving method including the steps, further carried out by the signal processing section, of:

calculating a fourth subpixel output signal based on a fourth subpixel control second signal calculated from the first subpixel input signal, second subpixel input signal and third subpixel input signal to a (p,q)th, where p is 1, 2, . . . , P and q is 1, 2, . . . , Q when the pixels are counted along the second direction, second pixel and a fourth subpixel control first signal calculated from the first subpixel input signal, second subpixel input signal and third subpixel input signal to an adjacent pixel positioned adjacent the (p,q)th pixel along the second direction, and outputting the calculated fourth subpixel output signal to the fourth subpixel of the (p,q)th second pixel; and further calculating a third subpixel output signal based at least on the third subpixel input signal to the (p,q)th second pixel and the third subpixel input signal to the (p,q)th first pixel and outputting the third subpixel output signal to the third subpixel.

With the driving method for an image display apparatus and the driving method for an image display apparatus assembly according to the first embodiment of the present invention, a fourth subpixel output signal to the (p,q)th pixel is determined based on an input signal to the (p,q)th pixel and an input signal to a pixel positioned adjacent the (p,q)th pixel along the second direction. In other words, the fourth subpixel output signal to a certain pixel is determined based also on the input signal to a pixel positioned adjacent the certain pixel. Therefore, further optimization of the output signal to the fourth subpixel is anticipated. Further, since the fourth subpixel is provided, increase of the luminance can be achieved with certainty and improvement of the display quality can be anticipated.

With the driving method for an image display apparatus and the driving method for an image display apparatus assembly according to the second embodiment of the present invention, a fourth subpixel output signal to the (p,q)th second pixel is determined based on an input signal to the (p,q)th second pixel and an input signal to a pixel positioned adjacent the (p,q)th second pixel along the second direction. In other words, the fourth subpixel output signal to a certain second pixel which configures a certain pixel group is determined based not only on the input signal to the second pixel which configures the certain pixel group but also on the input signal to a pixel positioned adjacent the certain second pixel. Therefore, further optimization of the output signal to the fourth subpixel is achieved. Besides, since one fourth subpixel is disposed in the pixel group configured from the first and second pixels, decrease of the area of the aperture region of the subpixels can be suppressed. As a result, increase of the luminance can be achieved with certainty and improvement of the display quality can be anticipated.

The above and other objects, features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENTS

Figure 1:
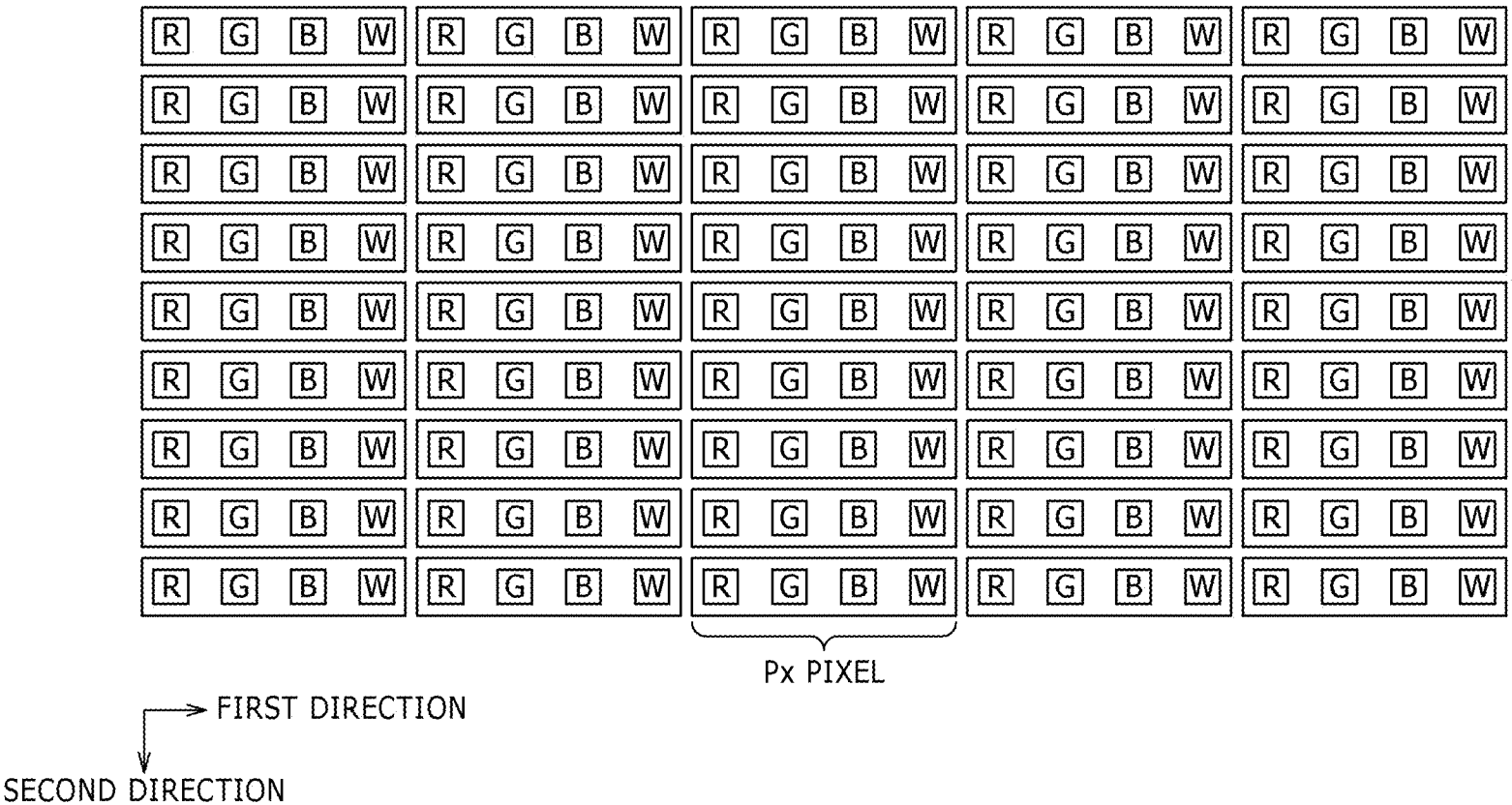
FIG. 1 is a view schematically illustrating arrangement of pixels and pixel groups on an image display panel of a working example 1 of the present invention.

In the following, the present invention is described in connection with preferred embodiments thereof. However, the present invention is not limited to the embodiments, and various numerical values, materials and so forth described in the description of the embodiments are merely illustrative. It is to be noted that the description is given in the following order.

1. General description of a driving method for an image display apparatus and a driving method for an image display apparatus assembly according to a first or second embodiment of the present invention
2. Working example 1 (driving method for the image display apparatus and driving method for the image display apparatus assembly according to the first embodiment of the present invention, 1Ath mode)
3. Working example 2 (modification to the working example 1, 1Ath mode)
4. Working example 3 (modification to the working example 2)
5. Working example 4 (another modification to the working example 2)
6. Working example 5 (driving method for the image display apparatus and driving method for the image display apparatus assembly according to the second embodiment of the present invention, 2Ath mode)
7. Working example 6 (modification to the working example 2, 2Bth mode), others General description of a driving method for an image display apparatus and a driving method for an image display apparatus assembly according to a first or second embodiment of the present invention A driving method according to a first embodiment of the present invention can be configured in the following manner.

In particular, regarding a (p,q)th pixel, a first subpixel input signal having a signal value of $x_{1-(p,q)}$, a second subpixel input signal having a signal value of $x_{2-(p,q)}$ and a third subpixel input signal having a signal value of $x_{3-(p,q)}$ are inputted to a signal processing section. Further, the signal processing section outputs, regarding the (p,q)th pixel, a first subpixel output signal having a signal value of $X_{1-(p,q)}$ for determining a display gradation of a first subpixel, a second subpixel output signal having a signal value of $X_{2-(p,q)}$ for determining a display gradation of a second subpixel, a third subpixel output signal having a signal value of $X_{3-(p,q)}$ for determining a display gradation of a third subpixel, and a fourth subpixel output signal having a signal value of $X_{4-(p,q)}$ for determining a display gradation of a fourth subpixel. Further, regarding an adjacent pixel positioned adjacent the (p,q)th pixel, a first subpixel input signal having a signal value of $x_{1-(p,q')}$, a second subpixel input signal having a signal value of $x_{2-(p,q')}$ and a third subpixel input signal having a signal value of $x_{3-(p,q')}$ are inputted to the signal processing section. Further, the signal processing section outputs, regarding the adjacent pixel, a first subpixel output signal having a signal value of $X_{1-(p,q')}$ for determining a display gradation of a first subpixel, a second subpixel output signal having a signal value of $X_{2-(p,q')}$ for determining a display gradation of a second subpixel, a third subpixel output signal having a signal value of $X_{3-(p,q')}$ for determining a display gradation of a third subpixel, and a fourth subpixel output signal having a signal value of $X_{4-(p,q)}$ for determining a display gradation of a fourth subpixel.

Meanwhile, a driving method according to a second embodiment of the present invention can be configured in the following manner.

In particular, regarding first pixel which configures a (p,q) th pixel group, a first subpixel input signal having a signal value of $x_{1-(p,q)-1}$, a second subpixel input signal having a signal value of $x_{2-(p,q)-1}$, and a third subpixel input signal having a signal value of $x_{3-(p,q)-1}$, are inputted to a signal processing section, and regarding a second pixel which configures the (p,q)th pixel group, a first subpixel input signal having a signal value of $x_{1-(p,q)-2}$, a second subpixel input signal having a signal value of $x_{2-(p,q)-2}$, and a third subpixel input signal having a signal value of $x_{3-(p,q)-2}$, are inputted to the signal processing section.

Further, regarding the first pixel which configures the (p,q) th pixel group, the signal processing section outputs a first subpixel output signal having a signal value of $X_{1-(p,q)-1}$ for determining a display gradation of the first subpixel, a second subpixel output signal having a signal value of $X_{2-(p,q)-1}$ for determining a display gradation of the second subpixel, and a third subpixel output signal having a signal value of $X_{3-(p,q)-1}$ for determining a display gradation of the third subpixel.

Further, regarding the second pixel which configures the (p,q)th pixel group, the signal processing section outputs a first subpixel output signal having a signal value of $X_{1-(p,q)-2}$ for determining a display gradation of the first subpixel, a second subpixel output signal having a signal value of $X_{2-(p,q)-2}$ for determining a display gradation of the second subpixel, and a fourth subpixel output signal having a signal value of $X_{4-(p,q)-2}$ for determining a display gradation of the fourth subpixel.

Further, regarding an adjacent pixel positioned adjacent the (p,q)th second pixel, a first subpixel input signal having a signal value of $x_{1-(p,q')}$, a second subpixel input signal having a signal value of $x_{2-(p,q')}$, and a third subpixel input signal having a signal value of $x_{3-(p,q')}$ are inputted to the signal processing section.

Here, $Max_{(p,q)}$, $Min_{(p,q)}$, $Max_{(p,q)-1}$, $Min_{(p,q)-1}$, $Max_{(p,q')-2}$, $Min_{(p,q-2)}$, $Max_{(p,q')}$ and $Min_{(p,q')}$ are defined in the following manner. Further, the terms "input signal" and "output signal" sometimes refer to signals themselves and sometimes refer to luminance of the signals.

$Max_{(p,q)}$: a maximum value among three subpixel input signal values including a first subpixel input signal value $x_{1-(p,q)}$, a second subpixel input signal value $x_{2-(p,q)}$ and a third subpixel input signal value $x_{3-(p,q)}$ to the (p,q)th pixel $Min_{(p,q)}$: a minimum value among the three subpixel input signal values including the first subpixel input signal value $x_{1-(p,q)}$, second subpixel input signal value $x_{2-(p,q)}$ and third subpixel input signal value $x_{3-(p,q)}$ to the (p,q)th pixel $Max_{(p,q)-1}$: a maximum value among three subpixel input signal values including a first subpixel input signal value $x_{1-(p,q)-1}$, a second subpixel input signal value $x_{2-(p,q)-1}$ and a third subpixel input signal value $x_{3-(p,q)-1}$ to the (p,q)th first pixel $Min_{(p,q)-1}$: a minimum value among the three subpixel input signal values including the first subpixel input signal value $x_{1-(p,q)-1}$, second subpixel input signal value $x_{2-(p,q)-1}$ and third subpixel input signal value $x_{3-(p,q)-1}$ to the (p,q)th first pixel $Max_{(p,q)-2}$: a maximum value among three subpixel input signal values including a first subpixel input signal value $x_{1-(p,q)-2}$, a second subpixel input signal value $x_{2-(p,q)-2}$ and a third subpixel input signal value $x_{3-(p,q)-2}$ to the (p,q)th second pixel $Min_{(p,q)-2}$: a minimum value among the three subpixel input signal values including the first subpixel input signal value $x_{1-(p,q)-2}$, second subpixel input signal value $x_{2-(p,q)-2}$ and third subpixel input signal value $x_{3-(p,q)-2}$ to the (p,q)th second pixel $Max_{(p,q')}$: a maximum value among three subpixel input signal values including a first subpixel input signal value $x_{1-(p,q')}$, a second subpixel input signal value $x_{2-(p,q')}$ and a third subpixel input signal value $x_{3-(p,q')}$ to an adjacent pixel positioned adjacent a (p,q)th pixel or a (p,q)th second pixel $Min_{(p,q')}$: a minimum value among the three subpixel input signal values including the first subpixel input signal value $x_{1-(p,q')}$, second subpixel input signal value $x_{2-(p,q')}$ and third subpixel input signal value $x_{3-(p,q')}$ to the adjacent pixel positioned adjacent the (p,q)th pixel or (p,q)th second pixel It is to be noted that the adjacent pixel positioned adjacent the (p,q)th pixel or the adjacent pixel positioned adjacent the (p,q)th second pixel may be the (p,q−1)th pixel, or may be a (p,q+1)th pixel or both of the (p,q−1)th pixel and the (p,q+1) th pixel.

The driving method according to the first embodiment of the present invention may have a mode in which the fourth subpixel control second signal value $SG_{2-(p,q)}$ is calculated based on $Min_{(p,q)}$ and the fourth subpixel control first signal value $SG_{1-(p,q)}$ is calculated based on $Min_{(p,q')}$. It is to be noted that such a mode as just described is hereinafter referred to as "1Ath mode" for the convenience of description.

More particularly, in the 1Ath mode, the fourth subpixel control second signal value $SG_{2-(p,q)}$ and the fourth subpixel control first signal value $SG_{1-(p,q)}$ can be calculated from expressions given below. It is to be noted that $c_{11}$, $c_{12}$, $c_{13}$, $c_{14}$, $c_{15}$ and $c_{16}$ in the expressions are constants. What value or what expression should be applied for the value of each of the fourth subpixel control second signal value $SG_{2-(p,q)}$ and the fourth subpixel control first signal value $SG_{1-(p,q)}$ may be determined suitably by making a prototype of the image display apparatus or the image display apparatus assembly and carrying out evaluation of images, for example, by an image observer.

$$SG_{2-(p,q)}=c_{11}(Min_{(p,q)}) \quad (1\text{-}1\text{-}A)$$

$$SG_{1-(p,q)}=c_{11}(Min_{(p,q')}) \quad (1\text{-}1\text{-}B)$$

or $$SG_{2-(p,q)}=c_{12}(Min_{(p,q)})^2 \quad (1\text{-}2\text{-}A),$$

$$SG_{1-(p,q)}=c_{12}(Min_{(p,q')})^2 \quad (1\text{-}2\text{-}B)$$

or else $$SG_{2-(p,q)}=c_{13}(Max_{(p,q)})^{1/2} \quad (1\text{-}3\text{-}A),$$

$$SG_{1-(p,q)}=c_{13}(Max_{(p,q')})^{1/2} \quad (1\text{-}3\text{-}B)$$

or else $$SG_{2-(p,q)}=c_{14}\{(Min_{(p,q)}/Max_{(p,q)-2}) \text{ or } (2^n-1)\} \quad (1\text{-}4\text{-}A)$$

$$SG_{1-(p,q)}=c_{14}\{(Min_{(p,q')}/Max_{(p,q')}) \text{ or } (2^n-1)\} \quad (1\text{-}4\text{-}B)$$

or else $$SG_{2-(p,q)}=c_{15}[\{(2^n-1)\cdot Min_{(p,q)}/(Max_{(p,q)}-Min_{(p,q)})\} \text{ or } (2^n-1)] \quad (1\text{-}5\text{-}A)$$

$$SG_{1-(p,q)}=c_{15}[\{(2^n-1)\cdot Min_{(p,q')}/(Max_{(p,q')}-Min_{p,q')})\} \text{ or } (2^n-1)] \quad (1\text{-}5\text{-}B)$$

or else $$SG_{2-(p,q)}=c_{16}\{\text{lower one of values of } Max_{(p,q)}^{1/2} \text{ and } Min_{(p,q)}\} \quad (1\text{-}6\text{-}A)$$

$$SG_{1-(p,q)}=c_{16}\{\text{lower one of values of } Max_{(p,q')}^{1/2} \text{ and } Min_{(p,q')}\} \quad (1\text{-}6\text{-}B)$$

Further, the 1Ath mode may be configured such that, regarding the (p,q)th pixel, the first subpixel output signal or first subpixel output signal value $X_{1-(p,q)}$ is calculated based at least on the first subpixel input signal, that is, first subpixel input signal value $x_{1-(p,q)}$, $Max_{(p,q)}$, $Min_{(p,q)}$ and fourth subpixel control second signal, that is, signal value $SG_{2-(p,q)}$;

the second subpixel output signal or second subpixel output signal value $X_{2-(p,q)}$ is calculated based at least on the second subpixel input signal, that is, second subpixel input signal value $x_{2-(p,q)}$, $Max_{(p,q)}$, $Min_{(p,q)}$ and fourth subpixel control second signal, that is, signal value $SG_{2-(p,q)}$; and the third subpixel output signal or third subpixel output signal value $X_{3-(p,q)}$ is calculated based at least on the third subpixel input signal, that is, third subpixel input signal value $x_{3-(p,q)}$, $Max_{(p,q)}$, $Min_{(p,q)}$ and fourth subpixel control second signal, that is, signal value $SG_{2-(p,q)}$.

Or, the driving method according to the first embodiment of the present invention can be configured such that, where $\chi$ is defined as a constant which depends upon the image display apparatus, a maximum value $V_{max}(S)$ of the brightness where the saturation S in an HSV (Hue, Saturation and Value) color space expanded by addition of a fourth color is used as a variable is calculated by the signal processing section, and the signal processing section (a) calculates the saturation S and the brightness V(S) of a plurality of pixels based on subpixel input signal values to the pixels, (b) calculates an expansion coefficient $\alpha_0$ based at least on one of the values of $V_{max}(S)/V(S)$ calculated with regard to the pixels, and (c) calculates the first subpixel output signal of the (p,q)th pixel based at least on the first subpixel input signal to the (p,q)th pixel and the expansion coefficient $\alpha_0$;

calculates the second subpixel output signal based at least on the second subpixel input signal to the (p,q)th pixel and the expansion coefficient $\alpha_0$; and calculates the third subpixel output signal based at least on the third subpixel input signal to the (p,q)th pixel and the expansion coefficient $\alpha_0$. It is to be noted that such a mode as just described is hereinafter referred to as "1Bth mode" for the convenience of description. The expansion coefficient $\alpha_0$ may be determined for each one image display frame. Further, in the configuration described above, subsequently to the step (c) described above, the luminance of the planar light source apparatus may be decreased based on the expansion coefficient $\alpha_0$.

Where the saturation of the (p,q)th pixel is represented by $S_{(p,q)}$ and the brightness by $V_{(p,q)}$, they can be represented in the following manner.

$$S_{(p,q)}=(\mathrm{Max}_{(p,q)}-\mathrm{Min}_{(p,q)})/\mathrm{Max}_{(p,q)}$$

$$V_{(p,q)}=\mathrm{Max}_{(p,q)}$$

It is to be noted that the saturation S can assume a value ranging from 0 to 1 and the brightness V can assume a value from 0 to $2^n-1$ where n is a display gradation bit number. "H" of the "HSV color space" signifies the hue representative of a type of a color, and "S" signifies the saturation or chroma representative of vividness of a color. Meanwhile, "V" signifies a brightness value or lightness value representative of brightness of a color. This similarly applies also to the following description.

Further, the fourth subpixel control second signal value $SG_{2-(p,q)}$ may be calculated based on $\mathrm{Min}_{(p,q)}$ and the expansion coefficient $\alpha_0$, and the fourth subpixel control first signal value $SG_{1-(p,q)}$ may be calculated based on $\mathrm{Min}_{(p,q')}$ and the expansion coefficient $\alpha_0$. More particularly, the fourth subpixel control second signal value $SG_{2-(p,q)}$ and the fourth subpixel control first signal value $SG_{1-(p,q)}$ can be calculated from expressions given below. It is to be noted that $c_{21}$, $c_{22}$, $c_{23}$, $c_{24}$, $c_{25}$ and $c_{26}$ in the expressions are constants. What value or what expression should be applied for the value of each of the fourth subpixel control second signal value $SG_{2-(p,q)}$ and the fourth subpixel control first signal value $SG_{1-(p,q)}$ may be determined suitably by making a prototype of the image display apparatus or the image display apparatus assembly and carrying out evaluation of images, for example, by an image observer.

$$SG_{2-(p,q)}=c_{21}(\mathrm{Min}_{(p,q)})\cdot\alpha_0 \quad (2\text{-}1\text{-}A),$$

$$SG_{1-(p,q)}=c_{21}(\mathrm{Min}_{(p,q')})\cdot\alpha_0 \quad (2\text{-}1\text{-}B)$$

or $$SG_{2-(p,q)}=c_{22}(\mathrm{Min}_{(p,q)})\cdot\alpha_0 \quad (2\text{-}2\text{-}A),$$

$$SG_{1-(p,q)}=c_{22}(\mathrm{Min}_{(p,q')})\cdot\alpha_0 \quad (2\text{-}2\text{-}B)$$

or else $$SG_{2-(p,q)}=c_{23}(\mathrm{Max}_{(p,q)})^{1/2}\cdot\alpha_0 \quad (2\text{-}3\text{-}A)$$

$$SG_{1-(p,q)}=c_{23}(\mathrm{Max}_{(p,q')})^{1/2}\cdot\alpha_0 \quad (2\text{-}3\text{-}B)$$

or else $$SG_{2-(p,q)}=c_{24}\{\text{product of } (\mathrm{Min}_{(p,q)}/\mathrm{Max}_{(p,q)-2}) \text{ or } (2^n-1) \text{ and } \alpha_0\} \quad (2\text{-}4\text{-}A)$$

$$SG_{1-(p,q)}=c_{24}\{\text{product of } (\mathrm{Min}_{(p,q')}/\mathrm{Max}_{(p,q')}) \text{ or } (2^n-1) \text{ and } \alpha_0\} \quad (2\text{-}4\text{-}B)$$

or else $$SG_{2-(p,q)}=c_{25}[\text{product of } \{(2^n-1)\cdot\mathrm{Min}_{(p,q)}/(\mathrm{Max}_{(p,q)}-\mathrm{Min}_{(p,q)})\} \text{ or } (2^n-1) \text{ and } \alpha_2] \quad (2\text{-}5\text{-}A)$$

$$SG_{1-(p,q)}=c_{25}[\text{product of } \{(2^n-1)\cdot\mathrm{Min}_{(p,q')}/(\mathrm{Max}_{(p,q')}-\mathrm{Min}_{(p,q')})\} \text{ or } (2^n-1) \text{ and } \alpha_2] \quad (2\text{-}5\text{-}B)$$

$$SG_{2-(p,q)}=c_{26}\{\text{product of lower one of values of } \mathrm{Max}_{(p,q)}^{1/2} \text{ and } \mathrm{Min}_{(p,q)} \text{ and } \alpha_0\} \quad (2\text{-}6\text{-}A)$$

$$SG_{1-(p,q)}=c_{26}\{\text{product of lower one of values of } \mathrm{Max}_{(p,q')}^{1/2} \text{ and } \mathrm{Min}_{(p,q')} \text{ and } \alpha_0\} \quad (2\text{-}6\text{-}B)$$

Further, in the 1Ath mode and the 1Bth mode described above, where $C_{11}$ and $C_{12}$ are constants, the fourth subpixel output signal value $X_{4-(p,q)}$ of the (p,q)th pixel is calculated by $$X_{4-(p,q)}=(C_{11}\cdot SG_{2-(p,q)}+C_{12}\cdot SG_{1-(p,q)})/(C_{11}+C_{12}) \quad (3\text{-}A)$$

or by $$X_{4-(p,q)}=C_{11}\cdot SG_{2-(p,q)}+C_{12}\cdot SG_{1-(p,q)} \quad (3\text{-}B)$$

or else by $$X_{4-(p,q)}=c_{11}\cdot(SG_{2-(p,q)}-SG_{1-(p,q)})+C_{12}\cdot SG_{1-(p,q)} \quad (3\text{-}C)$$

or can be calculated by $$X_{4-(p,q)}=[(SG_{2-(p,q)}^2+SG_{1-(p,q)}^2)/2]^{1/2} \quad (3\text{-}D)$$

What value or what expression should be applied for the value of the fourth subpixel output signal value $X_{4-(p,q)}$ may be calculated suitably by making a prototype of the image display apparatus or the image display apparatus assembly and carrying out evaluation of images, for example, by an image observer. Or, one of the expressions (3-A) to (3-D) may be selected depending upon the value of $SG_{2-(p,q)}$ or one of the expressions (3-A) to (3-D) may be selected depending upon the value of $SG_{1-(p,q)}$. Or else, one of the expressions (3-A) to (3-D) may be selected depending upon the values of $SG_{2-(p,q)}$ and $SG_{1-(p,q)}$. In other words, for each subpixel group, one of the expressions (3-A) to (3-D) may be used fixedly to calculate $X_{4-(p,q)}$, or for each subpixel group, one of the expressions (3-A) to (3-D) may be selectively used to calculate $X_{4-(p,q)}$.

An image display panel for use with the driving method according to the second embodiment of the present invention can be configured such that the first pixel and the second pixel are positioned adjacent each other in the second direction. In this instance, the first subpixel which configures the first pixel and the first subpixel which configures the second pixel may be disposed adjacent each other or may not be disposed adjacent each other in the second direction. Similarly, the second subpixel which configures the first pixel and the second subpixel which configures the second pixel may be disposed adjacent each other or may not be disposed adjacent each other in the second direction. Similarly, the third subpixel which configures the first pixel and the fourth subpixel which configures the second pixel may be disposed adjacent each other or may not be disposed adjacent each other in the second direction. Or, the image display panel may be configured such that the first pixels are disposed adjacent each other and the second pixels are disposed adjacent each other in the second direction. Also in this instance, the first subpixel which configures the first pixel and the first subpixel which configures the second pixel may be disposed adjacent each other or may not be disposed adjacent each other in the second direction. Similarly, the second subpixel which configures the first pixel and the second subpixel which configures the second pixel may be disposed adjacent each other or may not be disposed adjacent each other in the second direction. Similarly, the third subpixel which configures the first pixel and the fourth subpixel which configures the second pixel may be disposed adjacent each other or may not be disposed adjacent each other in the second direction.

The driving method according to the second embodiment of the present invention including the preferred configuration described hereinabove may have a mode wherein a fourth subpixel control second signal value $SG_{2-(p,q)}$ for the (p,q)th second pixel is obtained from $Min_{(p,q)-2}$; and a fourth subpixel control first signal $SG_{1-(p,q)}$ for an adjacent pixel positioned adjacent the (p,q)th second pixel is obtained from $Min_{(p,q')}$. It is to be noted that such a mode as just described is hereinafter referred to as "2Ath mode" for the convenience of description.

In particular, the fourth subpixel control second signal value $SG_{2-(p,q)}$ and the fourth subpixel control first signal value $SG_{1-(p,q)}$ are calculated using such expressions (1-1-A), (1-1-B), (1-2-A), (1-2-B), (1-3-A), (1-3-B), (1-4-A), (1-4-B), (1-5-A), (1-5-B), (1-6-A) and (1-6-B) as given hereinabove. What value or what expression should be applied for the value of each of the fourth subpixel control second signal value $SG_{2-(p,q)}$ and the fourth subpixel control first signal value $SG_{1-(p,q)}$ may be determined suitably by making a prototype of the image display apparatus or the image display apparatus assembly and carrying out evaluation of images, for example, by an image observer.

Further, the 2Ath mode can be configured in the following manner. In particular, with regard to the (p,q)th second pixel, the first subpixel output signal, that is, the first subpixel output signal value $X_{1-(p,q)-2}$, is calculated based at least on the first subpixel input signal, that is, the first subpixel input signal value $x_{1-(p,q)-2}$, $Max_{(p,q)-2}$, $Min_{(p,q)-2}$ and fourth subpixel control second signal, that is, signal value $SG_{2-(p,q)}$, and the second subpixel output signal, that is, the second subpixel output signal value $X_{2-(p,q)-2}$, is calculated based at least on the second subpixel input signal, that is, the second subpixel input signal value $x_{2-(p,q)-2}$, $Max_{(p,q)-2}$, $Min_{(p,q)-2}$ and fourth subpixel control second signal, that is, signal value $SG_{2-(p,q)}$. Further, with regard to the (p,q)th first pixel, the first subpixel output signal, that is, the first subpixel output signal value $X_{1-(p,q)-1}$, is calculated based at least on the first subpixel input signal, that is, the first subpixel input signal value $x_{1-(p,q)-1}$, $Max_{(p,q)-1}$, $Min_{(p,q)-1}$ and third subpixel control signal, that is, signal value $SG_{3-(p,q)}$, and the second subpixel output signal, that is, the second subpixel output signal value $X_{2-(p,q)-1}$, is calculated based at least on the second subpixel input signal, that is, the second subpixel input signal value $x_{2-(p,q)-1}$, $Max_{(p,q)-1}$, $Min_{(p,q)-1}$ and third subpixel control signal, that is, signal value $SG_{3-(p,q)}$.

It is to be noted that the control signal value, that is, the third subpixel control signal value $SG_{3-(p,q)}$ can be obtained by replacing "$Max_{(p,q')}$" and "$Min_{(p,q')}$" in the expressions (1-1-B), (1-2-B), (1-3-B), (1-4-B), (1-5-B), (1-6-B), (2-1-B), (2-2-B), (2-3-B), (2-4-B), (2-5-B) and (2-6-B) with "$Max_{(p,q)-1}$" and "$Min_{(p,q)-1}$," respectively.

Or, the driving method according to the second embodiment of the present invention including the preferred configurations described above may be configured such that, where $\chi$ is a constant which depends upon the image display apparatus, a maximum value $V_{max}(S)$ of brightness where a saturation S in an HSV color space enlarged by adding the fourth color is used as a variable is calculated by the signal processing section, and the signal processing section (a) calculates the saturation S and the brightness V(S) of a plurality of pixels based on the subpixel input signal values in the plural pixels;

(b) calculates an expansion coefficient $\alpha_0$ based at least on one value from among the values of $V_{max}(S)/V(S)$ calculated with regard to the plural pixels; and (c) calculates the first subpixel output signal value $X_{1-(p,q)-2}$ of the (p,q)th second pixel based on the first subpixel input signal value $x_{1-(p,q)-2}$, expansion coefficient $\alpha_0$ and constant $\chi$, the second subpixel output signal value $X_{2-(p,q)-2}$ of the second pixel being calculated based on the second subpixel input signal value $x_{2-(p,q)-2}$, expansion coefficient $\alpha_0$ and constant $\chi$, the fourth subpixel output signal value $X_{4-(p,q)-2}$ of the second pixel being calculated based on the fourth subpixel control second signal value $SG_{2-(p,q)}$, a fourth subpixel control first signal value $SG_{1-(p,q)}$, expansion coefficient $\alpha_0$ and constant $\chi$. It is to be noted that such a mode as described above is hereinafter referred to as "2Bth mode" for the convenience of description. The driving method may be configured such that the expansion coefficient $\alpha_0$ is determined for each one image display frame. Further, the driving method may be configured such that the first subpixel output signal value $X_{1-(p,q)-1}$ of the first pixel is calculated based on the first subpixel input signal value $x_{1-(p,q)-1}$, expansion coefficient $\alpha_0$ and constant $\chi$, and the second subpixel output signal value $X_{2-(p,q)-1}$ of the first pixel is calculated based on the second subpixel input signal value $x_{2-(p,q)-1}$, expansion coefficient $\alpha_0$ and constant $\chi$. It is to be noted that such a mode as described above is hereinafter referred to as "2Bth mode" for the convenience of description. The driving method may be configured such that the expansion coefficient $\alpha_0$ is determined for each one image display frame.

In the case where the saturation and the brightness of the (p,q)th first pixel and the saturation and the brightness of the (p,q)th second pixel are represented, where the saturation and the brightness of the first pixel are indicated by $S_{(p,q)-1}$ and $V_{(p,q)-1}$, respectively, the saturation and the brightness of the second pixel are indicated by $S_{(p,q)-2}$ and $V_{(p,q)-2}$, respectively, as $$S_{(p,q)-1}=(Max_{(p,q)-1}-Min_{(p,q)-1})/Max_{(p,q)-1}$$

$$V_{(p,q)-1}=(Max_{(p,q)-1}$$

$$S_{(p,q)-2}=(Max_{(p,q)-2}-Min_{(p,q)-2})/Max_{(p,q)-2}$$

$$V_{(p,q)-2}=Max_{(p,q)-2}$$

Further, the driving method may be configured such that the fourth subpixel control second signal value $SG_{2-(p,q)}$ is calculated based on $Min_{(p,q)-2}$ and the expansion coefficient $\alpha_0$ and the fourth subpixel control first signal value $SG_{1-(p,q)}$ is calculated based on $Min_{(p,q')}$ and the expansion coefficient $\alpha_0$. More particularly, the fourth subpixel control second signal value $SG_{2-(p,q)}$ and the fourth subpixel control first signal value $SG_{1-(p,q)}$ can be calculated using the expressions (2-1-A), (2-1-B), (2-2-A), (2-2-B), (2-3-A), (2-3-B), (2-4-A), (2-4-B), (2-5-A), (2-5-B), (2-6-A) and (2-6-B). What value or what expression should be applied for the value of each of the fourth subpixel control second signal value $SG_{2-(p,q)}$ and the fourth subpixel control first signal value $SG_{1-(p,q)}$ may be determined suitably by making a prototype of the image display apparatus or the image display apparatus assembly and carrying out evaluation of images, for example, by an image observer.

Further, in the 2Ath mode and the 2Bth mode described hereinabove, where $C_{21}$ and $C_{22}$ are constants, the fourth subpixel output signal value $X_{4-(p,q)-2}$ of the (p,q)th second pixel can be calculated by $$X_{4-(p,q)-2}=(C_{21}\cdot SG_{2-(p,q)}+C_{22}\cdot SG_{1-(p,q)})/(C_{21}+C_{22}) \quad (4\text{-A})$$

or calculated by $$X_{4-(p,q)-2}=C_{21}\cdot SG_{2-(p,q)}+C_{22}\cdot SG_{1-(p,q)} \quad (4\text{-B})$$

or else calculated by $$X_{4-(p,q)-2}=C_{21}\cdot(SG_{2-(p,q)}-SG_{1-(p,q)})+C_{22}\cdot SG_{1-(p,q)} \quad (4\text{-C})$$

Or else, the fourth subpixel output signal value $X_{4-(p,q)-2}$ of the (p,q)th second pixel can be calculated by $$X_{4-(p,q)-2}=[(SG_{2-(p,q)}^2+SG_{1-(p,q)}^2)/2]^{1/2} \quad (4\text{-D})$$

What value or what expression should be applied for the value of the fourth subpixel output signal value $X_{4-(p,q)-2}$ may be determined suitably by making a prototype of the image display apparatus or the image display apparatus assembly and carrying out evaluation of images, for example, by an image observer. Or, one of the expressions (4-A) to (4-D) may be selected depending upon the value of $SG_{2-(p,q)}$ or one of the expressions (4-A) to (4-D) may be selected depending upon the value of $SG_{1-(p,q)}$. Or else, one of the expressions (4-A) to (4-D) may be selected depending upon the values of $SG_{2-(p,q)}$ and $SG_{1-(p,q)}$. In other words, for each subpixel group, one of the expressions (4-A) to (4-D) may be used fixedly to determine $X_{4-(p,q)-2}$, or one of the expressions (4-A) to (4-D) may be selectively used to determine $X_{4-(p,q)-2}$ for each subpixel group.

In the 1Bth mode or the 2Bth mode including the preferred configurations and modes described hereinabove, a maximum value $V_{max}(S)$ of brightness where a saturation S in an HSV color space enlarged by adding a fourth color is used as a variable is stored in the signal processing section or is calculated by the signal processing section. Then, the saturation S and the brightness V(S) of a plurality of pixels are calculated based on the subpixel input signal values of the plural pixels, and further, an expansion coefficient $\alpha_0$ is calculated based on $V_{max}(S)/V(S)$. Furthermore, the output signal value is calculated based on the input signal value and the expansion coefficient $\alpha_0$. If the output signal value is expanded based on the expansion coefficient $\alpha_0$, then although the luminance of the white display subpixel increases as in the existing art, such a situation that the luminance of the red display subpixel, green display subpixel and blue display subpixel does not increase does not occur. In other words, not only the luminance of the white display subpixel increases, but also the luminance of the red display subpixel, green display subpixel and blue display subpixel increases. Therefore, occurrence of such a problem that darkening in color occurs can be prevented with certainty. It is to be noted that the output signal values $X_{1-(p,q)}$, $X_{2-(p,q)}$ and $X_{3-(p,q)}$ and the output signal values $X_{1-(p,q)-1}$, $X_{2-(p,q)-1}$, $X_{3-(p,q)-1}$, $X_{1-(p,q)-2}$ and $X_{2-(p,q)-2}$ can be calculated based on the expansion coefficient $\alpha_0$ and the constant $\chi$. More particularly, the output signal values mentioned can be calculated from the following expressions. It is to be noted that the luminance of the fourth subpixel in the (p,q)th second pixel is represented by $\chi\cdot X_{4(p,q)-2}$.

1Bth mode $$X_{1-(p,q)}=\alpha_0\cdot x_{1-(p,q)}-\chi\cdot SG_{2-(p,q)} \quad (5\text{-A})$$

$$X_{2-(p,q)}=\alpha_0\cdot x_{2-(p,q)}-\chi\cdot SG_{2-(p,q)} \quad (5\text{-B})$$

$$X_{3-(p,q)}=\alpha_0\cdot x_{3-(p,q)}-\chi\cdot SG_{2-(p,q)} \quad (5\text{-C})$$

2Bth mode $$X_{1-(p,q)-1}=\alpha_0\cdot x_{1-(p,q)-1}-\chi\cdot SG_{3-(p,q)} \quad (5\text{-a})$$

$$X_{2-(p,q)-1}=\alpha_0\cdot x_{2-(p,q)-1}-\chi\cdot SG_{3-(p,q)} \quad (5\text{-b})$$

$$X'_{3-(p,q)-3}=\alpha_0\cdot x_{3-(p,q)-1}-\chi\cdot SG_{3-(p,q)} \quad (5\text{-c})$$

$$X_{1-(p,q)-2}=\alpha_0\cdot x_{1-(p,q)-2}-\chi\cdot SG_{2-(p,q)} \quad (5\text{-d})$$

$$X_{2-(p,q)-2}=\alpha_0\cdot x_{2-(p,q)-2}-\chi\cdot SG_{2-(p,q)} \quad (5\text{-e})$$

$$X'_{3-(p,q)-2}=\alpha_0\cdot x_{3-(p,q)-2}-\chi\cdot SG_{2-(p,q)} \quad (5\text{-f})$$

Further, in the 2Ath mode and the 2Bth mode described above, where $C_{31}$ and $C_{32}$ are constants, the third subpixel output signal, that is, the third subpixel output signal value $X_{3-(p,q)-1}$, can be calculated, for example, from the following expressions.

$$X_{3-(p,q)-1}=(C_{31}\cdot X'_{3-(p,q)-1}+C_{32}\cdot X'_{3-(p,q)-2})/(C_{21}+C_{22}) \quad (6\text{-a})$$

or $$X_{3-(p,q)-1}=C_{31}\cdot X'_{3-(p,q)-1}+C_{32}\cdot X'_{3-(p,q)-2} \quad (6\text{-b})$$

or $$X_{3-(p,q)-1}=C_{21}\cdot X'_{3-(p,q)-1}-X'_{3-(p,q)-2})+C_{22}\cdot X'_{3-(p,q)-2} \quad (6\text{-c})$$

Generally, where the luminance of a set of first, second and third subpixels which configure a pixel or a pixel group when a signal having a value corresponding to a maximum signal value of the first subpixel output signal is inputted to the first subpixel and a signal having a value corresponding to a maximum signal value of the second subpixel output signal is inputted to the second subpixel and besides a signal having a value corresponding to a maximum signal value of the third subpixel output signal is inputted to the third subpixel is represented by $BN_{1-3}$ and the luminance of the fourth subpixel when a signal having a value corresponding to a maximum signal value of the fourth subpixel output signal is inputted to the fourth subpixel which configures the pixel or the pixel group is represented by $BN_4$, the constant $\chi$ can be represented as $$\chi=BN_4/BN_{1-3}$$

where the constant $\chi$ is a value unique to the image display panel, image display apparatus or image display apparatus assembly and is determined uniquely by the image display panel, image display apparatus or image display apparatus assembly.

The mode can be configured such that a minimum value $\alpha_{min}$ from among values of $V_{max}(S)/V(S)$ [$\equiv\alpha(S)$] calculated with regard to the plural pixels is determined as the expansion coefficient $\alpha_0$. Or, although it depends upon an image to be displayed, one of values within $(1\pm0.4)\cdot\alpha_{min}$ may be used as the expansion coefficient $\alpha_0$. Or else, although the expansion coefficient $\alpha_0$ is determined based at least on one value from among values of $V_{max}(S)/V(S)$ [$\equiv(S)$] determined with regard to the plural pixels, the expansion coefficient $\alpha_0$ may be calculated based on one of the values such as, for example, the minimum value $\alpha_{min}$, or a plurality of values $\alpha(S)$ may be calculated in order beginning with the minimum value and an average value $\alpha_{ave}$ of the values may be used as the expansion coefficient $\alpha_0$. The expansion coefficient $\alpha_0$ may be determined from among $(1\pm0.4)\cdot\alpha_{ave}$. Or otherwise, in the case where the number of pixels when the plural values $\alpha(S)$ are calculated in order beginning with the minimum value is smaller than a predetermined number, the plural number may be changed to determine again a plurality of values $\alpha(S)$ in order beginning with the minimum value. Further, in the case where all of the input signal values in some pixel group are equal to "0" or very low, such pixel groups may be excluded to calculate the expansion coefficient $\alpha_0$.

The fourth color may be white. However, the fourth color is not limited to this. The fourth color may be some other color such as, for example, yellow, cyan or magenta. In those cases, where the image display apparatus is configured from a color liquid crystal display apparatus, it may further include a first color filter disposed between the first subpixels and an image observer for transmitting the first primary color therethrough, a second color filter disposed between the second subpixels and the image observer for transmitting the second primary color therethrough, and a third color filter disposed between the third subpixels and the image observer for transmitting the third primary color therethrough.

Where $p_0$ is the number of pixels which configure one pixel group and $p_0 \times P \equiv P_0$, a mode may be adopted wherein the plural pixels with regard to which the saturation S and the brightness V(S) are to be calculated may be all of the $P_0 \times Q$ pixels. Or another mode may be adopted wherein the plural pixels with regard to which the saturation S and the brightness V(S) are to be calculated may be $P_0/P' \times Q/Q'$ pixels where $P_0 \geq P'$ and $Q \geq Q'$ and besides at least one of $P_0/P'$ and $Q/Q'$ is a natural number equal to or greater than 2. It is to be noted that the particular value of $P_0/P'$ or $Q/Q'$ may be powers of 2 such as 2, 4, 8, 16, . . . . If the former mode is adopted, then the picture quality can be maintained good to the upmost without picture quality variation. On the other hand, if the latter mode is adopted, then improvement of the processing speed and simplification of the circuitry of the signal processing section can be anticipated. It is to be noted that, in such an instance, for example, if $P_0/P'=4$ and $Q/Q'=4$, then since one saturation S and one brightness value V(S) are calculated from every four pixels, with the remaining three pixels, the value of $V_{max}(S)/V(S)$ [$\equiv\alpha(S)$] may possibly be lower than the expansion coefficient $\alpha_0$. In particular, the value of the expanded output signal may possibly exceed $V_{max}(S)$. In such an instance, for example, the upper limit value of the value of the expanded output signal may be made coincident with $V_{max}(S)$.

Although the shape of each subpixel usually is a rectangular shape, preferably each subpixel is disposed such that the major side thereof extends in parallel to the second direction and the minor side thereof extends in parallel to the first direction.

As a light source for configuring a planar light source apparatus, a light emitting element, particularly a light emitting diode (LED), can be used. A light emitting element formed from a light emitting diode has a comparatively small occupying volume, and it is suitable to dispose a plurality of light emitting elements. As the light emitting diode as a light emitting element, a white light emitting diode, for example, a light emitting diode configured from a combination of a purple or blue light emitting diode and light emitting particles so that white light is emitted.

Here, as the light emitting particles, red light emitting phosphor particles, green light emitting phosphor particles and blue light emitting phosphor particles can be used. As a material for configuring the red light emitting phosphor particles, $Y_2O_3$:Eu, $YVO_4$:Eu, Y(P, V)$O_4$:Eu, 3.5MgO.0.5$MgF_2$.$Ge_2$:Mn, $CaSiO_3$:Pb, Mn, $Mg_6AsO_{11}$:Mn, (Sr, Mg)$_3$ $(PO_4)_3$: Sn, $La_2O_2S$:Eu, $Y_2O_2S$:Eu, (ME:Eu)S (where "ME" signifies at least one kind of atom selected from a group including Ca, Sr and Ba, and this similarly applies also to the following description), $(M:Sm)_x(Si, Al)_{12}(O, N)_{16}$ (where "M" signifies at least one kind of atom selected from a group including Li, Mg and Ca, and this similarly applies also to the following description), $Me_2Si_5N_8$:Eu, (Ca:Eu)$SiN_2$, and (Ca:Eu)$AlSiN_3$ can be applied. Meanwhile, as a material for configuring the green light emitting phosphor particles, $LaPO_4$:Ce, Tb, $BaMgAl_{10}O_{17}$:Eu, Mn, $Zn_2SiO_4$:Mn, $MgAl_{11}O_{18}$:Ce, Tb, $Y_2SiO_5$:Ce, Tb, $MgAl_{11}O_{19}$:CE, Tb and Mn can be used. Further, (ME:Eu)$Ga_2S_4$, $(M:RE)_x(Si, Al)_{12}(O, N)_{16}$ (where "RE" signifies Tb and Yb), $(M:Tb)_x(Si, Al)_{12}(O, N)_{16}$, and $(M:Yb)_x(Si, Al)_{12}(O, N)_{16}$ can be used. Furthermore, as a material for configuring the blue light emitting phosphor particles, $BaMgAl_{10}O_{17}$:Eu, $BaMg_2Al_{18}O_{27}$:Eu, $Sr_2P_2O_7$:Eu, $Sr_5(PO_4)_3Cl$:Eu, (Sr, Ca, Ba, Mg)$_5$ $(PO_4)_3Cl$:Eu, $CaWO_4$ and $CaWO_4$:Pb can be used. However, the light emitting particles are not limited to phosphor particles, and, for example, for a silicon type material of the indirect transition type, light emitting particles can be applied to which a quantum well structure such as a two-dimensional quantum well structure, a one-dimensional quantum well structure (quantum thin line) or zero-dimensional quantum well structure (quantum dot) which uses a quantum effect by localizing a wave function of carriers is applied in order to convert the carries into light efficiently like a material of the direct transition type. Or, it is known that rare earth atoms added to a semiconductor material emit light sharply by transition in a shell, and also light emitting particles which apply such a technique as just described can be used.

Or else, a light source for configuring a planar light source apparatus may be configured from a combination of a red light emitting element such as, for example, a light emitting diode for emitting light of red of a dominant emitted light wavelength of, for example, 640 nm, a green light emitting element such as, for example, a GaN-based light emitting diode for emitting light of green of a dominant emitted light wavelength of, for example, 530 nm, and a blue light emitting element such as, for example, a GaN-based light emitting diode for emitting light of blue of a dominant emitted light wavelength of, for example, 450 nm. The planer light source apparatus may include a light emitting element emits light of a fourth color or a fifth color other than red, green and blue.

The light emitting diode may have a face-up structure or a flip chip structure. In particular, the light emitting diode is configured from a substrate and a light emitting layer formed on the substrate and may be configured such that light is emitted to the outside from the light emitting layer or light from the light emitting layer is emitted to the outside through the substrate. More particularly, the light emitting diode (LED) has a laminate structure, for example, of a first compound semiconductor layer formed on a substrate and having a first conduction type such as, for example, the n type, an active layer formed on the first compound semiconductor layer, and a second compound semiconductor layer formed on the active layer and having a second conduction type such as, for example, the p type. The light emitting diode includes a first electrode electrically connected to the first compound semiconductor layer, and a second electrode electrically connected to the second compound semiconductor layer. The layers which configure the light emitting diode may be made of known compound semiconductor materials relying upon the emitted light wavelength.

The planar light source apparatus may be formed as any of two different types of planar light apparatus or backlights including a direct planar light source disclosed, for example, in Japanese Utility Model Laid-Open No. Sho 63-187120 or Japanese Patent Laid-Open No. 2002-277870 and an edge light type or side light type planar light source apparatus disclosed, for example, in Japanese Patent Laid-Open No. 2002-131552.

The direct planar light source apparatus can be configured such that a plurality of light emitting elements each serving as a light source are disposed and arrayed in a housing. However, the direct planar light source apparatus is not limited to this. Here, in the case where a plurality of red light emitting elements, a plurality of green light emitting elements and a plurality of blue light emitting elements are disposed and arrayed in a housing, the following array state of the light emitting elements is available. In particular, a plurality of light emitting element groups each including a red light emitting element, a green light emitting element and a blue light emitting element are disposed continuously in a horizontal direction of a screen of an image display panel such as, for example, a liquid crystal display apparatus to form a light emitting element group array. Further, a plurality of such light emitting element group arrays are juxtaposed continuously in a vertical direction of the screen of the image display panel. It is to be noted that the light emitting element group can be formed in several combinations including a combination of one red light emitting element, one green light emitting element and one blue light emitting element, another combination of one red light emitting element, two green light emitting elements and one blue light emitting element, a further combination of two red light emitting elements, two green light emitting elements and one blue light emitting element, and so forth. It is to be noted that, to each light emitting element, such a light extraction lens as disclosed, for example, in *Nikkei Electronics*, No. 889, Dec. 20, 2004, p. 128 may be attached.

Further, where the direct planar light source apparatus is configured from a plurality of planar light source units, one planer light source unit may be configured from one light emitting element group or from two or more light emitting element groups. Or else, one planar light source unit may be configured from a single white light emitting diode or from two or more white light emitting diodes.

In the case where a direct planar light source apparatus is configured from a plurality of planar light source units, a partition wall may be disposed between the planar light source units. As the material for configuring the partition wall, an impenetrable material by light emitted from a light emitting element provided in the planar light source unit particularly such as an acrylic-based resin, a polycarbonate resin or an ABS resin is applicable. Or, as a material penetrable by light emitted from a light emitting element provided in the planar light source unit, a polymethyl methacrylate resin (PMMA), a polycarbonate resin (PC), a polyarylate resin (PAR), a polyethylene terephthalate resin (PET) or glass can be used. A light diffusing reflecting function may be applied to the surface of the partition wall, or a mirror surface reflecting function may be applied. In order to apply the light diffusing reflecting function to the surface of the partition wall, concaves and convexes may be formed on the partition wall surface by sand blasting or a film having concaves and convexes, that is, a light diffusing film, may be adhered to the partition wall surface. In order to apply the mirror surface reflecting function to the partition wall surface, a light reflecting film may be adhered to the partition wall surface or a light reflecting layer may be formed on the partition wall surface, for example, by plating.

The direct planar light source apparatus can be configured including a light diffusing plate, an optical function sheet group including a light diffusing sheet, a prism sheet or a light polarization conversion sheet, and a light reflecting sheet. For the light diffusing plate, light diffusing sheet, prism sheet, light polarization conversion sheet and light reflecting sheet, known materials can be used widely. The optical function sheet group may be formed from various sheets disposed in a spaced relationship from each other or laminated in an integrated relationship with each other. For example, a light diffusing sheet, a prism sheet, a light polarization conversion sheet and so forth may be laminated in an integrated relationship with each other. The light diffusing plate and the optical function sheet group are disposed between the planar light source apparatus and the image display panel.

Meanwhile, in the edge light type planar light source apparatus, a light guide plate is disposed in an opposing relationship to an image display panel, particularly, for example, a liquid crystal display apparatus, and light emitting elements are disposed on a side face, a first side face hereinafter described, of the light guide plate. The light guide plate has a first face or bottom face, a second face or top face opposing to the first face, a first side face, a second side face, a third side face opposing to the first side face, and a fourth side face opposing to the second side face. As a more particular shape of the light guide plate, a generally wedge-shaped truncated quadrangular pyramid shape may be applied. In this instance, two opposing side faces of the truncated quadrangular pyramid correspond to the first and second faces, and the bottom face of the truncated quadrangular pyramid corresponds to the first side face. Preferably, convex portions and/or concave portions are provided on a surface portion of the first face or bottom face. Light is introduced into the light guide plate through the first side face and is emitted from the second face or top face toward the image display panel. The second face of the light guide plate may be in a smoothened state, or as a mirror surface, or may be provided with blast embosses which exhibit a light diffusing effect, that is, as a finely roughened face.

Preferably, convex portions and/or concave portions are provided on the first face or bottom face. In particular, it is preferable to provide the first face of the light guide plate with convex portions or concave portions or else with concave-convex portions. Where the concave-convex portions are provided, the concave portions and convex portions may be formed continuously or not continuously. The convex portions and/or the concave portions provided on the first face of the light guide plate may be configured as successive convex portions or concave portions extending in a direction inclined by a predetermined angle with respect to the incidence direction of light to the light guide plate. With the configuration just described, as a cross sectional shape of the successive convexes or concaves when the light guide plate is cut along a virtual plane extending in the incidence direction of light to the light guide plate and perpendicular to the first face, a triangular shape, an arbitrary quadrangular shape including a square shape, a rectangular shape and a trapezoidal shape, an arbitrary polygon, or an arbitrary smooth curve including a circular shape, an elliptic shape, a parabola, a hyperbola, a catenary and so forth can be applied. It is to be noted that the direction inclined by a predetermined angle with respect to the incidence direction of light to the light guide plate signifies a direction within a range from 60 to 120 degrees in the case where the incidence direction of light to the light guide plate is 0 degrees. This similarly applies also in the following description. Or the convex portions and/or the concave portions provided on the first face of the light guide plate may be configured as non-continuous convex portions and/or concave portions extending along a direction inclined by a predetermined angle with respect to the incidence direction of light to the light guide plate. In such a configuration as just described, as a shape of the non-continuous convexes or concaves, such various curved faces as a pyramid, a cone, a circular cylinder, a polygonal prism including a triangular prism and a quadrangular prism, part of a sphere, part of a spheroid, part of a paraboloid and part of a hyperboloid can be applied. It is to be noted that, as occasion demands, convex portions or concave portions may not be formed at peripheral edge portions of the first face of the light guide plate. Further, while light emitted from the light source and introduced into the light guide plate collides with and is diffused by the convex portions or the concave portions formed on the first face, the height or depth, pitch and shape of the convex portions or concave positions formed on the first face of the light guide plate may be fixed or may be varied as the distance from the light source increases. In the latter case, for example, the pitch of the convex portions or the concave portions may be made finer as the distance from the light source increases. Here, the pitch of the convex portions or the pitch of the concave portions signifies the pitch of the convex portions or the pitch of the concave portions along the incidence direction of light to the light guide plate.

In a planar light source apparatus which includes a light guide plate, preferably a light reflecting member is disposed in an opposing relationship to the first face of the light guide plate. An image display panel, particularly, for example, a liquid crystal display apparatus, is disposed in a opposing relationship to the second face of the light guide plate. Light emitted from the light source enters the light guide plate through the first side face which corresponds, for example, to the bottom face of the truncated quadrangular pyramid. Thereupon, the light collides with and is scattered by the convex portions or the concave portions of the first face and then goes out from the first face of the light guide plate, whereafter it is reflected by the light reflecting member and enters the light guide plate through the first face. Thereafter, the light emerges from the second face of the light guide plate and irradiates the image display panel. For example, a light diffusing sheet or a prism sheet may be disposed between the image display panel and the second face of the light guide plate. Or, light emitted from the light source may be introduced directly to the light guide plate or may be introduced indirectly to the light guide plate. In the latter case, for example, an optical fiber may be used.

Preferably, the light guide plate is produced from a material which does not absorb light emitted from the light source very much. In particular, as a material for configuring the light guide plate, for example, glass, a plastic material such as, for example, PMMA, a polycarbonate resin, an acrylic-based resin, an amorphous polypropylene-based resin and a styrene-based resin including an AS resin can be used.

In the present invention, the driving method and the driving conditions of a planar light source apparatus are not limited particularly, and the light sources may be controlled collectively. In particular, for example, a plurality of light emitting elements may be driven at the same time. Or, a plurality of light emitting elements may be driven partially or divisionally. In particular, where a planar light source apparatus is configured from a plurality of planar light source units, the planar light source apparatus may be configured from S×T planar light source units corresponding to S×T display region units when it is assumed that the display region of the image display panel is virtually divided into the S×T display region units. In this instance, the light emitting state of the S×T planar light source units may be controlled individually.

A driving circuit for a planar light source apparatus and an image display panel includes, for example, a planar light source apparatus control circuit configured form a light emitting diode (LED) driving circuit, a calculation circuit, a storage device or memory and so forth, and an image display panel driving circuit configured from a known circuit. It is to be noted that a temperature control circuit can be included in the planar light source apparatus control circuit. Control of the luminance of the display region, that is, the display luminance, and the luminance of the planar light source unit, that is, the light source luminance, is carried out for every one image display frame. It is to be noted that the number of image information to be sent for one second as an electric signal to the drive circuit, that is, the number of images per second, is a frame frequency or frame rate, and the reciprocal number of the frame frequency is frame time whose unit is second.

A liquid crystal display apparatus of the transmission type includes, for example, a front panel including a transparent first electrode, a rear panel including a transparent second electrode, and a liquid crystal material disposed between the front panel and the rear panel.

The front panel is configured more particularly from a first substrate formed, for example, from a glass substrate or a silicon substrate, a transparent first electrode also called common electrode provided on an inner face of the first substrate and made of, for example, ITO (indium tin oxide), and a polarizing film provided on an outer face of the first substrate. Further, the color liquid crystal display apparatus of the transmission type includes a color filter provided on the inner face of the first substrate and coated with an overcoat layer made of an acrylic resin or an epoxy resin. The front panel is further configured such that the transparent first electrode is formed on the overcoat layer. It is to be noted that an orientation film is formed on the transparent first electrode. Meanwhile, the rear panel is configured more particularly from a second substrate formed, for example, from a glass substrate or a silicon substrate, a switching element formed on an inner face of the second substrate, a transparent second electrode also called pixel electrode made of, for example, ITO and controlled between conduction and non-conduction by the switching element, and a polarizing film provided on an outer face of the second substrate. An orientation film is formed over an overall area including the transparent second electrode. Such various members and liquid crystal material which configure liquid crystal display apparatus including a color liquid crystal display apparatus of the transmission type may be configured using known members and materials. As the switching element, for example, such three-terminal elements as a MOS type (metal oxide semiconductor) FET or a thin film transistor (TFT) and two-terminal elements such as a MIM (metal-insulator-metal) element, a varistor element and a diode formed on a single crystal silicon semiconductor substrate can be used.

The number of pixels arrayed in a two-dimensional matrix is $P_0$ along the first direction and Q along the second direction. In the case where this number of pixels is represented as ($P_0$, Q) for the convenience of description, as the value of ($P_0$, Q), several resolutions for image display can be used. Particularly, VGA (640, 480), S-VGA (800, 600), XGA (1,024, 768), APRC (1,152, 900), S-XGA (1,280, 1,024), U-XGA (1,600, 1,200), HD-TV (1,920, 1,080) and Q-XGA (2,048, 1,536) as well as (1,920, 1,035), (720, 480) and (1,280, 960) are available. However, the number of pixels is not limited to those numbers. Further, as the relationship between the value of ($P_0$, Q) and the value of (S, T), such relationships as listed in Table 1 below are available although the relationship is not limited to them. As the number of pixels for configuring one display region unit, 20×20 to 320×240, preferably 50×50 to 200×200, can be used. The numbers of pixels in different display region units may be equal to each other or may be different from each other.

TABLE 1

| | Value of S | Value of T |
|---|---|---|
| VGA (640, 480) | 2~32 | 2~24 |
| S-VGA (800, 600) | 3~40 | 2~30 |
| XGA (1024, 768) | 4~50 | 3~39 |
| APRC (1152, 900) | 4~58 | 3~45 |
| S-XGA (1280, 1024) | 4~64 | 4~51 |
| U-XGA (1600, 1200) | 6~80 | 4~60 |
| HD-TV (1920, 1080) | 6~86 | 4~54 |
| Q-XGA (2048, 1536) | 7~102 | 5~77 |
| (1920, 1035) | 7~64 | 4~52 |
| (720, 480) | 3~34 | 2~24 |
| (1280, 960) | 4~64 | 3~48 |

In the image display apparatus and driving method for the image display apparatus of the present invention, a color image display apparatus of the direct type or the projection type and a color image display apparatus of the field sequential type which may be the direct type or the projection type can be used as the image display apparatus. It is to be noted that the number of light emitting elements which configure the image display apparatus may be determined based on specifications required for the image display apparatus. Further, the image display apparatus may be configured including a light valve based on specifications required for the image display apparatus.

The image display apparatus is not limited to a color liquid crystal display apparatus but may be formed as an organic electroluminescence display apparatus, that is, an organic EL display apparatus, an inorganic electroluminescence display apparatus, that is, an inorganic EL display apparatus, a cold cathode field electron emission display apparatus (FED), a surface conduction type electron emission display apparatus (SED), a plasma display apparatus (PDP), a diffraction grating-light modulation apparatus including a diffraction grating-light modulation element (GLV), a digital micromirror device (DMD), a CRT or the like. Also the color liquid crystal display apparatus is not limited to a liquid crystal display apparatus of the transmission type but may be a liquid crystal display apparatus of the reflection type or a semi-transmission type liquid crystal display apparatus.

Working Example 1

The working example 1 relates to the driving method for an image display apparatus according to the first embodiment of the present invention and the driving method for an image display apparatus assembly according to the first embodiment of the present invention, and particularly relates to a 1Ath mode.

Figure 2:
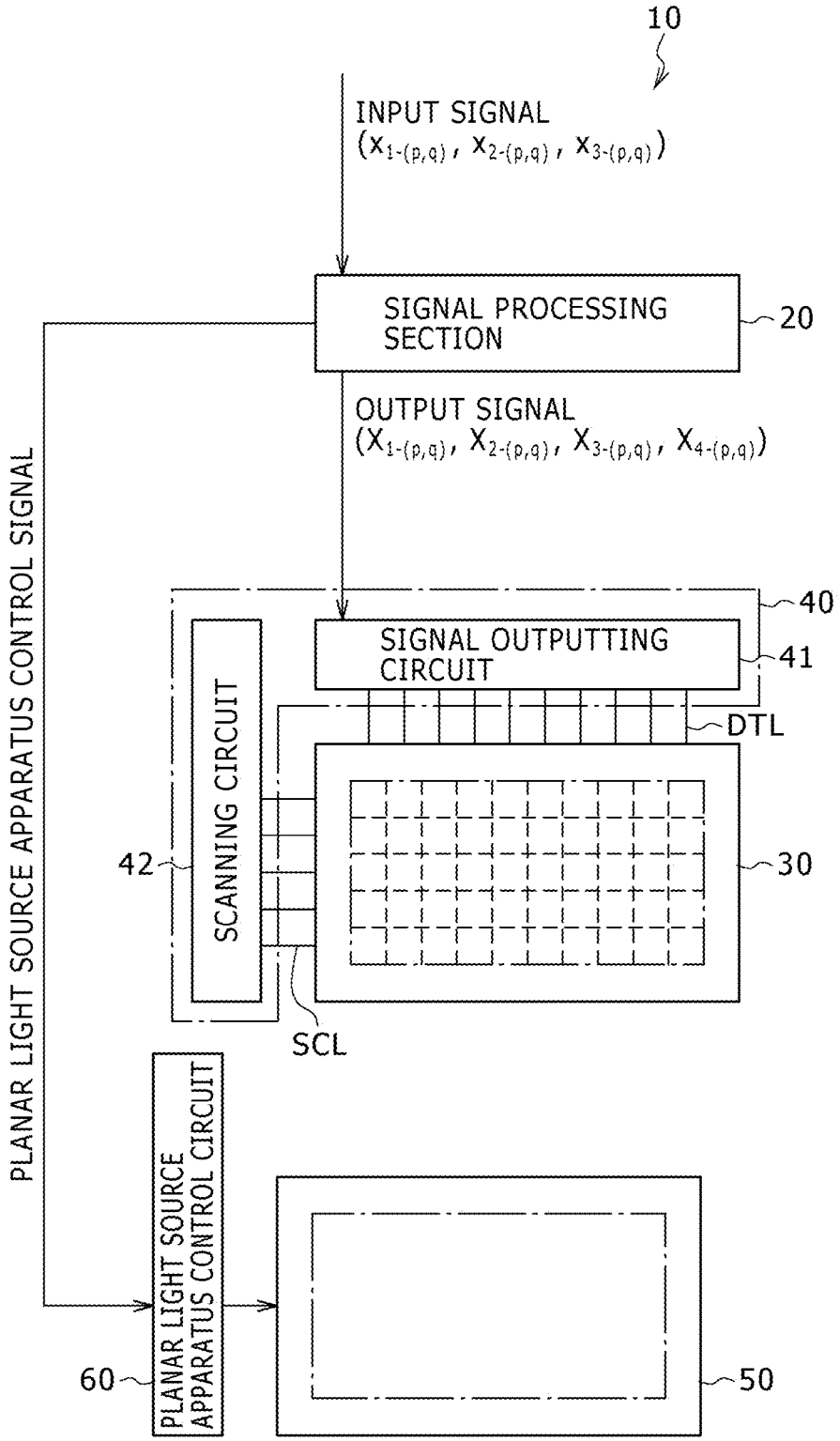
FIG. 2 is a block diagram of an image display apparatus of the working example 1.

Referring to FIG. 2, the image display apparatus 10 of the working example 1 includes an image display panel 30 and a signal processing section 20. Further, the image display apparatus assembly of the working example 1 includes the image display apparatus 10, and a planar light source apparatus 50 for illuminating the image display apparatus 10, particularly the image display panel 30, from the rear face side.

Figure 3:
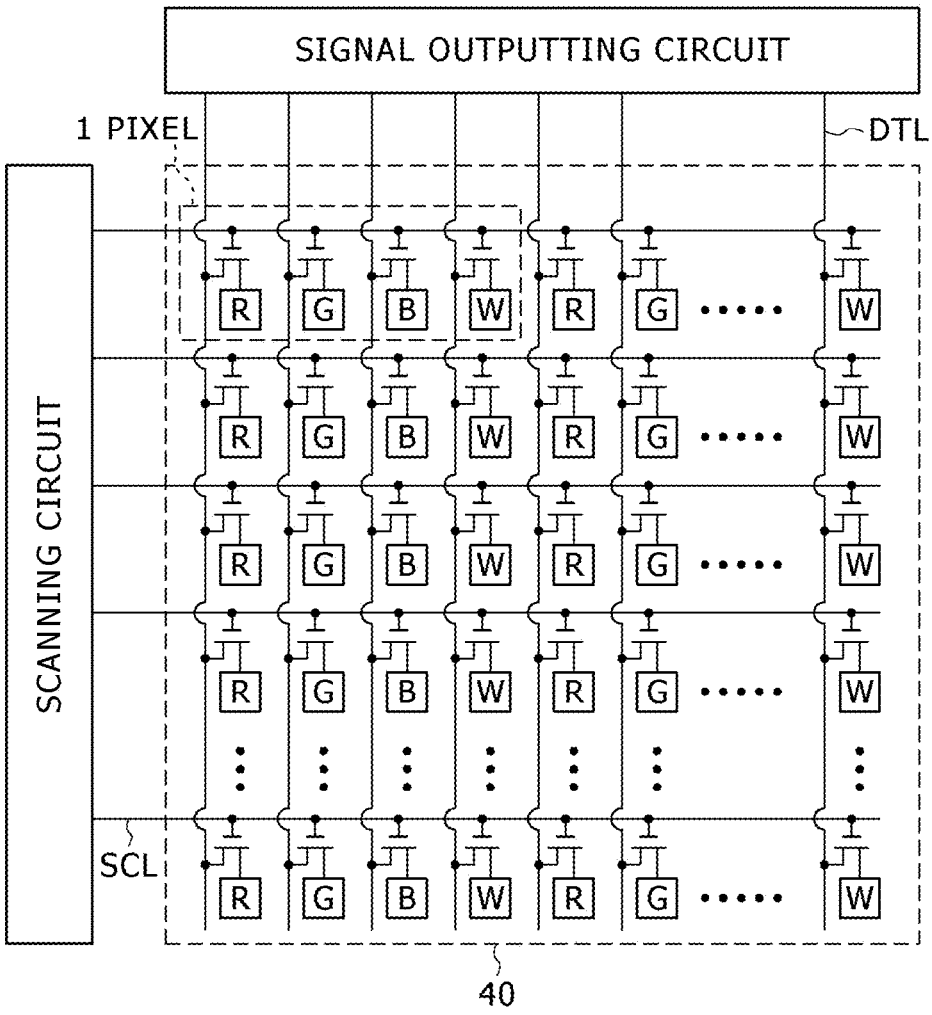
FIG. 3 is a circuit diagram of the image display panel and an image display panel driving circuit of the image display apparatus of FIG. 2.

Referring now to FIG. 1 which schematically illustrates arrangement of pixels, the image display panel 30 of the working example 1 includes totaling $P_0 \times Q_0$ pixels Px arrayed in a two-dimensional matrix including $P_0$ pixels Px arrayed in a first direction and $Q_0$ pixels Px arrayed in a second direction. Each of the pixels Px includes a first subpixel denoted by R for displaying a first primary color such as, for example, red, a second subpixel denoted by G for displaying a second primary color such as, for example, green, a third subpixel denoted by B for displaying a third primary color such as, for example, blue, and a fourth subpixel denoted by W for displaying a fourth color such as white. The subpixels mentioned of each pixel Px are arrayed in the first direction. The arrangement of the pixels is illustrated in FIG. 3. Each subpixel has a rectangular shape and is disposed such that the major side of the rectangle extends in parallel to the second direction and the minor side of the rectangle extends in parallel to the first direction.

The image display apparatus of the working example 1 is formed more particularly from a color liquid crystal display apparatus of the transmission type, and the image display panel 30 is formed from a color liquid crystal display panel. The image display panel 30 includes a first color filter disposed between the first subpixels and an image observer for transmitting the first primary color therethrough, a second color filter disposed between the second subpixels and the image observer for transmitting the second primary color therethrough, and a third color filter disposed between the third subpixels and the image observer for transmitting the third primary color therethrough. It is to be noted that no color filter is provided for the fourth subpixels which display white. A transparent resin layer may be provided in place of color filter. Consequently, it can be prevented that provision of no color filter gives rise to formation of a large offset on the fourth subpixels.

Referring back to FIG. 2, in the working example 1, the signal processing section 20 includes an image display panel driving circuit 40 for driving an image display panel, more particularly a color liquid crystal display panel, and a planar light source apparatus control circuit 60 for driving the planar light source apparatus 50. The image display panel driving circuit 40 includes a signal outputting circuit 41 and a scanning circuit 42. It is to be noted that a switching element such as, for example, a TFT (thin film transistor) for controlling operation, that is, the light transmission factor, of each subpixel of the image display panel 30 is controlled between on and off by the scanning circuit 42. Meanwhile, image signals are retained in the signal outputting circuit 41 and successively outputted to the image display panel 30. The signal outputting circuit 41 and the image display panel 30 are electrically connected to each other by wiring lines DTL, and the scanning circuit 42 and the image display panel 30 are electrically connected to each other by wiring lines SCL.

It is to be noted that, in the working examples of the present invention, in the case where the display gradation bit number is "n," n is set to n=8. In other words, the display control bit number is 8 bits, and the value of the display gradation particularly ranges from 0 to 255. It is to be noted that a maximum value of the display gradation is sometimes represented as $2^n-1$.

The signal processing section 20 calculates a first subpixel output signal, that is, a first subpixel output signal value $X_{1-(p,q)}$, to a pixel $Px_{(p,q)}$ based on a first subpixel input signal, that is, a first subpixel input signal value $x_{1-(p,q)}$, and outputs the determined first subpixel output signal to the first subpixel. Further, the signal processing section 20 calculates a second subpixel output signal, that is, a second subpixel output signal value $X_{2-(p,q)}$, to the pixel $Px_{(p,q)}$ based on a second subpixel input signal, that is, a second subpixel input signal value $x_{2-(p,q)}$, and outputs the calculated second subpixel output signal to the second subpixel. The signal processing section 20 calculates a third subpixel output signal, that is, a third subpixel output signal value $X_{3-(p,q)}$, to the pixel $Px_{(p,q)}$ based on a third subpixel input signal, that is, a third subpixel input signal value $x_{3-(p,q)}$, and outputs the calculated third subpixel output signal to the third subpixel.

Here, in the working example 1, to the signal processing section 20, regarding a (p,q)th pixel $Px_{(p,q)}$(where $1 \le p \le P_0$, $1 \le q \le Q_0$), a first subpixel input signal having a signal value of $x_{1-(p,q)}$, a second subpixel input signal having a signal value of $x_{2-(p,q)}$ and a third subpixel input signal having a signal value of $x_{3-(p,q)}$ are inputted. Further, the signal processing section 20 outputs, regarding the pixel $Px_{(p,q)}$, a first subpixel output signal having a signal value $X_{1-(p,q)}$ for determining a display gradation of a first subpixel R, a second subpixel output signal having a signal value $X_{2-(p,q)}$ for determining a display gradation of a second subpixel G, a third subpixel output signal having a signal value $X_{3-(p,q)}$ for determining a display gradation of a third subpixel B, and a fourth subpixel output signal having a signal value $X_{4-(p,q)}$ for determining a display gradation of a fourth subpixel W.

Further, regarding an adjacent pixel positioned adjacent the (p,q)th pixel, a first subpixel input signal having a signal value of $x_{1-(p,q')}$, a second subpixel input signal having a signal value of $x_{2-(p,q)}$ and a third subpixel input signal having a signal value of $x_{3-(p,q')}$ are inputted. Further, regarding the adjacent pixel, a first subpixel output signal having a signal value of $X_{1-(p,q)}$ for determining a display gradation of a first subpixel, a second subpixel output signal having a signal value of $X_{2-(p,q')}$ for determining a display gradation of a second subpixel, a third subpixel output signal having a signal value of $X_{3-(p,q')}$ for determining a display gradation of a third subpixel, and a fourth subpixel output signal having a signal value of $X_{4-(p,q')}$ for determining a display gradation of a fourth subpixel are outputted.

It is to be noted that, in the working example 1, the adjacent pixel positioned adjacent the (p,q)th pixel is the (p,q−1)th pixel. This similarly applies also to the other working examples. However, the adjacent pixel is not limited to this, but may be a (p,q+1)th pixel or both of the (p,q−1)th pixel and the (p,q+1)th pixel.

Further, the signal processing section 20 determines a fourth subpixel output signal based on a fourth subpixel control second signal determined from the first subpixel input signal, second subpixel input signal and third subpixel input signal to a (p,q)th pixel (where p=1, 2, . . . , $P_0$ and q=1, 2, . . . , $Q_0$) as counted along the second direction and a fourth subpixel control first signal determined from the first subpixel input signal, second subpixel input signal and third subpixel input signal to the adjacent pixel adjacent the (p,q)th pixel along the second direction. Then, the signal processing section 20 outputs the determined subpixel output signal to the fourth subpixel of the (p,q)th pixel.

More particularly, the fourth subpixel control second signal value $SG_{2-(p,q)}$ is calculated from the first subpixel input signal $x_{1-(p,q)}$, second subpixel input signal value $x_{2-(p,q)}$ and third subpixel input signal value $x_{3-(p,q)}$ to the (p,q)th pixel $Px_{(p,q)}$. Meanwhile, the fourth subpixel control first signal value $SG_{1-(p,q)}$ is calculated from the first subpixel input signal value $x_{1-(p,q')}$, second subpixel input signal value $x_{2-(p,q')}$ and third subpixel input signal value $x_{3-(p,q')}$ to the adjacent pixel adjacent the (p,q)th pixel along the second direction. Then, the fourth subpixel output signal is calculated based on the fourth subpixel control second signal value $SG_{2-(p,q)}$ and the fourth subpixel control first signal value $SG_{1-(p,q)}$, and the calculated fourth subpixel output signal value $X_{4-(p,q)}$ is outputted to the fourth subpixel of the (p,q)th pixel.

In the working example 1, the 1Ath mode is adopted. In particular, the fourth subpixel control second signal value $SG_{2-(p,q)}$ is calculated based on $Min_{(p,q)}$ of the (p,q)th pixel $Px_{(p,q)}$, and the fourth subpixel control first signal value $SG_{1-(p,q)}$ is calculated based on $Min_{(p,q')}$ of the adjacent pixel $Px_{(p,q')}$ adjacent the (p,q)th pixel $Px_{(p,q)}$.

More particularly, the fourth subpixel control second signal value $SG_{2-(p,q)}$ and the fourth subpixel control first signal value $SG_{1-(p,q)}$ are calculated from expressions (1-1-A) and (1-1-B) given below. However, in the working example 1, $c_{11}=1$. It is to be noted that what value or what expression should be applied for the value of each of the fourth subpixel control second signal value $SG_{2-(p,q)}$ and the fourth subpixel control first signal value $SG_{1-(p,q)}$ may be determined suitably by making a prototype of the image display apparatus 10 or the image display apparatus assembly and carrying out evaluation of images, for example, by an image observer.

$$SG_{2-(p,q)}=c_{11}(\mathrm{Min}_{(p,q)}) \tag{1-1-A}$$

$$SG_{1-(p,q)}=c_{11}(\mathrm{Min}_{(p,q')}) \tag{1-1-B}$$

Further, the fourth subpixel output signal value $X_{4-(p,q)}$ is calculated from an expression (3-A) given below. It is to be noted that, in the working example 1, $C_{11}=C_{12}=1$. In other words, the fourth subpixel output signal value $X_{4-(p,q)}$ is calculated from the following expression (3-A') of an arithmetic mean:

$$X_{4-(p,q)}=(C_{11}\cdot SG_{2-(p,q)}+C_{12}\cdot SG_{1-(p,q)})/(C_{11}+C_{12}) \tag{3-A}$$

$$=(SG_{2-(p,q)}+SG_{1-(p,q)})/2 \tag{3-A'}$$

Further, the first subpixel output signal value $X_{1-(p,q)}$ of the (p,q)th pixel $Px_{(p,q)}$ is calculated based at least on the first subpixel input signal value $x_{1-(p,q)}$, $Max_{(p,q)}$, $Min_{(p,q)}$ and fourth subpixel control second signal value $SG_{2-(p,q)}$. Further, the second subpixel output signal value $X_{2-(p,q)}$ of the (p,q)th pixel $Px_{(p,q)}$ is calculated based at least on the second subpixel input signal value $x_{2-(p,q)}$, $Max_{(p,q)}$, $Min_{(p,q)}$ and fourth subpixel control second signal value $SG_{2-(p,q)}$. Further, the third subpixel output signal value $X_{3-(p,q)}$ of the (p,q)th pixel $Px_{(p,q)}$ is calculated based at least on the third subpixel input signal value $x_{3-(p,q)}$, $Max_{(p,q)}$, $Min_{(p,q)}$ and fourth subpixel control second signal value $SG_{2-(p,q)}$. Here, in the working example 1, the first subpixel output signal value $X_{1-(p,q)}$ is calculated based on $$[x_{1-(p,q)}, \mathrm{Max}_{(p,q)}, \mathrm{Min}_{(p,q)}, SG_{2-(p,q)}, \chi]$$

the second subpixel output signal value $X_{2-(p,q)}$ is calculated based on $$[x_{2-(p,q)}, \mathrm{Max}_{(p,q)}, \mathrm{Min}_{(p,q)}, SG_{2-(p,q)}, \chi]$$

and the third subpixel output signal value $X_{3-(p,q)}$ is calculated based on $$[x_{3-(p,q)}, \mathrm{Max}_{(p,q)}, \mathrm{Min}_{(p,q)}, SG_{2-(p,q)}, \chi]$$

For example, it is assumed that, as regards the pixel $Px_{(p,q)}$, as an example, an input signal of an input signal value having a relationship represented by an expression (11-A) given below is inputted to the signal processing section 20, and as regards the adjacent pixel $Px_{(p,q')}$, as an example, an input signal of an input signal value having a relationship represented by an expression (11-B) given below is inputted to the signal processing section 20.

$$x_{3-(p,q)}<x_{1-(p,q)}<x_{2-(p,q)} \quad (11\text{-A})$$

$$x_{2-(p,q')}<x_{3-(p,q')}<x_{1-(p,q')} \quad (11\text{-B})$$

In this instance, $$\mathrm{Min}_{(p,q)}=x_{3-(p,q)} \quad (12\text{-A})$$

$$\mathrm{Min}_{(p,q')}=x_{2-(p,q')} \quad (12\text{-B})$$

Then, the fourth subpixel control second signal value $SG_{2-(p,q)}$ is determined based on $\mathrm{Min}_{(p,q)}$, and the fourth subpixel control first signal value $SG_{1-(p,q)}$ is determined based on $\mathrm{Min}_{(p,q')}$. In particular $$\begin{aligned} SG_{2-(p,q)} &= \mathrm{Min}_{(p,q)} \\ &= x_{3-(p,q)2} \end{aligned} \quad (13\text{-A})$$

$$\begin{aligned} SG_{1-(p,q)} &= \mathrm{Min}_{(p,q')} \\ &= x_{2-(p,q')} \end{aligned} \quad (13\text{-B})$$

Further, $$\begin{aligned} X_{4-(p,q)} &= (SG_{2-(p,q)} + SG_{1-(p,q)})/2 \\ &= (x_{3-(p,q)} + x_{2-(p,q')})/2 \end{aligned} \quad (14)$$

Incidentally, it is necessary for the luminance based on the input signal value of an input signal and the output signal value of an output signal to satisfy relationships given below in order to satisfy such a demand as to keep the chromaticity against variation. It is to be noted that, although the fourth subpixel output signal value $X_{4-(p,q)}$ is multiplied by $\chi$, this is because the fourth subpixel is brighter by $\chi$ times than the other subpixels as hereinafter described.

$$x_{1-(p,q)}/\mathrm{Max}_{(p,q)}=(X_{1-(p,q)}+\chi\cdot SG_{2-(p,q)})/(\mathrm{Max}_{(p,q)}+\chi\cdot SG_{2-(p,q)}) \quad (15\text{-A})$$

$$x_{2-(p,q)}/\mathrm{Max}_{(p,q)}=(X_{2-(p,q)}+\chi\cdot SG_{2-(p,q)})/(\mathrm{Max}_{(p,q)}+\chi\cdot SG_{2-(p,q)}) \quad (15\text{-B})$$

$$x_{3-(p,q)}/\mathrm{Max}_{(p,q)}=(X_{3-(p,q)}+\chi\cdot SG_{2-(p,q)})/(\mathrm{Max}_{(p,q)}+\chi\cdot SG_{2-(p,q)}) \quad (15\text{-C})$$

It is to be noted that, where the luminance of a set of first, second and third subpixels which configures a pixel (in the working examples 5 and 6 hereinafter described, a pixel group) when a signal having a value corresponding to a maximum signal value of the first subpixel output signal is inputted to the first subpixel and a signal having a value corresponding to a maximum signal value of the second subpixel output signal is inputted to the second subpixel and besides a signal having a value corresponding to a maximum signal value of the third subpixel output signal is inputted to the third subpixel is represented by $BN_{1-3}$ and the luminance of the fourth subpixel when a signal having a value corresponding to a maximum signal value of the fourth subpixel output signal is inputted to the fourth subpixel which configures the pixel (in the working examples 5 and 6 hereinafter described, the pixel group) is represented by $BN_4$, the constant $\chi$ can be represented as $$\chi=BN_4/BN_{1-3}$$

Here, the constant $\chi$ is a value unique to the image display panel 30, the image display apparatus or the image display apparatus assembly and is determined uniquely by the image display panel 30, image display apparatus or image display apparatus assembly. In particular, the luminance $BN_4$ when it is assumed that an input signal having the value 255 of the display gradation is inputted to the fourth subpixel is, for example, as high as 1.5 times the luminance $BN_{1-3}$ of white when input signals having values of the display gradation given as $$x_{1-(p,q)}=255$$

$$x_{2-(p,q)}=255$$

$$x_{3-(p,q)}=255$$

are inputted to the set of the first, second and third subpixels. In particular, in the working example 1, or in the working examples hereinafter described, $$=1.5$$

Accordingly, from the expressions (15-A), (15-B) and (15-C), output signal values are calculated as given below:

$$X_{1-(p,q)}=\{x_{1-(p,q)}\cdot(\mathrm{Max}_{(p,q)}+\chi\cdot SG_{2-(p,q)})\}/\mathrm{Max}_{(p,q)}-\chi\cdot SG_{2-(p,q)} \quad (16\text{-A})$$

$$X_{2-(p,q)}=\{x_{2-(p,q)}\cdot(\mathrm{Max}_{(p,q)}+\chi\cdot SG_{2-(p,q)})\}/\mathrm{Max}_{(p,q)}-\chi\cdot SG_{2-(p,q)} \quad (16\text{-B})$$

$$X_{3-(p,q)}=\{x_{3-(p,q)}\cdot(\mathrm{Max}_{(p,q)}+\chi\cdot SG_{2-(p,q)})\}/\mathrm{Max}_{(p,q)}-\chi\cdot SG_{2-(p,q)} \quad (16\text{-C})$$

Figure 4:
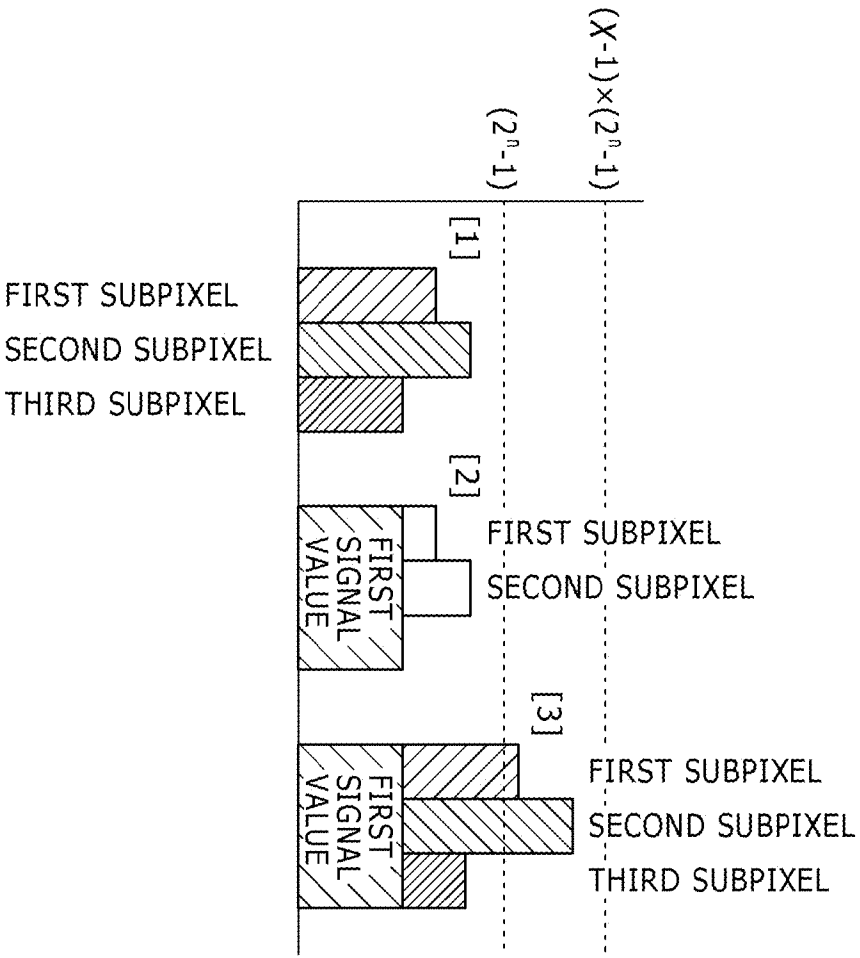
FIG. 4 is a diagrammatic view illustrating input signal values and output signal values in a driving method for the image display apparatus of FIG. 2.

Referring to FIG. 4, the input values to the first, second and third subpixels are illustrated in [1]. It is to be noted that $SG_{2-(p,q)}=SG_{1-(p,q)}$. Further, values obtained by subtracting the fourth subpixel output signal value from the input signal values to the first, second and third subpixels are illustrated in [2]. Furthermore, the output signal values of the first, second and third subpixels obtained based on the expressions (16-A), (16-B) and (16-C) given above are illustrated in [3]. It is to be noted that the axis of abscissa in FIG. 4 indicates the luminance, and the luminance $BN_{1-3}$ of the first, second and third subpixels is represented by $2^n-1$ and besides the luminance $BN_{1-3}+BN_4$ when the fourth subpixel is added is represented by $(\chi+1)\times(2^n-1)$.

In the following, a method of calculating the output signal values $X_{1-(p,q)}$, $X_{2-(p,q)}$, $X_{3-(p,q)}$ and $X_{4-(p,q)}$ of the (p,q)th pixel $Px_{(p,q)}$. It is to be noted that the following process is carried out so as to keep, in each pixel, the ratio among the luminance of the first primary color displayed by the (first subpixel+fourth subpixel), the luminance of the second primary color displayed by the (second subpixel+fourth subpixel) and the luminance of the third primary color displayed by the (third subpixel+fourth subpixel). Besides, the process is carried out so as to keep or maintain the color tone as far as possible. Furthermore, the process is carried out so as to keep or maintain the gradation-luminance characteristic, that is, the gamma characteristic or $\gamma$ characteristic).

Step 100

First, the signal processing section 20 calculates the fourth subpixel control second signal value $SG_{2-(p,q)}$ and the fourth subpixel control first signal value $SG_{1-(p,q)}$ for each of a plurality of pixels in accordance with expressions (1-1-A') and (1-1-B') given below based on the subpixel input signal values to the pixels. This process is carried out for all pixels. Further, the signal value $X_{4-(p,q)}$ is calculated in accordance with an expression (3-A') given below.

$$SG_{2-(p,q)}=\mathrm{Min}_{(p,q)} \quad (1\text{-}1\text{-A}').$$

$$SG_{1-(p,q)}=\mathrm{Min}_{(p,q')} \quad (1\text{-}1\text{-B}')$$

$$X_{4-(p,q)}=(SG_{2-(p,q)}+SG_{1-(p,q)})/2 \quad (3\text{-A}')$$

Step 110

Then, the signal processing section 20 calculates output signal values $X_{1-(p,q)}$, $X_{2-(p,q)}$ and $X_{3-(p,q)}$ from the fourth subpixel output signal value $X_{4-(p,q)}$ calculated for each pixel in accordance with the expressions (16-A), (16-B) and (16-C) given hereinabove.

It is to be noted that, since, with each pixel, the ratio $X_{1-(p,q)}:X_{2-(p,q)}:X_{3-(p,q)}$ of the output signal values is a little different from the ratio $x_{1-(p,q)}:x_{2-(p,q)}:x_{3-(p,q)}$ of the input signal values, if each pixel is observed solely, then some difference occurs with the color tone of the pixel with respect to the input signal. However, when each pixel is observed as a pixel, no problem occurs with the color tone of the pixel. This similarly applies also to the following description.

In the driving method for an image display apparatus or the driving method for an image display apparatus assembly of the working example 1, the signal processing section 20 calculates the fourth subpixel output signal based on the fourth subpixel control second signal value $SG_{2-(p,q)}$ calculated from the first, second and third subpixel input signals and the fourth subpixel control first signal value $SG_{1-(p,q)}$ calculated from the first, second and third subpixel input signals to the adjacent pixel. Here, since the fourth subpixel output signal is calculated taking input signals to the adjacent pixel into consideration, optimization of the output signal to the fourth subpixel is achieved and increase of the luminance can be achieved with certainty and besides improvement of the display quality can be anticipated.

For example, it is assumed that first, second and third subpixel input signal values indicated in Table 2 below are inputted to the (p,q)th pixel and the (p,q−1)th pixel, which is adjacent the (p,q)th pixel, as well as the (p,q−2)th, (p,q−3)th and (p,q+1)th pixels. A result when the value of the fourth subpixel output signal value outputted to the fourth subpixel which configures each of the (p,q−2)th pixel, (p,q−1)th pixel, (p,q)th pixel and (p,q+1)th is calculated based on the expression (3-A) at this time is indicated in Table 2. It is to be noted that increase of the luminance of the second pixel arising from the constant $\chi$ is ignored in the calculation.

Meanwhile, an example wherein the fourth subpixel output signal value $X_{4-(p,q)}$ is calculated using the following expression (17) in place of the expression (3-A) is indicated similarly as a comparative example 1 in Table 2.

$$X_{4-(p,q)}=\mathrm{Min}_{(p,q)} \tag{17}$$

TABLE 2

| input signal | pixel | | | | |
|---|---|---|---|---|---|
| value | (p, q − 3) | (p, q − 2) | (p, q − 1) | (p, q) | (p, q + 1) |
| $x_1$ | 0 | 0 | 255 | 255 | 255 |
| $x_2$ | 0 | 0 | 255 | 255 | 255 |
| $x_3$ | 0 | 0 | 255 | 255 | 255 |
| | | Output signal value Working example 1 | | | |
| $X_4$ | | 0 | 127 | 255 | 255 |
| | | Comparative example | | | |
| $X_4$ | | 0 | 255 | 255 | 255 |

From Table 2, the difference of the fourth subpixel output signal value of the (p,q)th pixel from that of the (p,q−1)th pixel is smaller in the working example 1 than in the comparative example 1.

Figures 20A, 20B:
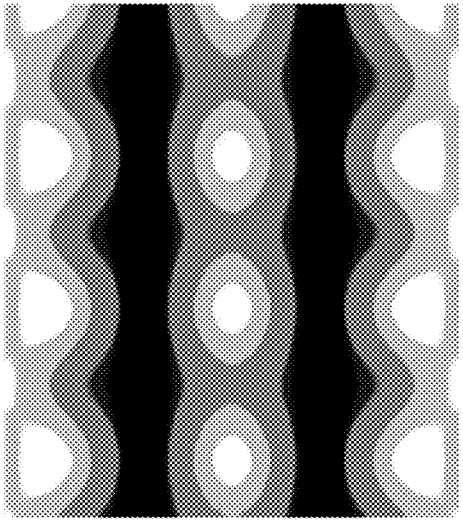
FIGS. 20A and 20B are views illustrating a problem of a related-art driving method for an image display apparatus.

If the difference of the fourth subpixel output signal value of the (p,q)th pixel from that of the (p,q−1)th pixel is great, then since the luminance of the fourth subpixel is high, the visibility is deteriorated. For example, if it is assumed that input signal values illustrated in FIG. 20A are inputted, then the displayed image should originally be visually observed such that one dark line, which is displayed by a line of pixels in the (b) th row, is sandwiched between two white lines extending in the horizontal direction and displayed by lines of pixels in the (a) th row and the (c) th row. It is to be noted that "R," "G," "B" and "W" in FIG. 20A represent the first, second, third and fourth subpixels, respectively, and the numerical value in each ( ) represents an output signal value. However, since actually the luminance of the fourth subpixel is high, the dark line is visually observed such that it has a varying width (refer to FIG. 20B. Since, in the working example 1, the difference of the fourth subpixel output signal value of the (p,q)th pixel from that of the (p,q−1)th pixel is reduced, such a phenomenon as just described is less likely to be observed.

Working Example 2

The working example 2 is a modification to the working example 1 but relates to a 1Bth mode.

In the working example 2, where $\chi$ is a constant which depends upon the image display apparatus 10, a maximum value $V_{max}(S)$ of the brightness where the saturation S in an HSV color space expanded by addition of a fourth color is a variable is calculated by the signal processing section 20, and the signal processing section 20

(a) calculates the saturation S and the brightness V(S) of a plurality of pixels based on subpixel input signal values to the pixels, (b) calculates an expansion coefficient $\alpha_0$ based at least on one of the values of $V_{max}(S)/V(S)$ calculated with regard to the pixels, and (c) calculates the first subpixel output signal, that is, the first subpixel output signal value $X_{1-(p,q)}$, of the (p,q)th pixel based at least on the first subpixel input signal, that is, the first subpixel input signal value $x_{1-(p,q)}$, and the fourth subpixel control second signal, that is, the signal value $SG_{2-(p,q)}$, as well as the expansion coefficient $\alpha_0$ and the constant $\chi$;

calculates the second subpixel output signal, that is, the second subpixel output signal value $X_{2-(p,q)}$, based at least on the second subpixel input signal, that is, the second subpixel input signal value $x_{2-(p,q)}$, and the fourth subpixel control second signal, that is, the signal value $SG_{2-(p,q)}$, as well as the expansion coefficient $\alpha_0$ and the constant $\chi$; and calculates the third subpixel output signal, that is, the third subpixel output signal value $X_{3-(p,q)}$, based at least on the third subpixel input signal, that is, the third subpixel input signal value $x_{3-(p,q)}$, and the fourth subpixel control second signal, that is, the signal value $SG_{2-(p,q)}$, as well as the expansion coefficient $\alpha_0$ and the constant $\chi$. It is to be noted that, next to the step (c) described above, the luminance of the planar light source apparatus is decreased based on the expansion coefficient $\alpha_0$. The expansion coefficient $\alpha_0$ is determined for each one image display frame.

Where the saturation of the (p,q)th pixel is represented by $S_{(p,q)}$, the brightness $V_{(p,q)}$, the saturation of the adjacent pixel by $S_{(p,q')}$ and the brightness by $V_{(p,q')}$, they are represented by the following expressions (21-A), (21-B), (21-C) and (21-D), respectively.

$$S_{(p,q)}=(\mathrm{Max}_{(p,q)}-\mathrm{Min}_{(p,q)})/\mathrm{Max}_{(p,q)} \tag{21-A}$$

$$V_{(p,q)}=\mathrm{Max}_{(p,q)} \tag{21-B}$$

$$S_{(p,q')}=(\mathrm{Max}_{(p,q')}-\mathrm{Min}_{(p,q')})/\mathrm{Max}_{(p,q')} \quad (21\text{-C}).$$

$$V_{(p,q')}=\mathrm{Max}_{(p,q')} \quad (21\text{-D})$$

Also in the working example 2, the fourth subpixel output signal value $X_{4-(p,q)}$ is calculated from an expression (3-A") given below. In particular, the fourth subpixel output signal value $X_{4-(p,q)}$ is calculated by arithmetic mean. It is to be noted that, while, in the expression (3-A"), the right side includes division by $\chi$, the expression is not limited to this.

$$X_{4-(p,q)}=(SG_{2-(p,q)}+SG_{1-(p,q)})/(2\chi) \quad (3\text{-A}")$$

It is to be noted that the fourth subpixel control second signal value $SG_{2-(p,q)}$ is calculated based on $\mathrm{Min}_{(p,q)}$ and the expansion coefficient $\alpha_0$, and the fourth subpixel control first signal value $SG_{1-(p,q)}$ is calculated based on $\mathrm{Min}_{(p,q')}$ and the expansion coefficient $\alpha_0$. In particular, the fourth subpixel control second signal value $SG_{2-(p,q)}$ and the fourth subpixel control first signal value $SG_{1-(p,q)}$ are calculated from expressions (2-1-A) and (2-1-B) given below, respectively. It is to be noted, however, that, in the working example 2, $c_{21}=1$.

$$SG_{2-(p,q)}=c_{21}(\mathrm{Min}_{(p,q)})\cdot\alpha_0 \quad (2\text{-1-A})$$

$$SG_{1-(p,q)}=c_{21}(\mathrm{Min}_{(p,q')})\cdot\alpha_0 \quad (2\text{-1-B})$$

Meanwhile, the output signal values $X_{1-(p,q)}$, $X_{2-(p,q)}$ and $X_{3-(p,q)}$ of the first subpixel R, second subpixel G and third subpixel B are given by the expressions (5-A), (5-B) and (5-C) given hereinabove and also given below, respectively.

$$X_{1-(p,q)}=\alpha_0\cdot x_{1-(p,q)}-\chi\cdot SG_{2-(p,q)} \quad (5\text{-A})$$

$$X_{2-(p,q)}=\alpha_0\cdot x_{2-(p,q)}-\chi\cdot SG_{2-(p,q)} \quad (5\text{-B})$$

$$X_{3-(p,q)}=\alpha_0\cdot x_{3-(p,q)}-\chi\cdot SG_{2-(p,q)} \quad (5\text{-C})$$

In the working example 2, the maximum value $V_{max}(S)$ of the brightness which includes, as a variable, the saturation S in the HSV color space expanded by addition of a fourth color such as white is stored into the signal processing section 20 or else is calculated every time by the signal processing section 20. In other words, as a result of the addition of the fourth color such as white, the dynamic range of the brightness in the HSV color space is expanded.

The following description is given in this regard.

Figure 5A:
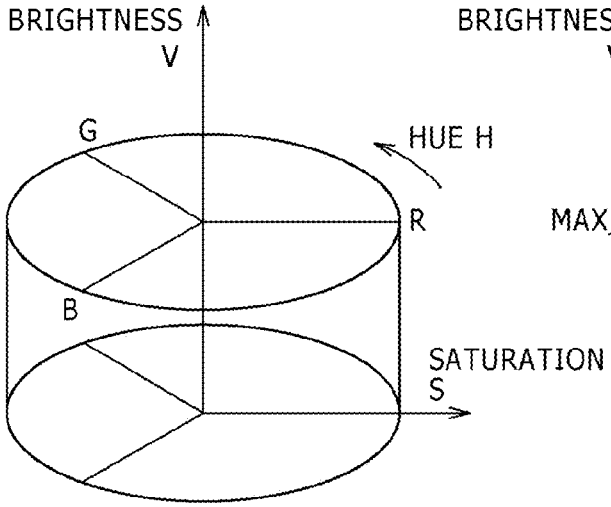
FIGS. 5A and 5B are diagrammatic views of a popular HSV (Hue, Saturation and Value) color space of a circular cylinder schematically illustrating a relationship between the saturation (S) and the brightness (V)
Figure 5B:
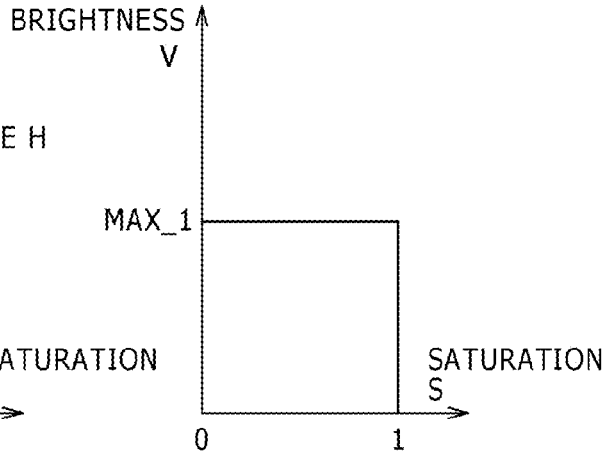

In the (p,q)th pixel $Px_{(p,q)}$, the saturation $S_{(p,q)}$ and the brightness $V_{(p,q)}$ in the HSV color space of a circular cylinder can be calculated from the expressions (21-A), (21-B), (21-C) and (21-D) based on the first subpixel input signal, that is, input signal value $x_{1-(p,q)}$, second subpixel input signal, that is, input signal value $x_{2-(p,q)}$ and third subpixel input signal, that is, input signal value $x_{3-(p,q)}$. Here, the HSV color space of a circular cylinder is schematically illustrated in FIG. 5A, and a relationship between the saturation S and the brightness V is schematically illustrated in FIG. 5B. It is to be noted that, in FIGS. 5B and 5D, the value of the brightness $2^n-1$ is represented by "MAX_1," and in FIG. 5D, the value of the brightness $(2^n-1)\times(\chi+1)$ is represented by "MAX_2." The saturation S can assume a value from 0 to 1, and the brightness V can assume a value from 0 to $2^n=1$.

Figure 5C:
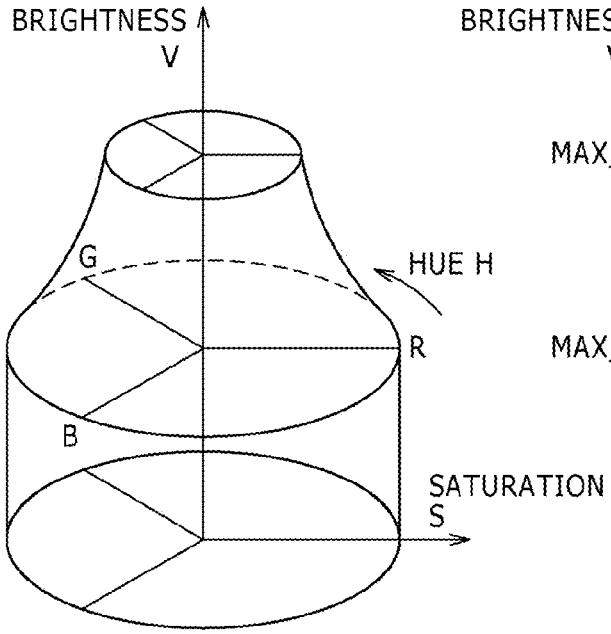
FIGS. 5C and 5D are diagrammatic views of an expanded HSV color space of a circular cylinder in a working example 2 of the present invention schematically illustrating a relationship between the saturation (S) and the brightness (V)
Figure 5D:
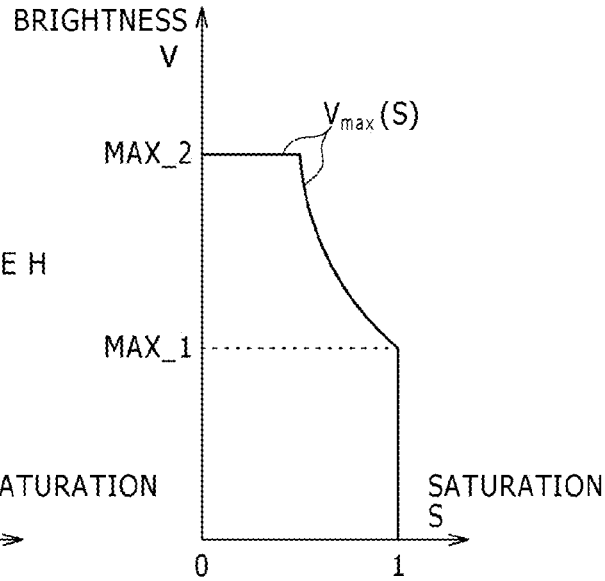

FIG. 5C illustrates the HSV color space of a circular cylinder expanded by addition of the fourth color or white in the working example 2, and FIG. 5D schematically illustrates a relationship between the saturation S and the brightness V. For the fourth subpixel which displays white, no color filter is disposed.

Incidentally, $V_{max}(S)$ can be represented by the following expression.

In the case where $S\leq S_0$, $$V_{max}(S)=(\chi+1)\cdot(2^n=1)$$

while, in the case where $S_0<S\leq 1$, $$V_{max}(S)=(2^n-1)\cdot(1/S)$$

where $$S_0=1/(\chi+1)$$

The maximum value $V_{max}(S)$ of the brightness obtained in this manner and using the saturation S in the expanded HSV color space as a variable is stored as a kind of lookup table into the signal processing section 20 or is calculated every time by the signal processing section 20.

It is to be noted that the image display apparatus and the image display apparatus assembly in the working example 2 or in any of the working examples 3 to 6 hereinafter described may be similar to those described hereinabove in connection with the working example 1 except a difference in a driving circuit, a difference in configuration of a pixel and some other difference. In particular, also the image display apparatus 10 of the working example 2 includes an image display panel and a signal processing section 20. Meanwhile, the image display apparatus assembly of the working example 2 includes the image display apparatus 10, and a planar light source apparatus 50 for illuminating the image display apparatus 10, particularly an image display panel, from the rear side. Further, the signal processing section 20 and the planar light source apparatus 50 in the working example 2 may be similar to the signal processing section 20 and the planar light source apparatus 50 described in the foregoing description of the working example 1, respectively. This similarly applies also to the working examples hereinafter described.

Step 200

First, the signal processing section 20 calculates the saturation S and the brightness V(S) of a plurality of pixels based on subpixel input signal values to the pixels. In particular, the signal processing section 20 calculates the saturations $S_{(p,q)}$ and $S_{(p,q')}$ and the brightness values $V_{(p,q)}$ and $V_{(p,q')}$ from the expressions (21-A), (21-B), (21-C) and (21-D) based on the input signal value $x_{1-(p,q)}$ of the first subpixel input signal, input signal value $x_{2-(p,q')}$ of the second subpixel input signal and input signal value $x_{3-(p,q)}$ of the third subpixel input signal to the (p,q)th pixel $Px_{(p,q)}$ and the input signal value $x_{1-(p,q')}$ of the first subpixel input signal, second signal value $x_{2-(p,q')}$ of the second subpixel input signal and input signal value $x_{3-(p,q')}$ of the third subpixel input signal to the (p,q−1)th pixel, that is, to the adjacent pixel, respectively. This process is carried out for all pixels. Accordingly, $P\times(Q-1)$ sets of $S_{(p,q)}$, $S_{(p,q)}$, $V_{(p,q)}$ and $V_{(p,q')}$ are obtained.

Step 210

Then, the signal processing section 20 calculates the expansion coefficient $\alpha_0$ based at least on one of the values of $V_{max}(S)/V(S)$ calculated with regard to the pixels.

Figure 6A:
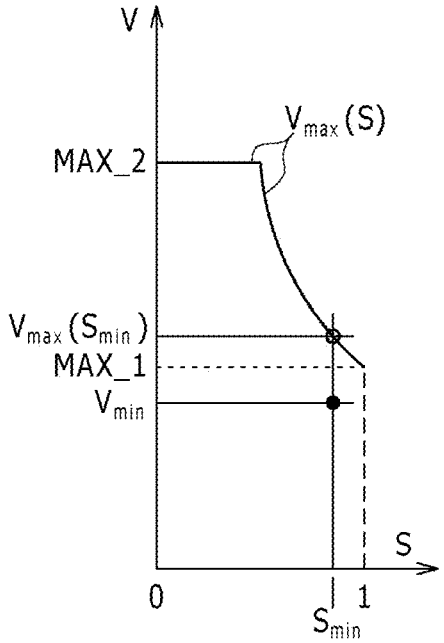
FIGS. 6A and 6B are diagrammatic views schematically illustrating a relationship of the saturation (S) and the brightness (V) in an HSV color space of a circular cylinder expanded by adding a fourth color, which is white, in the working example 2.
Figure 6B:
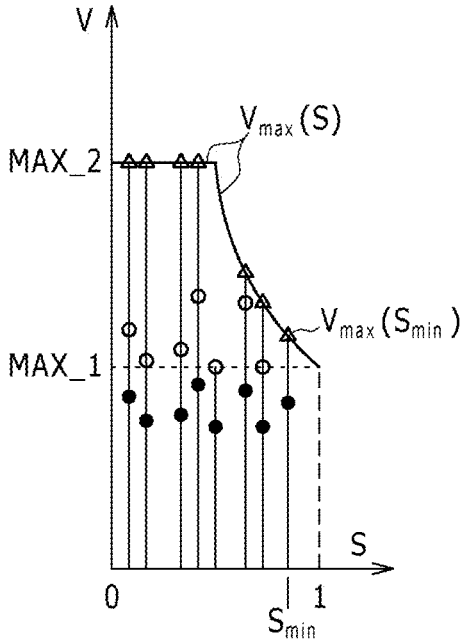

In particular, in the working example 2, the signal processing section 20 determines a minimum value $\alpha_{min}$ among the values of $V_{max}(S)/V(S)$ calculated with regard to all pixels, that is, $P_0\times Q$ pixels, as the expansion coefficient $\alpha_0$. In particular, the signal processing section 20 calculates the value of $\alpha_{(p,q)}=V_{max}(S)/V_{(p,q)}(S)$ with regard to all $P_0\times Q$ pixels and determines a minimum value of $\alpha_{(p,q)}$ among the values as the minimum value $\alpha_{min}$=expansion coefficient $\alpha_0$. It is to be noted that, in FIGS. 6A and 6B which schematically illustrate a relationship between the saturation S and the brightness V in the HSV color space of a circular cylinder expanded by the addition of the fourth color or white in the working example 2, the value of the saturation S at which the minimum value $\alpha_{min}$ is provided is indicated by "$S_{min}$," and the brightness at the time is indicated by "$V_{min}$" while $V_{max}(S)$ at the saturation $S_{min}$ is indicated by "$V_{max}(S_{min})$." Further, in FIG. 6B, V(S) is indicated by a solid round mark and $V(S)\times\alpha_0$ is indicated by a blank round mark, and $V_{max}(S)$ of the saturation S is indicated by a blank triangular mark.

Step 220

Then, the signal processing section 20 calculates the fourth subpixel output signal value $X_{4-(p,q)}$ of the (p,q)th pixel $Px_{(p,q)}$ based on the expressions (2-1-A), (2-1-B) and (3-A") given hereinabove. It is to be noted that the fourth subpixel output signal value $X_{4-(p,q)}$ is calculated with regard to $P\times(Q-1)$ pixels $Px_{(p,q)}$. The step 210 and the step 220 may be executed at the same time.

Step 230

Then, the signal processing section 20 calculates the first subpixel output signal value $X_{1-(p,q)}$ of the (p,q)th pixel $Px_{(p,q)}$ based on the input signal value $x_{1-(p,q)}$, expansion coefficient $\alpha_0$ and constant $\chi$. Further, the signal processing section 20 calculates the second subpixel output signal value $X_{2-(p,q)}$ based on the input signal value $x_{2-(p,q)}$, expansion coefficient $\alpha_0$ and constant $\chi$, and calculates the third subpixel output signal value $X_{3-(p,q)}$ based on the input signal value $x_{3-(p,q)}$, expansion coefficient $\alpha_0$ and constant $\chi$. It is to be noted that the step 220 and the step 230 may be executed at the same time, or the step 220 may be executed after the step 230 is executed.

In particular, the signal processing section 20 calculates the output signal values $X_{1-(p,q)}$, $X_{2-(p,q)}$ and $X_{3-(p,q)}$ of the (p,q)th pixel $Px_{(p,q)}$ based on the expressions (5-A), (5-B) and (5-C) given hereinabove, respectively.

Figure 7:
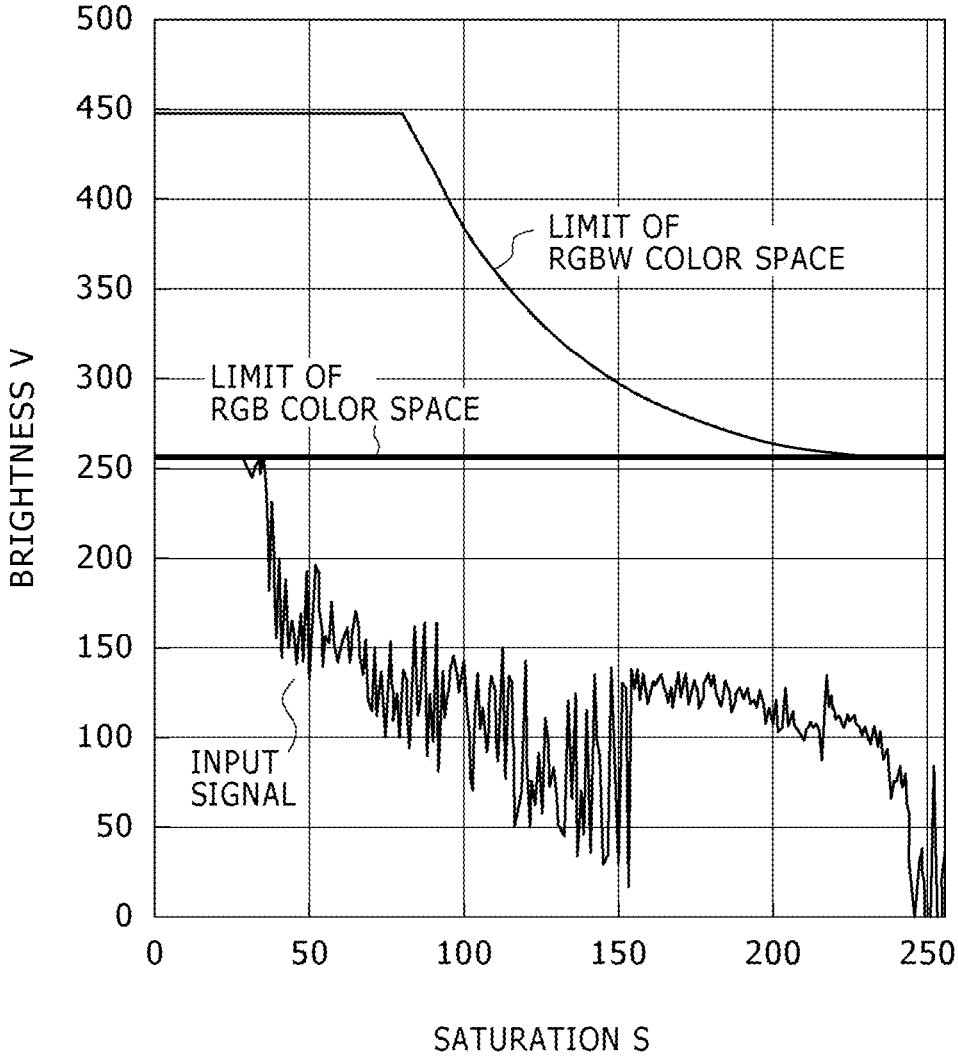
FIG. 7 is a view illustrating a HSV color space before the fourth color of white is added in the working example 2 in the past, an HSV color space expanded by addition of the fourth color of white and a relationship between the saturation (S) and the brightness (V) of an input signal.
Figure 8:
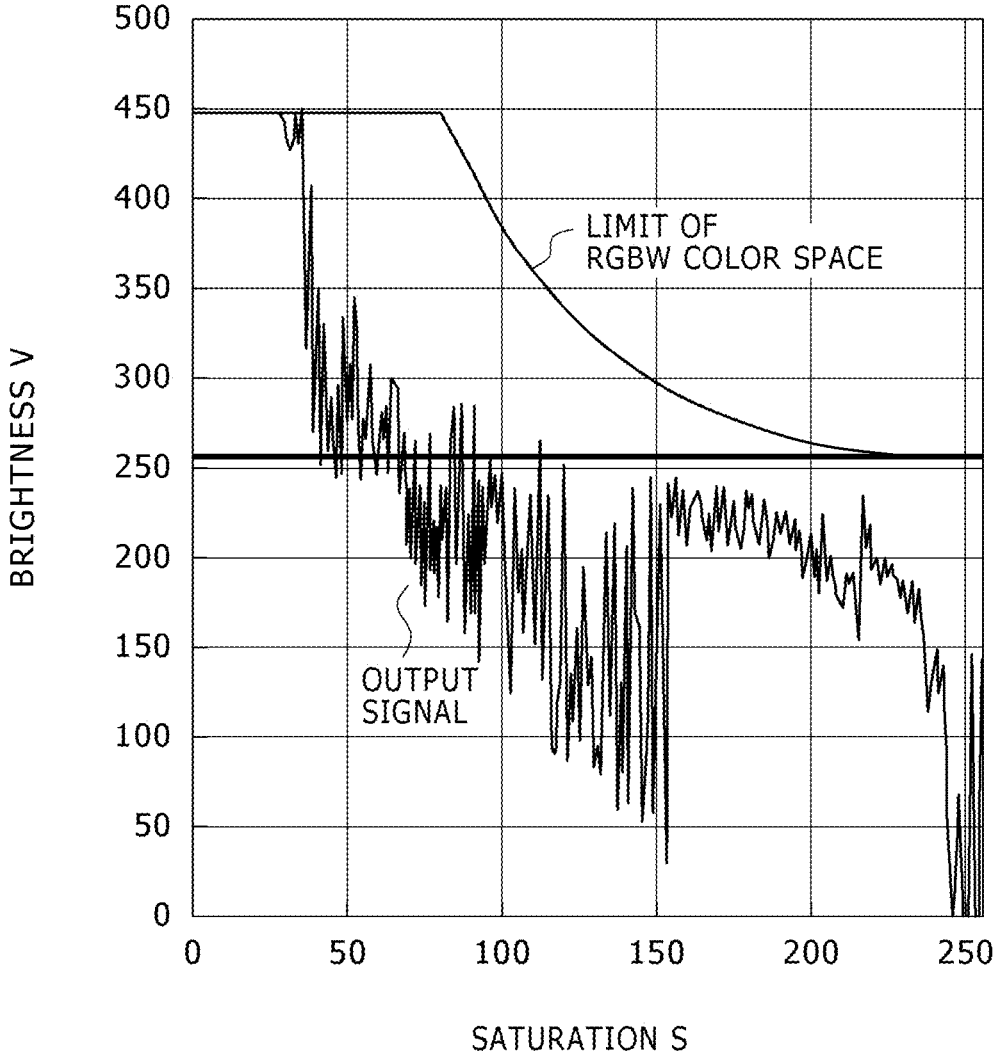
FIG. 8 is a view illustrating a HSV color space before the fourth color of white is added in the working example 2 in the past, an HSV color space expanded by addition of the fourth color of white and a relationship between the saturation (S) and the brightness (V) of an output signal which is in an expansion process.

FIG. 7 illustrates an example of a HSV color space of related arts before the fourth color or white is added in the working example 2, an HSV color space expanded by addition of the fourth color or white and a relationship of the saturation S and the brightness V of an input signal. Further, FIG. 7 illustrates an example of the HSV color space of related arts before the fourth color or white is added in the working example 2, the HSV color space expanded by addition of the fourth color or white and a relationship of the saturation S and the brightness V of an output signal in a state in which an expansion process is applied. It is to be noted that, although the value of the saturation S on the axis of abscissa in FIGS. 7 and 8 originally remains within the range from 0 to 1, in FIGS. 7 and 8, they are indicated in a form multiplied by 255.

What is significant here resides in that the luminance of the first subpixel R, second subpixel G and third subpixel B is expanded by the expansion coefficient $\alpha_0$ as indicated by the expressions (5-A), (5-B) and (5-C). Since the luminance of the first subpixel R, second subpixel G and third subpixel B is expanded by the expansion coefficient $\alpha_0$ in this manner, not only the luminance of the white display subpixel, that is, the fourth subpixel, increases, but also the luminance of the red display subpixel, green display subpixel and blue display subpixel, that is, of the first, second and third subpixels, increases. Therefore, occurrence of such a problem that darkening in color occurs can be prevented with certainty. In particular, the luminance of an entire image increases to $\alpha_0$ times in comparison with the alternative case in which the luminance of the first subpixel R, second subpixel G and third subpixel B is not expanded. Accordingly, for example, image display of a still picture or the like can be carried out with a high luminance favorably.

It is assumed that, in the case where $\chi=1.5$ and $2^n=1=255$, values indicated in Table 3 given below are inputted as input signal values for $x_{1-(p,q)}$, $x_{2-(p,q)}$ and $x_{3-(p,q)}$. It is to be noted that $SG_{2-(p,q)}=SG_{1-(p,q)}$. Further, the expansion coefficient $\alpha_0$ is set to a value given in Table 3.

TABLE 3

| | |
|---|---|
| $X_{1-(p,q)-2}$ = | 240 |
| $X_{2-(p,q)-2}$ = | 255 |
| $X_{3-(p,q)-2}$ = | 160 |
| $Max_{(p,q)-2}$ = | 255 |
| $Min_{(p,q)-2}$ = | 160 |
| $S_{(p,q)-2}$ = | 0.373 |
| $V_{(p,q)-2}$ = | 255 |
| $V_{max}(S)$ = | 638 |
| $\alpha_0$ = | 1.592 |

For example, according to the input signal values indicated in Table 3, in the case where the expansion coefficient $\alpha_0$ is taken into consideration, the values of the luminance to be displayed based on the input signal values ($x_{1-(p,q)}$, $x_{2-(p,q)}$, $x_{3-(p,q)}$)=(240, 255, 160) become, in compliance with 8-bit display, $$\text{luminance value of first subpixel}=\alpha_0\cdot x_{1-(p,q)}=1.592\times 240=382 \quad (22\text{-A})$$

$$\text{luminance value of second subpixel}=\alpha_0\cdot x_{2-(p,q)}=1.592\times 255=406 \quad (22\text{-B})$$

$$\text{luminance value of third subpixel}=\alpha_0\cdot x_{3-(p,q)}=1.592\times 160=255 \quad (22\text{-C})$$

$$\text{luminance value of fourth subpixel}=\alpha_0\cdot x_{4-(p,q)}=1.592\times 160=255 \quad (22\text{-D})$$

Accordingly, the first subpixel output signal value $X_{1-(p,q)}$, second subpixel output signal value $X_{2-(p,q)}$, third subpixel output signal value $X_{3-(p,q)}$ and fourth subpixel output signal value $X_{4-(p,q)}$ become such as given below.

$$X_{1-(p,q)}=382-255=127$$

$$X_{2-(p,q)}=406-255=151$$

$$X_{3-(p,q)}=255-255=0$$

$$X_{4-(p,q)}=255/\chi=170$$

In this manner, the output signal values $X_{1-(p,q)}$, $X_{2-(p,q)}$ and $X_{3-(p,q)}$ of the first, second and third subpixels become lower than the values required originally.

In the image display apparatus assembly or the driving method for an image display apparatus assembly of the working example 2, the output signal values $X_{1-(p,q)}$, $X_{2-(p,q)}$, $X_{3-(p,q)}$ and $X_{4-(p,q)}$ of the (p, q) th pixel group $PG_{(p,q)}$ are expanded to $\alpha_0$ times. Therefore, in order to obtain a luminance of an image equal to the luminance of an image in a non-expanded state, the luminance of the planar light source apparatus 50 should be reduced based on the expansion coefficient $\alpha_0$. In particular, the luminance of the planar light source apparatus 50 should be set to $1/\alpha_0$ times. By this, reduction of the power consumption of the planar light source apparatus can be anticipated.

Figure 9:
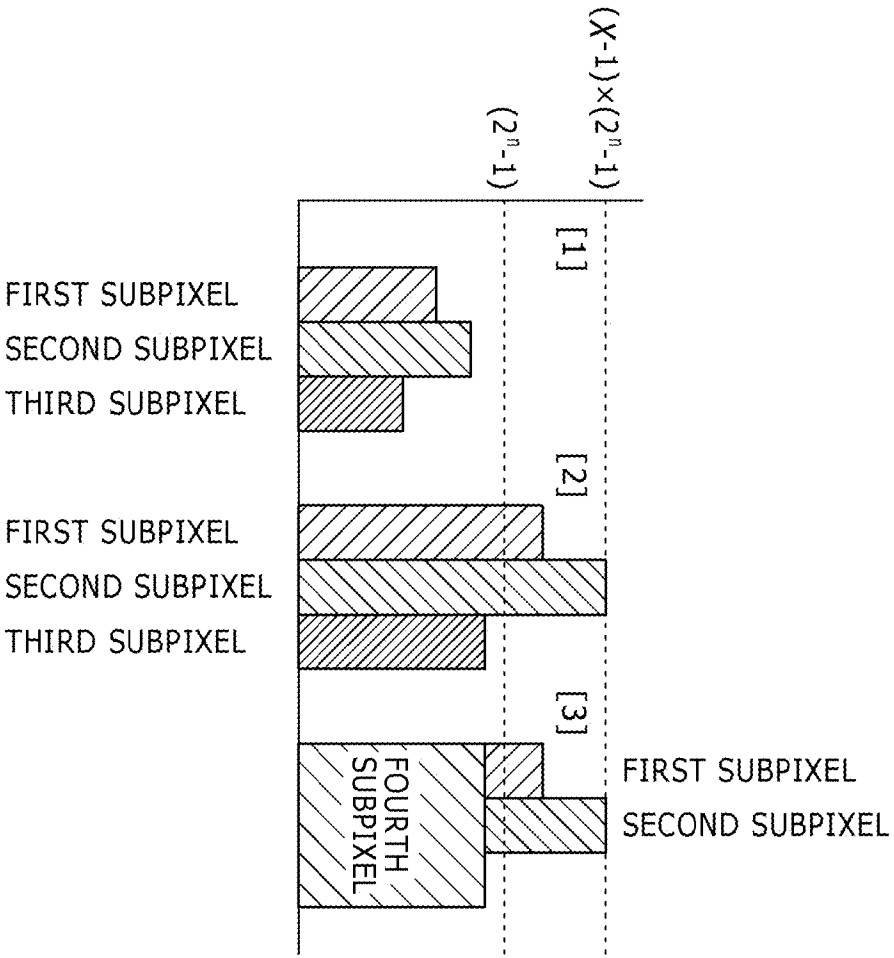
FIG. 9 is a diagrammatic view schematically illustrating input signal values and output signal values in an expansion process in a driving method for an image display apparatus and a driving method for an image display apparatus assembly according to the working example 2.

An expansion process in the driving method for an image display apparatus and the driving method for an image display apparatus assembly of the working example 2 is described with reference to FIG. 9. FIG. 9 schematically illustrates input signal values and output signal values. Referring to FIG. 9, the input signal values of a set of the first, second and third subpixels at which $\alpha_{min}$ is obtained are indicated in [1]. Meanwhile, the input signal values expanded by an expansion operation, that is, by an operation of calculating the product of an input signal value and the expansion coefficient $\alpha_0$, are indicated in [2]. Furthermore, the output signal values after an expansion operation is carried out, that is, a state in which the output signal values $X_{1-(p,q)}$, $X_{2-(p,q)}$, $X_{3-(p,q)}$, and $X_{4-(p,q)}$ are obtained, are indicated in [3]. In the example illustrated in FIG. 9, a maximum luminance which can be implemented is obtained with the second subpixel.

It is to be noted that, since, in each pixel group, the ratio $$X_{1-(p,q)}:X_{2-(p,q)}:X_{3-(p,q)}$$

of the output signal values of the first and second pixels is a little different from the ratio $$x_{1-(p,q)}:x_{2-(p,q)}:x_{3-(p,q)}$$

of the input signal values, if each pixel group is observed solely, then some difference occurs with the color tone of the pixel group with respect to the input signal. However, when each pixel group is observed as a pixel group, no problem occurs with the color tone of the pixel group.

Working Example 3

Figure 10:
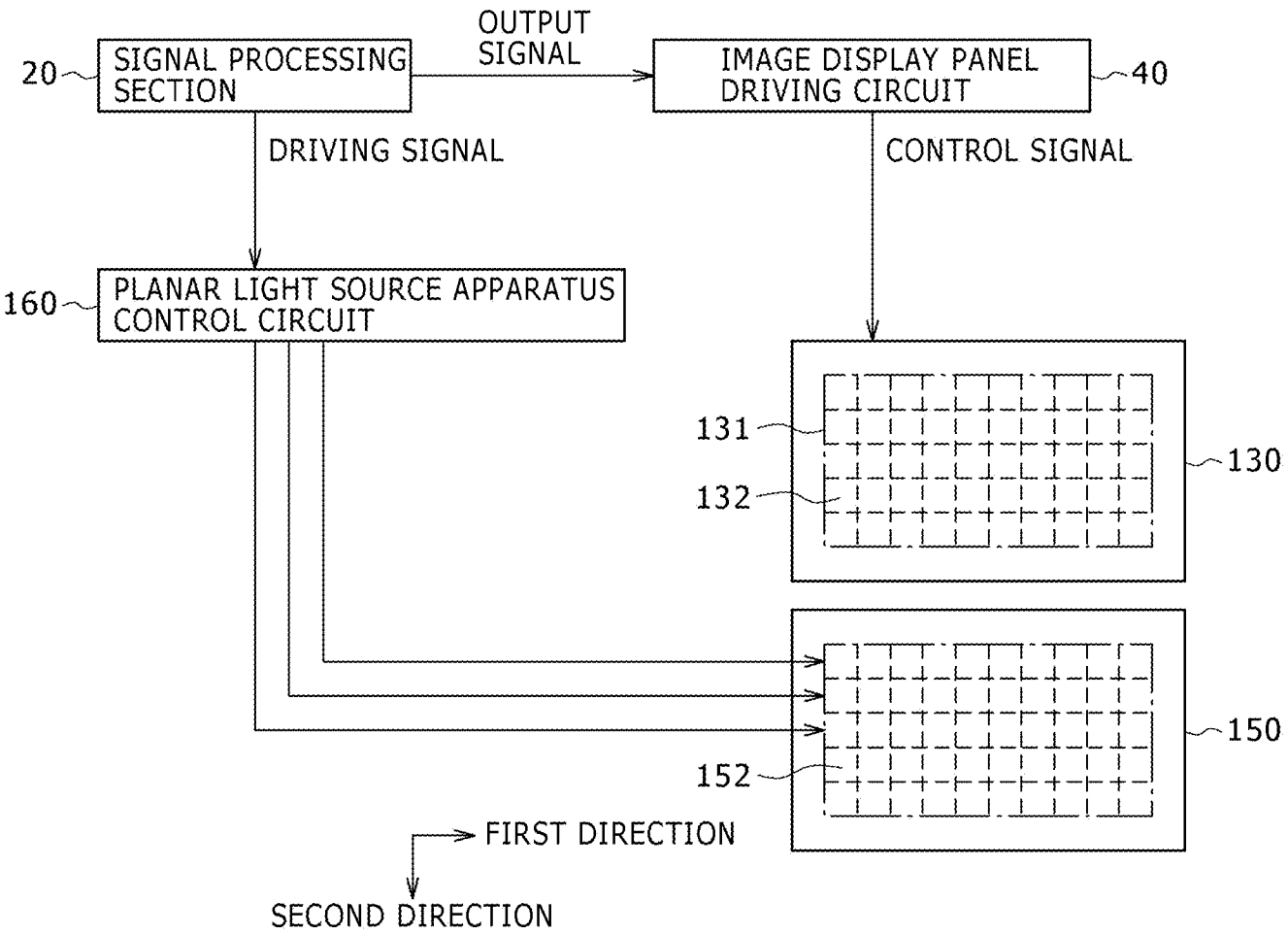
FIG. 10 is a block diagram of an image display panel and a planar light source apparatus which configure an image display apparatus assembly according to a working example 3 of the present invention.

The working example 3 is a modification to the second working example 2. For the planar light source apparatus, although a planar light source apparatus of the direct type in related arts may be adopted, in the working example 3, a planar light source apparatus 150 of the divisional driving type, that is, of the partial driving type, described hereinbelow is adopted as shown in FIG. 10. It is to be noted that the expansion process itself may be similar to that described hereinabove in connection with the working example 2.

The planar light source apparatus 150 of the divisional driving type is formed from S×T planar light source units 152 which correspond, in the case where it is assumed that a display region 131 of an image display panel 130 which configures a color liquid crystal display apparatus is divided into S×T virtual display region units 132, to the S×T display region units 132. The light emission state of the S×T planar light source units 152 is controlled individually.

Referring to FIG. 10, the image display panel 130 which is a color liquid crystal display panel includes the display region 131 in which totaling $P_0 \times Q$ pixels are arrayed in a two-dimensional matrix including $P_0$ pixels disposed along the first direction and Q pixels disposed along the second direction. Here, it is assumed that the display region 131 is divided into S×T virtual display region units 132. Each of the display region units 132 includes a plurality of pixels. In particular, if the image displaying resolution satisfies the HD-TV standard and the number of pixels arrayed in a two-dimensional matrix is represented by ($P_0$, Q), then the number of pixels is (1920, 1080). Further, the display region 131 configured from pixels arrayed in a two-dimensional matrix and indicated by an alternate long and short dash line in FIG. 10 is divided into S×T virtual display region units 132 boundaries between which are indicated by broken lines. The value of (S, T) is, for example, (19, 12). However, for simplified illustration, the number of display region units 132, and also of planar light source units 152 hereinafter described, in FIG. 10 is different from this value. Each of the display region units 132 includes a plurality of pixels, and the number of pixels which configure one display region unit 132 is, for example, approximately 10,000. Usually, the image display panel 130 is line-sequentially driven. More particularly, the image display panel 130 has scanning electrodes extending along the first direction and data electrodes extending along the second direction such that they cross with each other like a matrix. A scanning signal is inputted from a scanning circuit to the scanning electrodes to select and scan the scanning electrodes while data signals or output signals are inputted to the data electrodes from a signal outputting circuit so that the image display panel 130 displays an image based on the data signal to form a screen image.

The planar light source apparatus or backlight 150 of the direct type includes S×T planar light source units 152 corresponding to the S×T virtual display region unit 132, and the planar light source units 152 illuminate the display region units 132 corresponding thereto from the rear side. Light sources provided in the planar light source units 152 are controlled individually. It is to be noted that, while the planar light source apparatus 150 is positioned below the image display panel 130, in FIG. 10, the image display panel 130 and the planar light source apparatus 150 are shown separately from each other.

While the display region 131 configured from pixels arrayed in a two-dimensional matrix is divided in to the S×T display region units 132, this state can be regarded such that, if it is represented with "row" and "column," then it is considered that the display region 131 is divided into the display region units 132 disposed in T rows×S columns. Further, although the display region unit 132 is configured from a plurality of ($M_0 \times N_0$) pixels, if this state is represented with "row" and "column," then it is considered that the display region unit 132 is configured from the pixels disposed in $N_0$ rows×$M_0$ columns.

Figure 12:
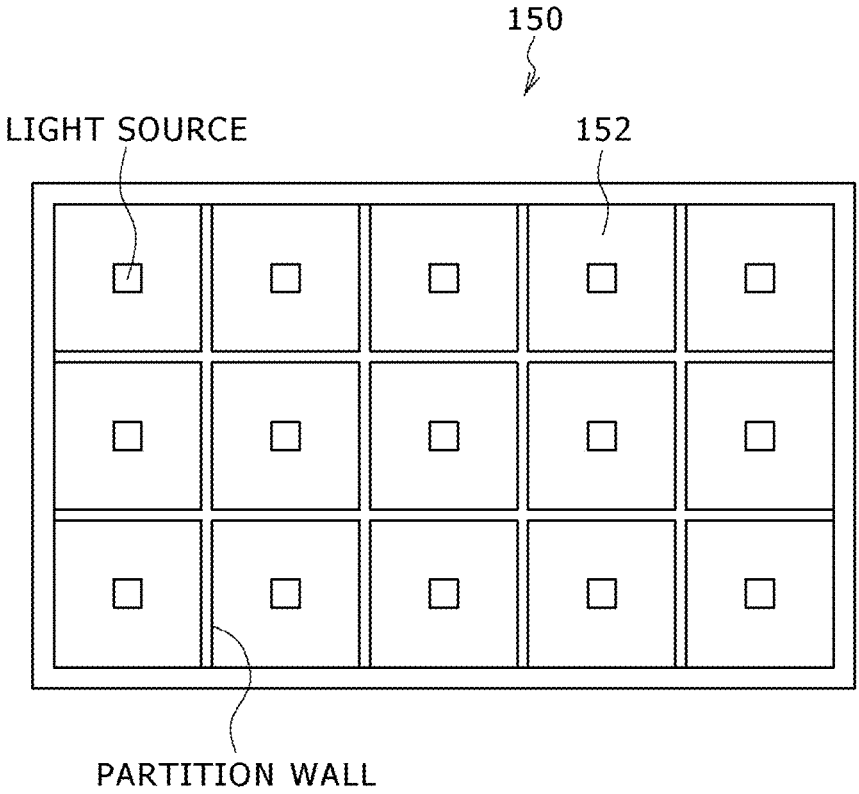
FIG. 12 is a view schematically illustrating an arrangement and array state of planar light source units and so forth of the planar light source apparatus of the image display apparatus assembly of the working example 3.

A disposition array state of the planar light source units 152 and so forth of the planar light source apparatus 150 is illustrated in FIG. 12. Each light source is formed from a light emitting diode 153 which is driven based on a pulse width modulation (PWM) controlling method. Increase or decrease of the luminance of the planar light source unit 152 is carried out by increasing or decreasing control of the duty ratio in pulse width modulation control of the light emitting diode 153 which constitutes the planar light source unit 152. Illuminating light emitted from the light emitting diode 153 goes out from the planar light source unit 152 through a light diffusion plate and successively passes through an optical functioning sheet group including a light diffusion sheet, a prism sheet and a polarized light conversion sheet (all not shown) until it illuminates the image display panel 130 from the rear side. One light sensor which is a photodiode 67 is disposed in each planar light source unit 152. The photodiode 67 measures the luminance and the chromaticity of the light emitting diode 153.

Figure 11:
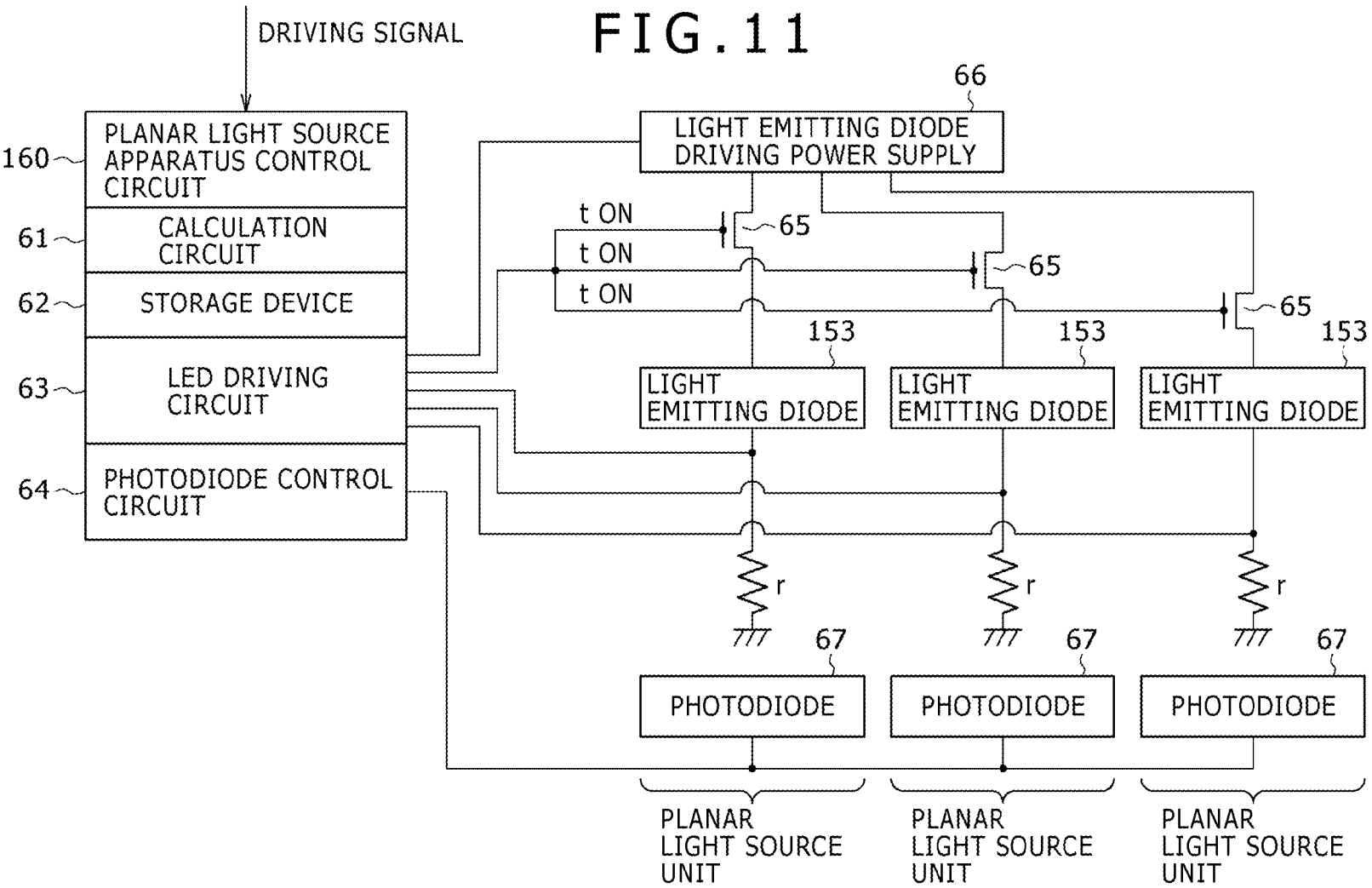
FIG. 11 is a block circuit diagram of a planar light source apparatus control circuit of the planar light source apparatus of the image display apparatus assembly of the working example 3.

Referring to FIGS. 10 and 11, a planar light source apparatus control circuit 160 for driving the planar light source units 152 based on a planar light source apparatus control signal or driving signal from the signal processing section 20 carries out on/off control of the light emitting diode 153 which configures each planar light source unit 152. The planar light source apparatus control circuit 160 includes a calculation circuit 61, a storage device or memory 62, an LED driving circuit 63, a photodiode control circuit 64, a switching element 65 formed from an FET, and a light emitting diode driving power supply 66 which is a constant current source. The circuit elements which configure the planar light source apparatus control circuit 160 may be known circuit elements.

The light emission state of each light emitting diode 153 in a certain image displaying frame is measured by the corresponding photodiode 67, and an output of the photodiode 67 is inputted to the photodiode control circuit 64 and is converted into data or a signal representative of, for example, a luminance and a chromaticity of the light emitting diode 153 by the photodiode control circuit 64 and the calculation circuit 61. The data is sent to the LED driving circuit 63, by which the light emission state of the light emitting diode 153 in a next image displaying frame is controlled with the data. In this manner, a feedback mechanism is formed.

A resistor r for current detection is inserted in series to the light emitting diode 153 on the downstream of the light emitting diode 153, and current flowing through the resistor r is converted into a voltage. Then, operation of the light emitting diode driving power supply 66 is controlled under the control of the LED driving circuit 63 so that the voltage drop across the resistor r may exhibit a predetermined value. While FIG. 11 shows that one light emitting diode driving power supply 66 serving as a constant current source is shown provided, actually such light emitting diode driving power supplies 66 are disposed for driving individual ones of the light emitting diodes 153. It is to be noted that three planar light source units 152 are shown in FIG. 11. While FIG. 11 shows the configuration wherein one light emitting diode 153 is provided in one planar light source unit 152, the number of light emitting diodes 153 which configure one planar light source unit 152 is not limited to one.

Each pixel group is configured from four kinds of subpixels including first, second, third and fourth subpixels as described above. Here, control of the luminance, that is, gradation control, of each subpixel is carried out by 8-bit control so that the luminance is controlled among $2^8$ stages of 0 to 255. Also, values PS of a pulse width modulation output signal for controlling the light emission time period of each light emitting diodes 153 constituting each planer light source unit 152 are among $2^8$ stages of 0 to 255. However, the number of stages of the luminance is not limited to this, and the luminance control may be carried out, for example, by 10-bit control such that the luminance is controlled among $2^{10}$ of 0 to 1,023. In this instance, the representation of a numerical value of 8 bits may be, for example, multiplied by four.

Following definitions are applied to the light transmission factor (also called numerical aperture) $L_t$ of a subpixel, the luminance y, that is, display luminance, of a portion of the display region which corresponds to the subpixel and the luminance Y of the planar light source unit 152, that is, the light source luminance.

$Y_1$: for example, a maximum luminance of the light source luminance, and this luminance is hereinafter referred to sometimes as light source luminance first prescribed value.

$Lt_1$: for example, a maximum value of the light transmission factor or numerical aperture of a subpixel of the display region unit 132, and this value is hereinafter referred to sometimes as light transmission factor first prescribed value.

$Lt_2$: a transmission factor or numerical aperture of a subpixel when it is assumed that a control signal corresponding to the display region unit signal maximum value $X_{max\text{-}(s,t)}$ which is a maximum value among values of an output signal of the signal processing section 20 inputted to the image display panel driving circuit 40 in order to drive all subpixels of the display region unit 132 is supplied to the subpixel, and the transmission factor or numerical aperture is hereinafter referred to sometimes as light transmission factor second prescribed value. It is to be noted that the transmission factor second prescribed value $Lt_2$ satisfies $0 \leq Lt_2 \leq Lt_1$.

$y_2$: a display luminance obtained when it is assumed that the light source luminance is the light source luminance first prescribed value $Y_1$ and the light transmission factor or numerical aperture of a subpixel is the light transmission factor second prescribed value $Lt_2$, and the display luminance is hereinafter referred to sometimes as display luminance second prescribed value.

$Y_2$: a light source luminance of the planar light source unit 152 for making the luminance of a subpixel equal to the display luminance second prescribed value $y_2$ when it is assumed that a control signal corresponding to the display region unit signal maximum value $X_{max\text{-}(s,t)}$ is supplied to the subpixel and besides it is assumed that the light transmission factor or numerical aperture of the subpixel at this time is corrected to the light transmission factor first prescribed value $Lt_1$. However, the light source luminance $Y_2$ may be corrected taking an influence of the light source luminance of each planar light source unit 152 upon the light source luminance of any other planar light source unit 152 into consideration.

Figure 13A:
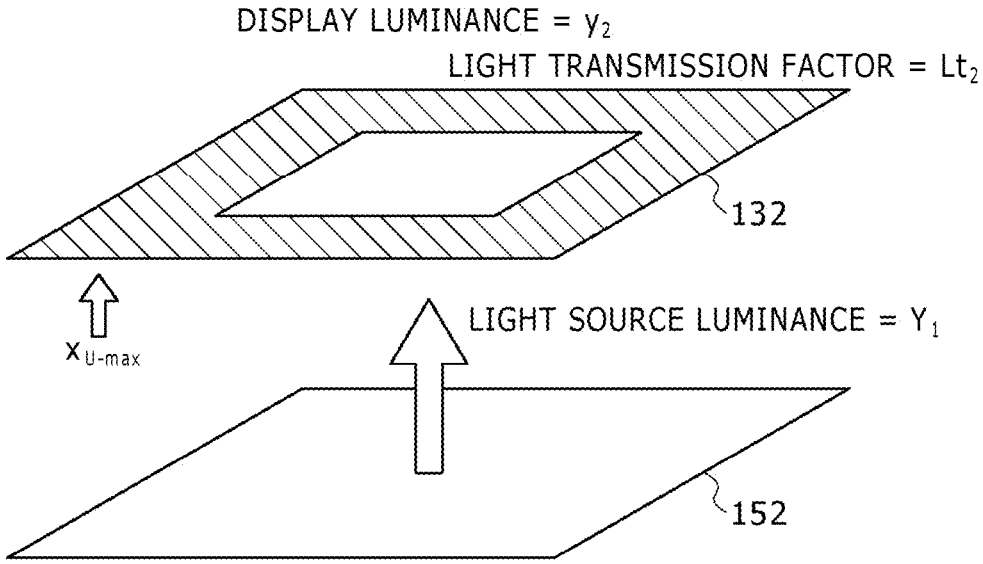
FIGS. 13A and 13B are schematic views illustrating states of increasing or decreasing, under the control of a planar light source apparatus control circuit, the light source luminance of the planar light source unit so that a display luminance second prescribed value when it is assumed that a control signal corresponding to a display region unit signal maximum value is supplied to a subpixel may be obtained by the planar light source unit.
Figure 13B:
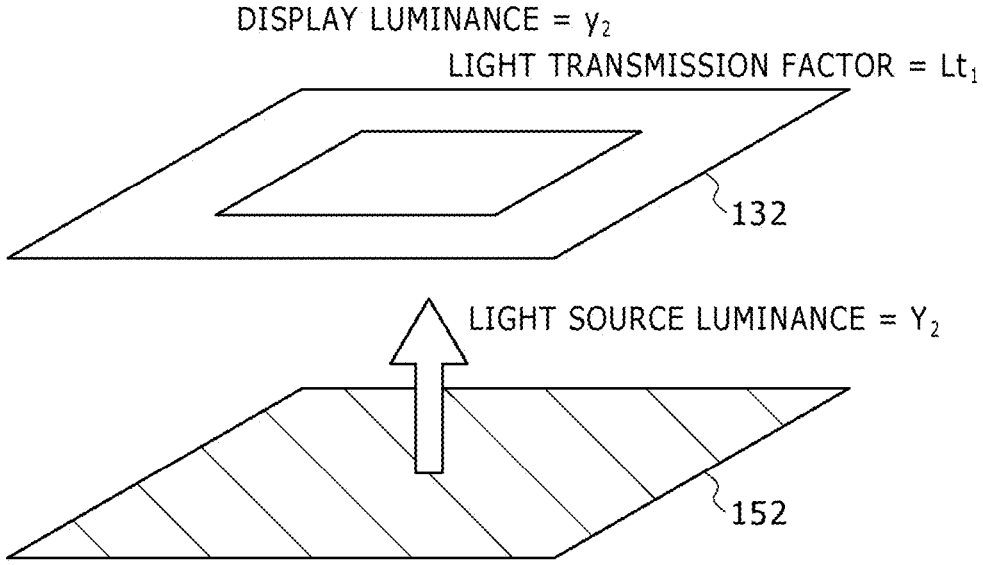

Upon partial driving or divisional driving of the planar light source apparatus, the luminance of a light emitting element which configures a planar light source unit 152 corresponding to a display region unit 132 is controlled by the planar light source apparatus control circuit 160 so that the luminance of a subpixel when it is assumed that a control signal corresponding to the display region unit signal maximum value $X_{max\text{-}(s,t)}$ is supplied to the subpixel, that is, the display luminance second prescribed value $y_2$ at the light transmission factor first prescribed value $Lt_1$, may be obtained. In particular, for example, the light source luminance $Y_2$ may be controlled, for example, reduced, so that the display luminance $y_2$ may be obtained when the light transmission factor or numerical aperture of the subpixel is set, for example, to the light transmission factor first prescribed value $Lt_1$. In particular, the light source luminance $Y_2$ of the planar light source unit 152 may be controlled for each image display frame so that, for example, the following expression (A) may be satisfied. It is to be noted that the light source luminance $Y_2$ and the light source luminance first prescribed value $Y_1$ have a relationship of $Y_2 \leq Y_1$. Such control is schematically illustrated in FIGS. 13A and 13B.

$$Y_2 \cdot Lt_1 = Y_1 \cdot Lt_2 \quad \text{(A)}$$

In order to individually control the subpixels, the output signal values $X_{1\text{-}(p,q)}$, $X_{2\text{-}(p,q)}$, $X_{3\text{-}(p,q)}$ and $X_{4\text{-}(p,q)}$ for controlling the light transmission factor Lt of the individual subpixels are signaled from the signal processing section 20 to the image display panel driving circuit 40. In the image display panel driving circuit 40, control signals are produced from the output signals and supplied or outputted to the subpixels. Then, a switching element which configures each subpixel is driven based on a pertaining one of the control signals and a desired voltage is applied to a transparent first electrode and a transparent second electrode not shown which configure a liquid crystal cell to control the light transmission factor Lt or numerical aperture of the subpixel. Here, as the magnitude of the control signal increases, the light transmission factor Lt or numerical aperture of the subpixel increases and the luminance, that is, the display luminance y, of a portion of the display region corresponding to the subpixel increases. In particular, an image configured from light passing through the subpixel and normally a kind of a point is bright.

Control of the display luminance y and the light source luminance $Y_2$ is carried out for each one image display frame, for each display region unit and for each planar light source unit in image control of the image display panel 130. Further, operation of the image display panel 130 and operation of the planar light source apparatus 150 within one image display frame are synchronized with each other. It is to be noted that the number of image information sent as an electric signal to the driving circuit for one second, that is, the number of images per one second, is a frame frequency or frame rate, and the reciprocal number to the frame frequency is frame time whose unit is second.

In the working example 2, an expansion process of expanding an input signal to obtain an output signal is carried out for all pixels based on one expansion coefficient $\alpha_0$. On the other hand, in the working example 3, an expansion coefficient $\alpha_0$ is calculated for each of the S×T display region units 132, and an expansion process based on the calculated expansion coefficient $\alpha_0$ is carried out for each display region unit 132.

Then, in the (s,t)th planar light source unit 152 which corresponds to the (s,t)th display region unit 132 whose determined expansion coefficient is $\alpha_{0-(s,t)}$, the luminance of the light source is set to $1/\alpha_{0-(s,t)}$.

Or, the luminance of a light source which configures the planar light source unit 152 corresponding to each display region unit 132 is controlled by the planar light source apparatus control circuit 160 so that a luminance of a subpixel when it is assumed that a control signal corresponding to the display region unit signal maximum value $X_{max-(s,t)}$ which is a maximum value among output signal values of the signal processing section 20 inputted to drive all subpixels which configure each display region unit 132 is supplied to the subpixel, that is, the display luminance second prescribed value $y_2$ at the light transmission factor first prescribed value $Lt_1$, may be obtained. In particular, the light source luminance $Y_2$ may be controlled, for example, reduced, so that the display luminance $y_2$ may be obtained when the light transmission factor or numerical aperture of the subpixel is set to the light transmission factor first prescribed value $Lt_1$. In other words, particularly the light source luminance $Y_2$ of the planar light source unit 152 may be controlled for each image display frame so that the expression (A) given hereinabove may be satisfied.

Incidentally, in the planar light source apparatus 150, in the case where luminance control of the planar light source unit 152 of, for example, (s,t)=(1,1) is assumed, there are cases where it is necessary to take an influence from the other S×T planar light source units 152 into consideration. Since the influence upon the planar light source unit 152 from the other planar light source units 152 is known in advance from a light emission profile of each of the planar light source unit 152, the difference can be calculated by backward calculation, and as a result, correction of the influence is possible. A basic form of the calculation is described below.

The luminance, that is, the light source luminance $Y_2$, required for the S×T planar light source units 152 based on the requirement of the expression (A) is represented by a matrix $[L_{P\times Q}]$. Further, the luminance of a certain planar light source unit which is obtained when only the certain planar light source unit is driven while the other planar light source units are not driven is determined with regard to the S×T planar light source units 152 in advance. The luminance in this instance is represented by a matrix $[L'_{P\times Q}]$. Further, correction coefficients are represented by a matrix $[\alpha_{P\times Q}]$. Consequently, a relationship among the matrices can be represented by the following expression (B-1). The matrix $[\alpha_{P\times Q}]$ of the correction coefficients can be determined in advance.

$$[L_{P\times Q}]=[L'_{P\times Q}]\cdot[\alpha_{P\times Q}] \quad \text{(B-1)}$$

Therefore, the matrix $[L'_{P\times Q}]$ may be determined from the expression (B-1). The matrix $[L'_{P\times Q}]$ can be determined by calculation of an inverse matrix. In particular, $$[L'_{P\times Q}]=[L_{P\times Q}]\cdot[\alpha_{P\times Q}]^{-1} \quad \text{(B-2)}$$

may be calculated. Then, the light source, that is, the light emitting diode 153, provided in each planar light source unit 152 may be controlled so that the luminance represented by the matrix $[L'_{P\times Q}]$ may be obtained. In particular, such operation or processing may be carried out using information or a data table stored in the storage device or memory 62 provided in the planar light source apparatus control circuit 160. It is to be noted that, in the control of the light emitting diodes 153, since the value of the matrix $[L'_{P\times Q}]$ cannot assume a negative value, it is a matter of course that it is necessary for a result of the calculation to remain within a positive region. Accordingly, the solution of the expression (B-2) sometimes becomes an approximate solution but not an exact solution.

In this manner, a matrix [L' p×Q] when it is assumed that each planar light source unit is driven solely is determined as described above based on a matrix $[L_{P\times Q}]$ obtained based on values of the expression (A) obtained by the planar light source apparatus control circuit 160 and a matrix $[\alpha_{P\times Q}]$ of correction coefficients, and the matrix $[L'_{P\times Q}]$ is converted into corresponding integers, that is, values of a pulse width modulation output signal, within the range of 0 to 255 based on the conversion table stored in the storage device 62. In this manner, the calculation circuit 61 which configures the planar light source apparatus control circuit 160 can obtain a value of a pulse width modulation output signal for controlling the light emission time period of the light emitting diode 153 of the planar light source unit 152. Then, based on the value of the pulse width modulation output signal, the on time $t_{ON}$ and the off time $t_{OFF}$ of the light emitting diode 153 which configures the planar light source unit 152 may be determined by the planar light source apparatus control circuit 160. It is to be noted that:

$$t_{ON}+t_{OFF}=\text{fixed value } t_{const}$$

Further, the duty ratio in driving based on pulse width modulation of the light emitting diode can be represented as $$t_{ON}/(t_{ON}+t_{OFF})=t_{ON}/t_{Const}$$

Then, a signal corresponding to the on time $t_{ON}$ of the light emitting diode 153 which configures the planar light source unit 152 is sent to the LED driving circuit 63, and the switching element 65 is controlled to an on state only within the on time $t_{ON}$ based on the value of the signal corresponding to the on time $t_{ON}$ from the LED driving circuit 63. Consequently, LED driving current from the light emitting diode driving power supply 66 is supplied to the light emitting diode 153. As a result, each light emitting diode 153 emits light only for the on time $t_{ON}$ within one image display frame. In this manner, each display region unit 132 is illuminated with a predetermined illuminance.

It is to be noted that the planar light source apparatus 150 of the divisional driving type or partial driving type described hereinabove in connection with the working example 3 may be applied also to the working example 1.

Working Example 4

Also the working example 4 is a modification to the working example 2. In the working example 4, an image display apparatus described below is used. In particular, the image display apparatus of the working example 4 includes an image display panel wherein a plurality of light emitting element units UN for displaying a color image, which are each configured from a first light emitting element which corresponds to a first subpixel for emitting blue light, a second light emitting element which corresponds to a second subpixel for emitting green light, a third light emitting element which corresponds to a third subpixel for emitting red light and a fourth light emitting element which corresponds to a fourth subpixel for emitting white light are arrayed in a two-dimensional matrix. Here, the image display panel which configures the image display apparatus of the working example 4 may be, for example, an image display panel having a configuration and structure described below. It is to be noted that the number of light emitting element units UN may be determined based on specifications required for the image display apparatus.

In particular, the image display panel which configures the image display apparatus of the working example 4 is a direct-vision color image display panel of the passive matrix type or the active matrix type wherein the light emitting/no-light emitting states of the first, second, third and fourth light emitting elements are controlled so that the light emission states of the light emitting elements may be directly visually observed to display an image. Or, the image display panel is a color image display panel of the passive matrix projection type or the active matrix projection type wherein the light emitting/no-light emitting states of the first, second, third and fourth light emitting elements are controlled such that light is projected on a screen to display an image.

Figure 14:
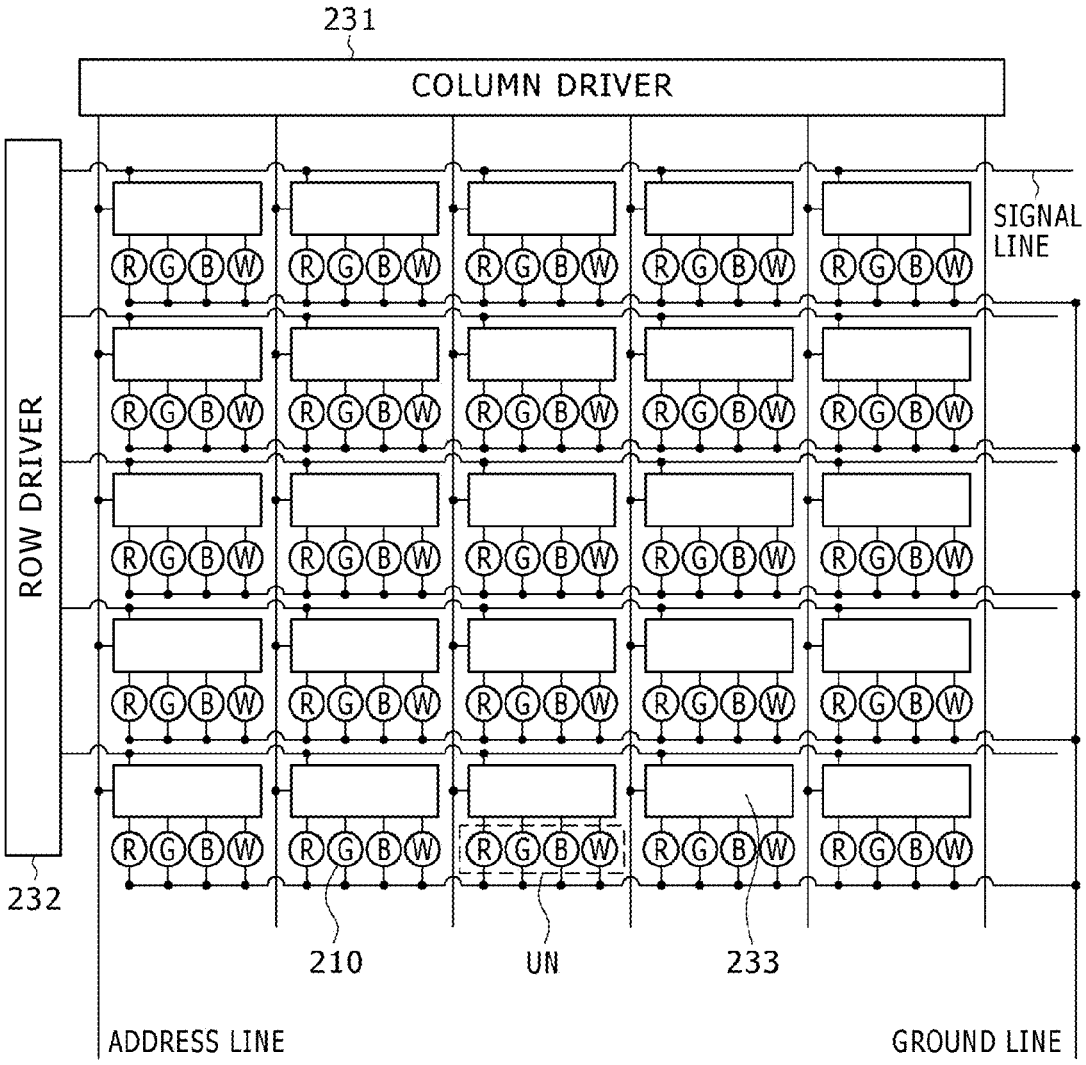
FIG. 14 is an equivalent circuit diagram of an image display apparatus of a working example 4 of the present invention.

For example, a light emitting element panel which configures a direct-vision color image display panel of the active matrix type is shown in FIG. 14. Referring to FIG. 14, a light emitting element for emitting red light, that is, a first subpixel, is denoted by "R"; a light emitting element for emitting green light, that is, a second subpixel, by "G"; a light emitting element for emitting blue light, that is, a third subpixel, by "B"; and a light emitting element for emitting white light, that is, a fourth subpixel, by "W." Each of light emitting elements 210 is connected at one electrode thereof, that is, at the p side electrode or the n side electrode thereof, to a driver 233. Such drivers 233 are connected to a column driver 231 and a row driver 232. Each light emitting element 210 is connected at the other electrode thereof, that is, at the n side electrode or the p side electrode thereof, to a ground line. Control of each light emitting element 210 between the light emitting state and the no-light emitting state is carried out, for example, by selection of the driver 233 by the row driver 232, and a luminance signal for driving each light emitting element 210 is supplied from the column driver 231 to the driver 233. Selection of any of the light emitting element R for emitting red light, that is, the first light emitting element or first subpixel, the light emitting element G for emitting green light, that is, the second light emitting element or second subpixel, the light emitting element B for emitting blue light, that is, the third light emitting element or third subpixel and the light emitting element W for emitting white light, that is, the fourth light emitting element or fourth subpixel, is carried out by the driver 233. The light emitting and no-light emitting states of the light emitting element R for emitting red light, the light emitting element G for emitting green light, the light emitting element B for emitting blue light and the light emitting element W for emitting white light may be controlled by time division control or may be controlled simultaneously. It is to be noted that, in the case where the image display apparatus is of the direct vision type, an image is viewed directly, but where the image display apparatus is of the projection type, an image is projected on a screen through a projection lens.

It is to be noted that an image display panel which configures such an image display apparatus as described above is schematically shown in FIG. 15. In the case where the image display apparatus is of the direct-vision type, the image display panel is viewed directly, but where the image display apparatus is of the projection type, an image is projected from the display panel to the screen through a projection lens 203.

Figure 15:
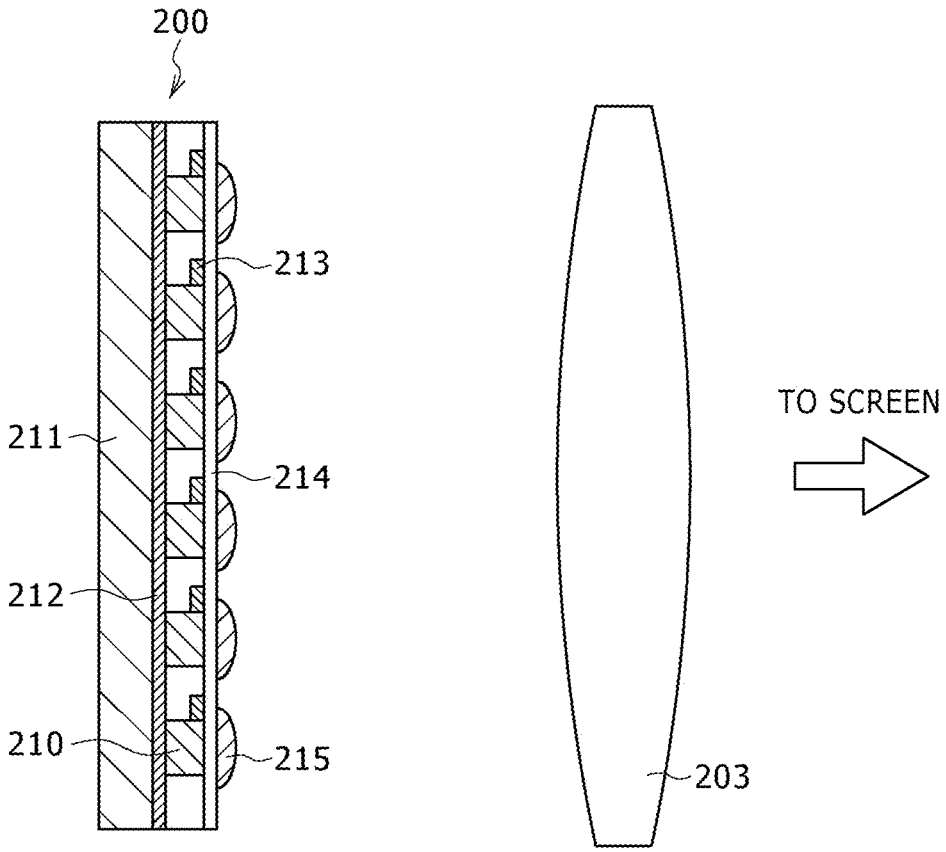
FIG. 15 is a schematic view of an image display panel which composes the image display apparatus of the working example 4.

Referring to FIG. 15, the light emitting element panel 200 includes a substrate 211 formed, for example, from a printed circuit board, light emitting elements 210 attached to the substrate 211, X direction wiring lines 212 electrically connected to one electrode, for example, to the p side electrode or the n side electrode, of the light emitting elements 210 and connected to the column driver 231 or the row driver 232, and Y direction wiring lines 213 electrically connected to the other electrode, that is, to the n side electrode or the p side electrode, of the light emitting elements 210 and connected to the row driver 232 or the column driver 231. The light emitting element panel 200 further includes a transparent backing 214 for covering the light emitting elements 210, and a microlens member 215 provided on the transparent backing 214. It is to be noted that the configuration of the light emitting element panel 200 is not limited to the configuration described.

In the working example 4, output signals for controlling the light emission state of the first, second, third and fourth light emitting elements, that is, the first, second third and fourth subpixels, may be obtained based on the expansion process described hereinabove in connection with the working example 2. Then, if the image display apparatus is driven based on the output signal values obtained by the expansion process, then the luminance of the entire image display apparatus can be increased to $\alpha_0$ times. Or, if the emitted light luminance of the first, second, third and fourth light emitting elements, that is, the first, second, third and fourth subpixels, is controlled to $1/\alpha_0$ times based on the output signal values, then reduction of the power consumption of the entire image display apparatus can be achieved without causing deterioration of the image quality.

As occasion demands, output signals for controlling the light emitting state of the first, second, third and fourth light emitting elements, that is, the first, second, third and fourth subpixels, may be obtained by the process described hereinabove in connection with the working example 1.

Working Example 5

The working example 5 relates to a driving method for an image display apparatus according to the second embodiment of the present invention and a driving method for an image display apparatus assembly according to the second embodiment of the present invention. The working example 5 relates particularly to the 2Ath mode.

Similarly to the image displaying apparatus described hereinabove with reference to FIG. 2, the image display apparatus 10 of the working example 5 includes an image display panel 30 and a signal processing section 20. Meanwhile, the image display apparatus assembly of the working example 5 includes an image display apparatus 10, and a planar light source apparatus 50 for illuminating the image display apparatus 10, particularly a image display panel 30, from the rear side. The image display panel 30 includes totaling P×Q pixel groups arrayed in a two-dimensional matrix including P pixel groups arrayed in a first direction such as, for example, in the horizontal direction and Q pixel groups arrayed in a second direction such as, for example, in the vertical direction. It is to be noted that, where the number of pixels which configure a pixel group is $p_0$, $p_0=2$.

Figure 16:
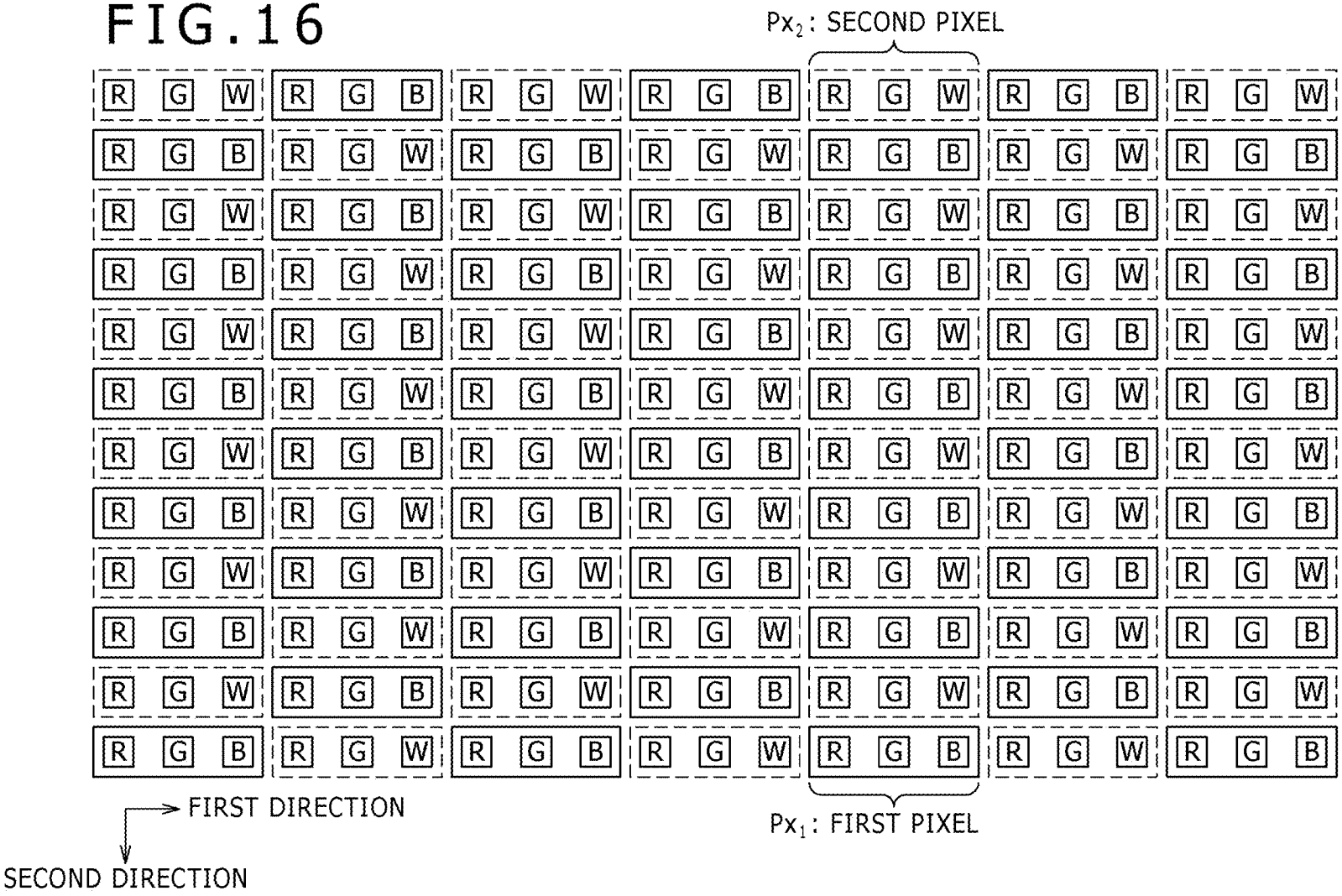
FIGS. 16, 17 and 18 are views schematically illustrating different arrangements of pixels and pixel groups on an image display panel of a working example 5 of the present invention.
Figure 17:
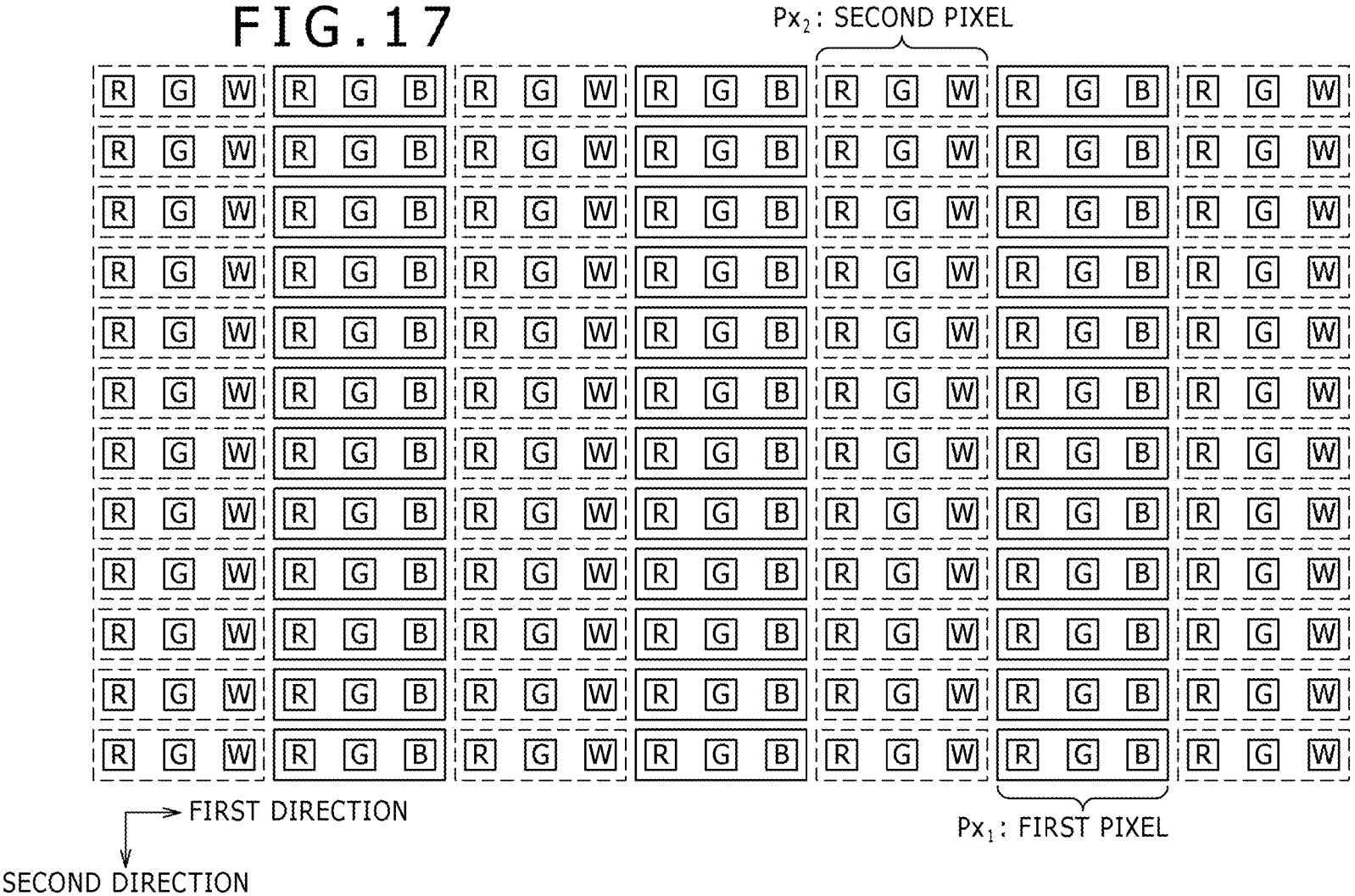

In particular, as seen from the arrangement of pixels of FIG. 16 or 17, in the image display panel 30 in the working example 5, each pixel group includes a first pixel $Px_1$ and a second pixel $Px_2$ along the first direction. The first pixel $Px_1$ includes a first subpixel denoted by "R" for displaying a first primary color such as, for example, red, a second subpixel denoted by "G" for displaying a second primary color such as, for example, green, and a third subpixel denoted by "B" for displaying a third primary color such as, for example, blue. Meanwhile, the second pixel $Px_2$ includes a first subpixel R for displaying the first primary color, a second subpixel G for displaying the second primary color, and a fourth subpixel W for displaying a fourth color such as, for example white. It is to be noted that, in FIGS. 16 and 17, the first, second and third subpixels which configure the first pixel $Px_1$ are surrounded by solid lines while the first, second and fourth subpixels which configure the second pixel $Px_2$ are surrounded by broken lines. More particularly, in the first pixel $Px_1$, the first subpixel R for displaying the first primary color, the second subpixel G for displaying the second primary color and the third subpixel B for displaying the third primary color are arrayed in order along the first direction. Meanwhile, in the second pixel $Px_2$, the first subpixel R for displaying the first primary color, the second subpixel G for displaying the second primary color and the fourth subpixel W for displaying the fourth color are arrayed in order along the first direction. The third subpixel B which configures the first pixel $Px_1$ and the first subpixel R which configures the second pixel $Px_2$ are positioned adjacent each other. Meanwhile, the fourth subpixel W which configures the second pixel $Px_2$ and the first subpixel R which configures the first pixel $Px_1$ in a pixel group adjacent the pixel group are positioned adjacent each other. It is to be noted that the subpixels have a rectangular shape and are disposed such that the major side thereof extends in parallel to the second direction and the miner side thereof extends in parallel to the first direction.

In the example shown in FIG. 16, a first pixel and a second pixel are disposed adjacent each other along the second direction. In this instance, the first subpixel which configures the first pixel and the first subpixel which configures the second pixel may be disposed adjacent each other or may not be disposed adjacent each other. Similarly, the second subpixel which configures the first pixel and the second subpixel which configures the second pixel may be disposed adjacent each other or may not be disposed adjacent each other along the second direction. Similarly, the third subpixel which configures the first pixel and the fourth subpixel which configures the second pixel may be disposed adjacent each other or may not be disposed adjacent each other along the second direction. On the other hand, in the example shown in FIG. 17, a first pixel and another first pixel are disposed adjacent each other and a second pixel and another second pixel are disposed adjacent each other along the second direction. Also in this instance, the first subpixel which configures the first pixel and the first subpixel which configures the second pixel may be disposed adjacent each other or may not be disposed adjacent each other along the second direction. Similarly, the second subpixel which configures the first pixel and the second subpixel which configures the second pixel may be disposed adjacent each other or may not be disposed adjacent each other along the second direction. Similarly, the third subpixel which configures the first pixel and the fourth subpixel which configures the second pixel may be disposed adjacent each other or may not be disposed adjacent each other along the second direction.

In the working example 5, the third subpixel is formed as a subpixel for displaying blue. This is because the visual sensitivity of blue is approximately ⅙ that of the green and, even if the number of subpixels for displaying blue is reduced to one half in the pixel groups, no significant problem occurs.

The signal processing section 20

(1) determines a first subpixel output signal to the first pixel $Px_1$ based at least on a first subpixel input signal to the first pixel $Px_1$ and outputs the determined first subpixel output signal to the first subpixel R of the first pixel $Px_1$;

(2) determines a second subpixel output signal to the first pixel $Px_1$ based at least on a second subpixel input signal to the first pixel $Px_1$ and outputs the determined second subpixel output signal to the second subpixel G of the first pixel $Px_1$;

(3) determines a first subpixel output signal to the second pixel $Px_2$ based at least on a first subpixel input signal to the second pixel $Px_2$ and outputs the determined first subpixel output signal to the first subpixel R of the second pixel $Px_2$; and (4) determines a second subpixel output signal to the second pixel $Px_2$ based at least on a second subpixel input signal to the second pixel $Px_2$ and outputs the determined second subpixel output signal to the second subpixel G of the second pixel $Px_2$.

Here in the working example 5, regarding the first pixel $Px_{(p,q)-1}$ which configures the (p,q)th pixel group $PG_{(p,q)}$ where $1 \le p \le P$ and $1 \le q \le Q$, the signal processing section 20 receives a first subpixel input signal having a signal value of $x_{1-(p,q)-1}$, and a second subpixel input signal having a signal value of $x_{2-(p,q)-1}$, and a third subpixel input signal having a signal value of $x_{3-(p,q)-1}$, inputted thereto, and regarding the second pixel $Px_{(p,q)-2}$ which configures the (p,q)th pixel group $PG_{(p,q)}$, the signal processing section 20 receives a first subpixel input signal having a signal value of $x_{1-(p,q)-2}$, a second subpixel input signal having a signal value of $x_{2-(p,q)-2}$, and a third subpixel input signal having a signal value of $x_{3-(p,q)-2}$, inputted thereto.

Further, in the working example 5, with regard to the first pixel $Px_{(p,q)-1}$ which configures the (p,q)th pixel group $PG_{(p,q)}$, the signal processing section 20 outputs a first subpixel output signal having a signal value $X_{1-(p,q)-1}$ for determining a display gradation of the first subpixel R, a second subpixel output signal having a signal value $X_{2-(p,q)-1}$ for determining a display gradation of the second subpixel G, and a third subpixel output signal having a signal value $X_{3-(p,q)-1}$ for determining a display gradation of the third subpixel B.

Further, with regard to the second pixel $Px_{(p,q)-2}$ which configures the (p,q)th pixel group $PG_{(p,q)}$, the signal processing section 20 outputs a first subpixel output signal having a signal value $X_{1-(p,q)-2}$ for determining a display gradation of the first subpixel R, a second subpixel output signal having a signal value $X_{2-(p,q)-2}$ for determining a display gradation of the second subpixel G, and a fourth subpixel output signal having a signal value $X_{4-(p,q)-2}$ for determining a display gradation of the fourth subpixel W.

Further, with regard to an adjacent pixel positioned adjacent the (p,q)th second pixel, the signal processing section 20 receives a first subpixel input signal having a signal value $x_{1-(p,q')}$, a second subpixel input signal having a signal value $x_{2-(p,q')}$, and a third subpixel input signal having a signal value $x_{3-(p,q')}$ inputted thereto.

Further, in the working example 5, the signal processing section 20 determines a fourth subpixel output signal, that is, a fourth subpixel output signal value $X_{4-(p,q)-2}$ based on a fourth subpixel control second signal, that is, a fourth subpixel control second signal value $SG_{2-(p,q)}$ to the second pixel $Px_{(p,q)-2}$ which is the (p,q)th, where p=1, 2, . . . , P and q=2, 3, . . . , Q as counted along the second direction and a fourth subpixel control first signal, that is, a fourth subpixel control first signal value $SG_{1-(p,q)}$ to an adjacent pixel positioned adjacent the second pixel $Px_{(p,q)-2}$. Then, the signal processing section 20 outputs the determined fourth subpixel output signal to the fourth subpixel of the (p,q)th second pixel. Here, the fourth subpixel control second signal, that is, the fourth subpixel control second signal value $SG_{2-(p,q)}$ is determined from the first subpixel input signal, that is, the first subpixel input signal value $x_{1-(p,q)-2}$, second subpixel input signal, that is, second subpixel input signal value $x_{2-(p,q)-2}$, and third subpixel input signal, that is, third subpixel input signal value $x_{3-(p,q)-2}$. Further, the fourth subpixel control first signal, that is, the fourth subpixel control first signal value $SG_{1-(p,q)}$ is determined from the first subpixel input signal, that is, the first subpixel input signal value $x_{1-(p,q')}$, second subpixel input signal, that is, second subpixel input signal value $x_{2-(p,q')}$ and third subpixel input signal, that is, third subpixel input signal value $x_{3-(p,q')}$ to the adjacent pixel positioned adjacent the (p,q)th second pixel along the second direction.

Further, the signal processing section 20 determines a third subpixel output signal, that is, a third subpixel output signal value $X_{3-(p,q)-1}$, based at least on the third subpixel input signal, that is, the third subpixel input signal value $x_{3-(p,q)-2}$ to the (p,q)th second pixel $Px_{(p,q)-2}$ and the third subpixel input signal, that is, the third subpixel input signal value $x_{3-(p,q)-1}$ to the (p,q)th first pixel.

It is to be noted that, in the working example 5, the adjacent pixel adjacent the (p,q)th second pixel is represented as the (p,q−1)th pixel. This similarly applies also to the other working examples hereinafter described. However, the adjacent pixel is not limited to this, but may be the (p,q+1)th pixel or may be both of the (p,q−1)th pixel and the (p,q+1)th pixel.

In the working example 5, the 2Ath mode is adopted. In particular, the fourth subpixel control second signal value $SG_{2-(p,q)}$ of the (p,q)th second pixel $Px_{(p,q)-2}$ is obtained from $Min_{(p,q)-2}$. Further, the fourth subpixel control first signal value $SG_{1-(p,q)}$ of the adjacent pixel positioned adjacent the (p,q)th second pixel $Px_{(p,q)-2}$ is obtained from $Min_{(p,q')}$.

In particular, the fourth subpixel control second signal value $SG_{2-(p,q)}$ and the fourth subpixel control first signal value $SG_{1-(p,q)}$ are calculated from expressions (1-1-A') and (1-1-B') given below, respectively. However, in the working example 5, $c_{11}=1$. Further, the control signal value, that is, third subpixel control signal value $SG_{3-(p,q)}$ is calculated from an expression (1-1-C') given below. It is to be noted that the value to be used as, or the expression to be used for calculation of, each of the fourth subpixel control second signal value $SG_{2-(p,q)}$ and the fourth subpixel control first signal value $SG_{1-(p,q)}$ may be determined suitably by producing a prototype of the image display apparatus 10 or the image display apparatus assembly and carrying out evaluation of an image obtained on the prototype and observed, for example, by an image observer.

$$SG_{2-(p,q)}=Min_{(p,q)-2} \tag{1-1-A'}$$

$$SG_{1-(p,q)}=Min_{(p,q')} \tag{1-1-B'}$$

$$SG_{3-(p,q)}=Min_{(p,q)-1} \tag{1-1-C'}$$

Further, the fourth subpixel output signal value $X_{4-(p,q)-2}$ is calculated by $$X_{4-(p,q)-2}=(SG_{2-(p,q)}+SG_{1-(p,q)})/2 \tag{4-A'}$$

In other words, the fourth subpixel output signal value $X_{4-(p,q)-2}$ is calculated by arithmetic mean.

Further, the first subpixel output signal, that is, the first subpixel output signal value $X_{1-(p,q)-2}$, of the (p,q)th second pixel $Px_{(p,q)-2}$ is calculated based at least on the first subpixel input signal, that is, the first subpixel input signal value $x_{1-(p,q)-2}$, $Max_{(p,q)-2}$, $Min_{(p,q)-2}$ and fourth subpixel control second signal, that is, fourth subpixel control second signal value $SG_{2-(p,q)}$. Further, the second subpixel output signal, that is, the second subpixel output signal value $X_{2-(p,q)-2}$, is calculated based at least on the second subpixel input signal, that is, the second subpixel input signal value $x_{2-(p,q)-2}$ $Max_{(p,q)-2}$ $Min_{(p,q)-2}$ and fourth subpixel control second signal, that is, fourth subpixel control second signal value $SG_{2-(p,q)}$. Here, in the working example 5, the first subpixel output signal value $X_{1-(p,q)-2}$ is calculated particularly based on $$[x_{1-(p,q)-2}, Max_{(p,q)-2}, Min_{(p,q)-2}, SG_{2-(p,q)}; \chi]$$

and the second subpixel output signal value $X_{2-(p,q)-2}$ is calculated based on $$[x_{2-(p,q)-2}, Max_{(p,q)-2}, Min_{(p,q)-2}, SG_{2-(p,q)}; \chi]$$

Further, the first subpixel output signal, that is, the first subpixel output signal value $X_{1-(p,q)-1}$, of the (p,q)th first pixel $Px_{(p,q)-1}$ is calculated based at least on the first subpixel input signal, that is, the first subpixel input signal value $x_{1-(p,q)-1}$, $Max_{(p,q)-1}$, $Min_{(p,q)-1}$ and third subpixel control signal, that is, signal value $SG_{3-(p,q)}$. Further, the second subpixel output signal, that is, the second subpixel output signal value $X_{2-(p,q)-1}$, is calculated based at least on the second subpixel input signal, that is, the second subpixel input signal value $x_{2-(p,q)-1}$, $Max_{(p,q)-1}$, $Min_{(p,q)-1}$ and third subpixel control signal, that is, signal value $SG_{3-(p,q)}$. Here, in the working example 5, the first subpixel output signal value $X_{1-(p,q)-1}$ is calculated particularly based on $$[x_{1-(p,q)-1}, Max_{(p,q)-1}, Min_{(p,q)-1}, SG_{3-(p,q)}; \chi]$$

and the second subpixel output signal value $X_{2-(p,q)-1}$ is calculated based on $$[x_{2-(p,q)-1}, Max_{(p,q)-1}, Min_{(p,q)-1}, SG_{3-(p,q)}; \chi]$$

It is assumed that, for example, regarding the second pixel $Px_{(p,q)-2}$ of the pixel group $PG_{(p,q)}$, input signals of input signal values having a relationship to each other given below are inputted to the signal processing section 20 and, regarding the adjacent pixel, input signals of input signal values having a relationship to each other given below are inputted to the signal processing section 20.

$$x_{3-(p,q)-2}<x_{1-(p,q)-2}<x_{2-(p,q)-2} \tag{51-A}$$

$$x_{2-(p,q')}<x_{3-(p,q')}<x_{1-(p,q')} \tag{51-B}$$

in this instance, $$Min_{(p,q)-2}=x_{3-(p,q)-2} \tag{52-A}$$

$$Min_{(p,q')}=x_{2-(p,q')} \tag{52-B}$$

Then, the fourth subpixel control second signal value $SG_{2-(p,q)}$ is determined based on $Min_{(p,q)-2}$, and the fourth subpixel control first signal value $SG_{1-(p,q)}$ is determined based on $Min_{(p,q')}$. In particular, they are calculated by expressions (53-A) and (53-B) given below, respectively.

$$\begin{aligned} SG_{2-(p,q)} &= Min_{(p,q)-2} \\ &= x_{3-(p,q)-2} \end{aligned} \tag{53-A}$$

$$\begin{aligned} SG_{1-(p,q)} &= Min_{(p,q')} \\ &= x_{2-(p,q')} \end{aligned} \tag{53-B}$$

-continued

Further, $$X_{4-(p,q)-2} = (SG_{2-(p,q)} + SG_{1-(p,q)})/2 = (x_{3-(p,q)-2} + x_{2-(p,q')})/2 \quad (54)$$

Incidentally, as regards the luminance based on the input signal value of the input signal and the output signal value of the output signal, in order to satisfy such a demand as to keep the chromaticity against variation, it is necessary to satisfy the following relationships. It is to be noted that, while the fourth subpixel output signal value $X_{4-(p,q)-2}$ is multiplied by $\chi$, this is because the fourth subpixel is as bright as $\chi$ times that of the other subpixels.

$$x_{1-(p,q)-2}/\mathrm{Max}_{(p,q)-2}=(X_{1-(p,q)-2}+\chi\cdot SG_{2-(p,q)})/(\mathrm{Max}_{(p,q)-2}+\chi\cdot SG_{2-(p,q)}) \quad (55\text{-A})$$

$$x_{2-(p,q)-2}/\mathrm{Max}_{(p,q)-2}=(X_{2-(p,q)-2}+\chi\cdot SG_{2-(p,q)})/(\mathrm{Max}_{(p,q)-2}+\chi\cdot SG_{2-(p,q)}) \quad (55\text{-B})$$

$$x_{1-(p,q)-1}/\mathrm{Max}_{(p,q)-1}=(X_{1-(p,q)-1}+\chi\cdot SG_{3-(p,q)})/(\mathrm{Max}_{(p,q)-1}+\chi\cdot SG_{3-(p,q)}) \quad (55\text{-C})$$

$$x_{2-(p,q)-1}/\mathrm{Max}_{(p,q)-1}=(X_{2-(p,q)-1}+\chi\cdot SG_{3-(p,q)})/(\mathrm{Max}_{(p,q)-1}+\chi\cdot SG_{3-(p,q)}) \quad (55\text{-D})$$

$$x_{3-(p,q)-1}/\mathrm{Max}_{(p,q)-1}=(X'_{3-(p,q)-1}+\chi\cdot SG_{3-(p,q)})/(\mathrm{Max}_{(p,q)-1}+\chi\cdot SG_{3-(p,q)}) \quad (55\text{-E})$$

$$x_{3-(p,q)-2}/\mathrm{Max}_{(p,q)-2}=(X'_{3-(p,q)-2}+\chi\cdot SG_{2-(p,q)})/(\mathrm{Max}_{(p,q)-2}+\chi\cdot SG_{2-(p,q)}) \quad (55\text{-F})$$

Accordingly, the output signal values are calculated in the following manner from the expressions (55-A) to (55-F).

$$X_{1-(p,q)-2}=\{x_{1-(p,q)-2}\cdot(\mathrm{Max}_{(p,q)-2}+\chi\cdot SG_{2-(p,q)})\}/\mathrm{Max}_{(p,q)-2}-\chi\cdot SG_{2-(p,q)} \quad (56\text{-A}),$$

$$X_{2-(p,q)-2}=\{x_{2-(p,q)-2}\cdot(\mathrm{Max}_{(p,q)-2}+\chi\cdot SG_{2-(p,q)})\}/\mathrm{Max}_{(p,q)-2}-\chi\cdot SG_{2-(p,q)} \quad (56\text{-B}).$$

$$X_{1-(p,q)-1}=\{x_{1-(p,q)-1}\cdot(\mathrm{Max}_{(p,q)-1}+\chi\cdot SG_{3-(p,q)})\}/\mathrm{Max}_{(p,q)-1}-\chi\cdot SG_{3-(p,q)} \quad (56\text{-C})$$

$$X_{2-(p,q)-1}=\{x_{2-(p,q)-1}\cdot(\mathrm{Max}_{(p,q)-1}+\chi\cdot SG_{3-(p,q)})\}/\mathrm{Max}_{(p,q)-1}-\chi\cdot SG_{3-(p,q)} \quad (56\text{-D})$$

$$X_{3-(p,q)-1}=(X'_{3-(p,q)-1}+X'_{3-(p,q)-2})/2 \quad (56\text{-E})$$

where $$X'_{3-(p,q)-1}=\{x_{3-(p,q)-1}\cdot(\mathrm{Max}_{(p,q)-1}+\chi\cdot SG_{3-(p,q)})\}/\mathrm{Max}_{(p,q)-1}-\chi\cdot SG_{3-(p,q)} \quad (56\text{-a})$$

$$X'_{3-(p,q)-2}=\{x_{3-(p,q)-2}\cdot(\mathrm{Max}_{(p,q)-2}+\chi\cdot SG_{2-(p,q)})\}/\mathrm{Max}_{(p,q)-2}-\chi\cdot SG_{2-(p,q)} \quad (56\text{-b})$$

In the following, a method of determining the output signal valves $X_{1-(p,g)-1}$, $X_{2-(p,g)-1}$, $X_{3-(p,g)-1}$, $X_{1-(p,g)-2}$, $X_{2-(p,g)-2}$ and $X_{4-(p,g)-2}$ in the (p,q) pixel group $PG_{(p,q)}$ is described. It is to be noted that the process described below is carried out such that the ratio between the luminance of the first primary color displayed by the (first subpixel+fourth subpixel) and the luminance of the second primary color displayed by the (second subpixel+fourth subpixel) may be maintained. Besides, the process is carried out such that the color tone is kept or maintained as far as possible. Furthermore, the process is carried out such that the gradation-luminance characteristic, that is, the gamma characteristic or $\gamma$ characteristic is kept or maintained.

Step 500

First, the signal processing section 20 calculates a fourth subpixel control second signal value $SG_{2-(p,q)}$, a fourth subpixel control first signal value $SG_{1-(p,q)}$ and a control signal value or third subpixel control signal value $SG_{3-(p,q)}$ in accordance with expressions (1-1-A'), (1-1-B') and (1-1-C'), respectively, based on subpixel input signal values of a pixel group. This process is carried out for all pixel groups. Further, the signal value $X_{4-(p,q)-2}$ is calculated in accordance with an expression (4-A').

$$SG_{2-(p,q)}=\mathrm{Min}_{(p,q)-2} \quad (1\text{-}1\text{-A}')$$

$$SG_{1-(p,q)}=\mathrm{Min}_{(p,q')} \quad (1\text{-}1\text{-B}')$$

$$SG_{3-(p,q)}=\mathrm{Min}_{(p,q)-1} \quad (1\text{-}1\text{-C}')$$

$$X_{4-(p,q)-2}=(SG_{2-(p,q)}+SG_{1-(p,q)})/2 \quad (4\text{-A}')$$

Step 510

Then, the signal processing section 20 calculates output signal values $X_{1-(p,q)-2}$, $X_{2-(p,q)-2}$, $X_{1-(p,q)-1}$, $X_{2-(p,q)-1}$ and $X_{3-(p,q)-1}$ by the expressions (56-A) to (56-E), 56(a) and 56(b) from the fourth subpixel output signal value $X_{4-(p,q)-2}$ determined with regard to the pixel group. This operation is carried out for all of the P×Q pixel groups.

It is to be noted that, since the ratios of the output signal values at the second pixel in each pixel group $X_{1-(p,q)-2}:X_{2-(p,q-2}$ $X_{1-(p,q)-1}:X_{2-(p,q)-1}:X_{3-(p,q)-1}$ are a little different from the ratios of the input signal values $x_{1-(p,q)-2}:x_{2-(p,q)-2}$ $x_{1-(p,q)-1}:x_{2-(p,q)-1}:x_{3-(p,q)-1}$ if each pixel is viewed solely, then some difference occurs with the color tone among the pixels with respect to the input signal. However, when the pixels are observed as a pixel group, no problem occurs with the color tone of the pixel group. This similarly applies also to the description given below.

In the driving method for an image display apparatus or the driving method for an image display apparatus assembly of the working example 5, the signal processing section 20 determines a fourth subpixel output signal based on a fourth subpixel control second signal value $SG_{2-(p,q)}$ and a fourth subpixel control first signal value $SG_{1-(p,q)}$ determined from a first subpixel input signal, a second subpixel input signal and a third subpixel input signal and outputs the determined fourth subpixel output signal. Here, since the fourth subpixel output signal is determined based on input signals to the first pixel $Px_1$ and the second pixel $Px_2$ which are positioned adjacent each other, optimization of the output signal to the fourth subpixel is achieved. Besides, since one fourth subpixel is disposed also for a pixel group which is configured at least from the first pixel $Px_1$ and the second pixel $Px_2$, reduction of the area of the aperture region of the subpixels can be suppressed. As a result, increase of the luminance can be achieved with certainty and improvement in display quality can be achieved.

Working Example 6

The working example 6 is a modification to the working example 5 and relates to the 2Bth mode.

In the working example 6, where $\chi$ is a constant which relies upon the image display apparatus 10, the signal processing section 20 determines a maximum value $V_{max}(S)$ of the brightness where the saturation S is a variable in an HSV color space expanded by addition of a fourth color, and the signal processing section 20

(a) calculates a saturation S and a brightness V(S) regarding a plurality of pixels based on subpixel input signal values to the plural pixels, (b) calculates an expansion coefficient $\alpha_0$ based at least on one of the values of $V_{max}(S)/V(S)$ calculated with regard to the plural pixels, and (c) calculates a first subpixel output signal value $X_{1-(p,q)-2}$ of the (p,q)th second pixel $Px_2$ based on the first subpixel input signal value $X_{1-(p,q)-2}$, expansion coefficient $\alpha_0$ and constant $\chi$, calculates a second subpixel output signal value $X_{2-(p,q)-2}$ of the second pixel $Px_2$ based on the second subpixel input signal value $X_{2-(p,q)-2}$, expansion coefficient $\alpha_0$ and constant $\chi$, and calculates a fourth subpixel output signal value $X_{4-(p,q)-2}$ of the second pixel $Px_2$ based on the fourth subpixel control second signal value $SG_{2-(p,q)}$, fourth subpixel control first signal value $SG_{1-(p,q)}$, expansion coefficient $\alpha_0$ and constant $\chi$. The expansion coefficient $\alpha_0$ is calculated for every one image display frame. It is to be noted that the fourth subpixel control second signal value $SG_{2-(p,q)}$ and the fourth subpixel control first signal value $SG_{1-(p,q)}$ are calculated in accordance with expressions (2-1-A') and (2-1-B'), respectively. Further, the control signal value or third subpixel control signal value $SG_{3-(p,q)}$ is calculated from the following expression (2-1-C').

$$SG_{2-(p,q)}=\mathrm{Min}_{(p,q)-2})\cdot\alpha_0 \quad \text{(2-1-A').}$$

$$SG_{1-(p,q)}=\mathrm{Min}_{(p,q')})\cdot\alpha_0 \quad \text{(2-1-B').}$$

$$SG_{3-(p,q)}=\mathrm{Min}_{(p,q)-1})\cdot\alpha_0 \quad \text{(2-1-C')}$$

Further, where the saturation and the brightness of the (p,q)th first pixel $Px_1$ are represented by $S_{(p,q)-1}$ and $V_{(p,q)-1}$, respectively, and the saturation and the brightness of the (p,q)th second pixel $Px_2$ are represented by $S_{(p,q)-2}$ and $V_{(p,q)-2}$, respectively, they are represented by the following expressions (61-A) to (61-D), respectively.

$$S_{(p,q)-1}=(\mathrm{Max}_{(p,q)-1}-\mathrm{Min}_{(p,q)-1})/\mathrm{Max}_{(p,q)-1} \quad \text{(61-A).}$$

$$V_{(p,q)-1}=\mathrm{Max}_{(p,q)-1} \quad \text{(61-B).}$$

$$S_{(p,q)-2}=(\mathrm{Max}_{(p,q)-2}-\mathrm{Min}_{(p,q)-2})/\mathrm{Max}_{(p,q)-2} \quad \text{(61-C)}$$

$$V_{(p,q)-2}=\mathrm{Max}_{(p,q)-2} \quad \text{(61-D)}$$

In the working example 6, the fourth subpixel output signal value $X_{4-(p,q)-2}$ is calculated from an expression (4-A") given below. In particular, the fourth subpixel output signal value $X_{4-(p,q)-2}$ is calculated by arithmetic mean. It is to be noted that, while, in the expression (4-A"), the right side includes division by $\chi$, the expression is not limited to this.

$$X_{4-(p,q)-2}=(SG_{2-(p,q)}+SG_{1-(p,q)})/(2\chi) \quad \text{(4-A")}$$

Meanwhile, the output signal values $X_{1-(p,q)-2}$, $X_{2-(p,q)-2}$, $X_{1-(p,q)-1}$, $X_{2-(p,q)-1}$ and $X_{3-(p,q)-1}$ of the first subpixel R, second subpixel G and third subpixel B are calculated from expressions (5-a) to (5-f) and (6-a') given below.

$$X_{1-(p,q)-1}=\alpha_0\cdot x_{1-(p,q)-1}-\chi\cdot SG_{3-(p,q)} \quad \text{(5-a)}$$

$$X_{2-(p,q)-1}=\alpha_0\cdot x_{2-(p,q)-1}-\chi\cdot SG_{3-(p,q)} \quad \text{(5-b)}$$

$$X'_{3-(p,q)-1}=\alpha_0\cdot x_{3-(p,q)-1}-\chi\cdot SG_{3-(p,q)} \quad \text{(5-c).}$$

$$X_{1-(p,q)-2}=\alpha_0\cdot x_{1-(p,q)-2}-\chi\cdot SG_{2-(p,q)} \quad \text{(5-d)}$$

$$X_{2-(p,q)-2}=\alpha_0\cdot x_{2-(p,q)-2}-\chi\cdot SG_{2-(p,q)} \quad \text{(5-e)}$$

$$X'_{3-(p,q)-2}=\alpha_0\cdot x_{3-(p,q)-2}-\chi\cdot SG_{2-(p,q)} \quad \text{(5-f)}$$

$$X_{3-(p,q)-1}=(X'_{3-(p,q)-1}+X'_{3-(p,q)-2})/2 \quad \text{(6-a')}$$

Also in the working example 6, a maximum value $V_{max}(S)$ of the brightness where the saturation S in an HSV color space expanded by addition of a fourth color (white) is variable is stored into the signal processing section 20 or is calculated every time by the signal processing section 20 similarly as in the working example 2. In other words, by addition of a fourth color (white), the dynamic range of the brightness in the HSV color space is expanded.

In the following, a method of calculating the output signal values $X_{1-(p,q)-2}$, $X_{2-(p,q)-2}$, $X_{1-(p,q)-1}$, $X_{2-(p,q)-1}$ and $X_{3-(p,q)-1}$ of the (p,q)th pixel group $PG_{(p,q)}$, that is, an expansion process, is described. It is to be noted that the following process is carried out such that the gradation-luminance characteristic, that is, the gamma characteristic or $\gamma$ characteristic, is maintained. Further, in the following process, the process described below is carried out so as to keep the ratio on luminance as far as possible over all of the first and second pixels, that is, over all pixel groups. Besides, the process is carried out so as to keep or maintain the color tone as far as possible.

Step 600

First, the signal processing section 20 calculates the saturation S and the brightness V(S) of a plurality of pixel groups based on subpixel input signal values to a plurality of pixels. In particular, the signal processing section 20 calculates the saturation $S_{(p,q)-1}$ and $S_{(p,q)-2}$ and the brightness $V_{(p,q)-1}$ and $V_{(p,q)-2}$ from expressions substantially same as the expressions (21-A), (21-B), (21-C) and (21-D), that is, from expressions obtained by replacing $\mathrm{Max}_{(p,q)}$ and $\mathrm{Min}_{(p,q)}$ with $\mathrm{Max}_{(p,q)-2}$ and $\mathrm{Min}_{(p,q)-2}$, respectively, in the expressions (21-A), (21-B), (21-C) and (21-D), based on the input signal value $x_{1-(p,q)-2}$ of the first subpixel input signal, the input signal value $x_{2-(p,q)-2}$ of the second pixel input signal and the input signal value $x_{3-(p,q)-2}$ of the third subpixel input signal to the (p,q)th second pixel $Px_{(p,q)-2}$ as well as the input signal value $x_{3-(p,q')}$ of the third subpixel input signal to the adjacent pixel. This process is carried out for all pixel groups.

Step 610

Then, the signal processing section 20 calculates an expansion coefficient $\alpha_0$ based at least on one of values of $V_{max}(S)/V(S)$ calculated with regard to a plurality of pixel groups.

In particular, in the working example 6, the lowest value or minimum value $\alpha_{min}$ among the values of $V_{max}(S)/V(S)$ calculated with regard to all pixels, that is, all of the $P_0\times Q$ pixels, is determined as an expansion coefficient $\alpha_0$. In particular, the value of $\alpha_{(p,q)}=V_{max}(S)/V_{(p,q)}(S)$ is calculated with regard to all pixel groups, that is, all of the $P_0\times Q$ pixel groups, and a minimum value of $\alpha_{(p,q)}$ is determined as $\alpha_{min}$=expansion coefficient $\alpha_0$.

Step 620

Then, the signal processing section 20 calculates the fourth subpixel output signal value $X_{4-(p,q)-2}$ of the (p,q)th pixel group $PG_{(p,q)}$ from the expression (2-1-A'), (2-1-B') and (4-A") given hereinabove. It is to be noted that $X_{4-(p,q)-2}$ is calculated with regard to all of the P×Q pixel groups $PG_{(p,q)}$. The step 610 and the step 620 may be executed simultaneously.

Step 630

Then, the signal processing section 20 calculates the first subpixel output signal value $X_{1-(p,q)-2}$ of the (p,q)th second pixel $Px_{(p,q)-2}$ from the expressions (5-a) to (5-f) and (6-a') based on the input signal value $x_{1-(p,q)-2}$, expansion coefficient $\alpha_0$ and constant $\chi$. Further, the signal processing section 20 calculates the second subpixel output signal value $X_{2-(p,q)-2}$ based on the input signal value $x_{2-(p,q)-2}$, expansion coefficient $\alpha_0$ and constant $\chi$. Furthermore, the signal processing section 20 calculates the first subpixel output signal value $X_{1-(p,q)-1}$ of the (p,q)th first pixel $Px_{(p,q)-1}$ based on the input signal value $x_{1-(p,q)-1}$, expansion coefficient $\alpha_0$ and constant $\chi$. Further, the signal processing section 20 calculates the second subpixel output signal value $X_{2-(p,q)-1}$ based on the input signal value $x_{2-(p,q)-1}$, expansion coefficient $\alpha_0$ and constant $\chi$, and calculates the third subpixel output signal value $X_{3-(p,q)-1}$ based on the input signal values $x_{3-(p,q)-1}$ and $x_{3-(p,q)-2}$, expansion coefficient $\alpha_0$ and constant $\chi$. It is to be noted that the step 620 and the step 630 may be executed simultaneously, or the step 620 may be executed after execution of the step 630.

Also in the working example 6, what is significant resides in that the luminance of the first subpixel R, second subpixel G and third subpixel B is expanded by the expansion coefficient $\alpha_0$ as indicated by the expressions (5-a) to (5-f) and (6-a'). In the case where the luminance of the first subpixel R and second subpixel G is expanded in this manner, not only the luminance of the white displaying subpixel, that is, the fourth subpixel, increases, but also the luminance of the red displaying subpixel and the green displaying subpixel, that is, the first and second subpixels, increases. Therefore, occurrence of such a problem that darkening in color occurs can be prevented with certainty. In particular, in comparison with an alternative case in which the luminance of the first subpixel R, second subpixel G and third subpixel B is not expanded, the luminance of an entire image increases to $\alpha_0$ times. In this manner, according to the image display apparatus assembly or the driving method therefor of the working example 6, the output signal values $X_{1-(p,q)-2}$, $X_{2-(p,q)-2}$, $X_{4-(p,q)-2}$, $X_{1-(p,q)-1}$, $X_{2-(p,q)-1}$ and $X_{3-(p,q)-1}$ of the (p,q)th pixel group $PG_{(p,q)}$ are expanded to $\alpha_0$ times. Therefore, in order to form an image of a luminance equal to the luminance of an image which is not in an expanded state, the luminance of the planar light source apparatus 50 may be decreased based on the expansion coefficient $\alpha_0$. In particular, the luminance of the planar light source apparatus 50 may be reduced to $1/\alpha_0$ times. By this, reduction of the power consumption of the planar light source apparatus can be anticipated.

It is to be noted that, since the ratios of the output signal values of the first and second pixels in each pixel group $X_{1-(p,q)-2}:X_{2-(p,q)-2}$ $X_{1-(p,q)-1}:X_{2-(p,q)-1}:X_{3-(p,q)-1}$ are a little different from the ratios of the input signal values $x_{1-(p,q)-2}:x_{2-(p,q)-2}$ $x_{1-(p,q)-1}:x_{2-(p,q)-1}:x_{3-(p,q)-1}$ if each pixel is viewed solely, then some difference sometimes occurs with the color tone among the pixels with respect to the input signal. However, when the pixels are observed as a pixel group, no problem occurs with the color tone of the pixel group.

While the present invention has been described above in connection with preferred working examples thereof, the present invention is not limited to the working examples. The configuration and the structure of the color liquid crystal display apparatus assemblies, color liquid crystal display apparatus, planar light source apparatus, planar light source units and driving circuits described in the above examples are illustrative, and also the members, materials and so forth which configure them are illustrative and can be altered suitably.

While, in the working examples 2 and 6, a plurality of pixels, or a set of a first subpixel, a second subpixel and a third subpixel, whose saturation S and brightness V(S) should be calculated, are all of P×Q pixels or all sets of first subpixels, second subpixels and third subpixels, the number of such pixels is not limited to this. In particular, the plural pixels, or the set of a first subpixel, a second subpixel and a third subpixel, whose saturation S and brightness V(S) should be calculated, may be set, for example, to one for every four or one for every eight.

While, in the working example 2 or the working example 6, the expansion coefficient $\alpha_0$ is calculated based on a first subpixel input signal, a second subpixel input signal and a third subpixel input signal, it may be calculated alternatively based on one of the first, second and third input signals or on one of subpixel input signals from within a set of first, second and third subpixels or else on one of first, second and third pixel input signals. In particular, as an input signal value of one of such input signals, for example, an input signal value $x_{2-(p,q)}$ or $x_{2-(p,q)-2}$ for green may be used. Then, the output signal value may be calculated from the calculated expansion coefficient $\alpha_0$ in a similar manner as in the working examples. It is to be noted that, in this instance, without using the saturation $S_{(p,q)}$ or $S_{(p,q)-2}$ in the expression (21-C) and so forth, "1" may be used as the value of the saturation $S_{(p,q)}$ or $S_{(p,q)-2}$. In other words, the value of $Min_{(p,q)}$ or $Min_{(p,q)-2}$ in the expression (21-C) and so forth is set to "0." Or else, the expansion coefficient $\alpha_0$ may be calculated based on input signal values of two different ones of first, second and third subpixel input signals, or on two different input signals from among subpixel input signals for a set of first, second and third subpixels or else on two different input signals from among the first, second and third subpixel input signals. More particularly, for example, the input signal value $x_{1-(p,q)-2}$ for red and the input signal value $x_{2-(p,q)-2}$ for green can be used. Then, an output signal value may be calculated from the calculated expansion coefficient $\alpha_0$ in a similar manner as in the working example. It is to be noted that, in this instance, without using $S_{(p,q)}$, $V_{(p,q)}$, $S_{(p,q)-2}$ and $V_{(p,q)-2}$ of the expressions (21-C), (21-D) and so forth, for example, as a value of $S_{(p,q)}$, in the case where $x_{1-(p,q)} \geq x_{2-(p,q)}$, $$S_{(p,q)}=(x_{1-(p,q)}-x_{2-(p,q)})/x_{2-(p,q)}$$

$$V_{(p,q)}=x_{1-(p,q)}$$

may be used, but in the case where $x_{1-(p,q)} < x_{2-(p,q)}$ $$S_{(p,q)}=(x_{2-(p,q)}-x_{1-(p,q)})/x_{2-(p,q)}$$

$$V_{(p,q)}=x_{2-(p,q)}$$

may be used. For example, in the case where a monochromatic image is to be displayed on a color image display apparatus, it is sufficient if such an expansion process as given by the expressions above is carried out.

Or else, also it is possible to adopt such a form that an expansion process is carried out within a range within which picture quality variation cannot be perceived by an observer. In particular, disorder in gradation is liable to stand out with regard to yellow having high visibility. Accordingly, it is preferable to carry out an expansion process so that an expanded output signal from an input signal having a particular hue such as, for example, yellow may not exceed $V_{max}$ with certainty. Or, in the case where the rate of input signals having a particular hue such as, for example, yellow is low, also it is possible to set the expansion coefficient $\alpha_0$ to a value higher than the minimum value.

Figure 19:
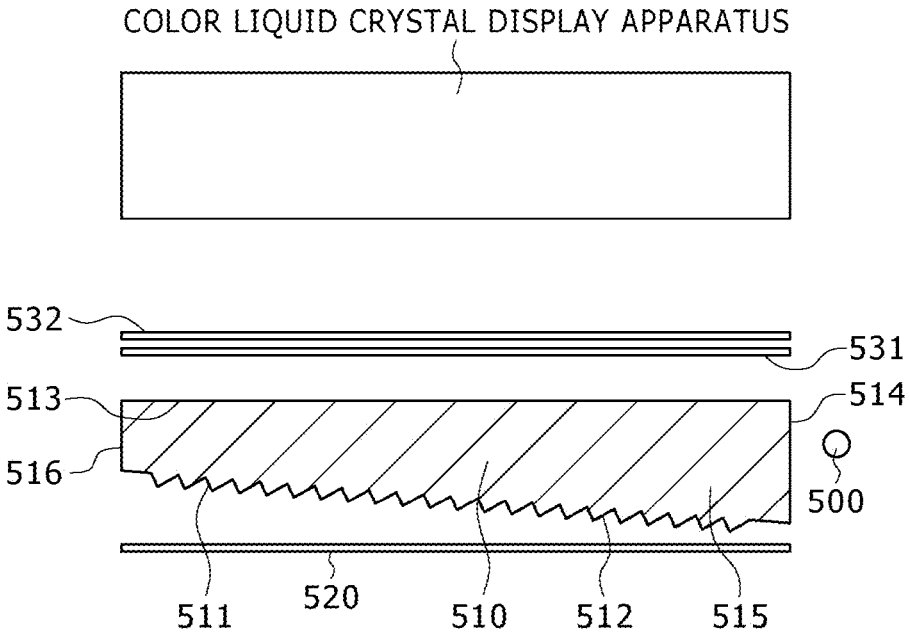
FIG. 19 is a schematic view of a planar light source apparatus of the edge light type or side light type.

Also it is possible to adopt a planar light source apparatus of the edge light type, that is, of the side light type. In this instance, as seen in FIG. 19, a light guide plate 510 formed, for example, from a polycarbonate resin has a first face 511 which is a bottom face, a second face 513 which is a top face opposing to the first face 511, a first side face 514, a second side face 515, a third side face 516 opposing to the first side face 514, and a fourth side face opposing to the second side face 515. A more particular shape of the light guide plate 510 is a generally wedge-shaped truncated quadrangular pyramid shape, and two opposing side faces of the truncated quadrangular pyramid correspond to the first face 511 and the second face 513 while the bottom face of the truncated quadrangular pyramid corresponds to the first side face 514. Further, concave-convex portions 512 are provided on a surface portion of the first face 511. The cross sectional shape of continuous concave-convex portions when the light guide plate 510 is cut along a virtual plane perpendicular to the first face 511 in a first primary color light incoming direction to the light guide plate 510 is a triangular shape. In other words, the concave-convex portions 512 provided on the surface portion of the first face 511 have a prism shape. The second face 513 of the light guide plate 510 may be smooth, that is, may be formed as a mirror face, or may have blast embosses which have a light diffusing effect, that is, may be formed as a fine concave-convex face. A light reflecting member 520 is disposed in an opposing relationship to the first face 511 of the light guide plate 510. Further, an image display panel such as, for example, a color liquid crystal display panel, is disposed in an opposing relationship to the second face 513 of the light guide plate 510. Furthermore, a light diffusing sheet 531 and a prism sheet 532 are disposed between the image display panel and the second face 513 of the light guide plate 510. First primary color light emitted from a light source 500 advances into the light guide plate 510 through the first side face 514, which is a face corresponding to the bottom face of the truncated quadrangular pyramid, of the light guide plate 510. Then, the first primary color light comes to and is scattered by the concave-convex portions 512 of the first face 511 and goes out from the first face 511, whereafter it is reflected by the light reflecting member 520 and advances into the first face 511 again. Thereafter, the first primary color light goes out from the second face 513, passes through the light diffusing sheet 531 and the prism sheet 532 and irradiates the image display panel, for example, of the working example 1.

As the light source, a fluorescent lamp or a semiconductor laser which emits blue light as the first primary color light may be adopted in place of light emitting diodes. In this instance, the wavelength $\lambda_1$ of the first primary color light which corresponds to the first primary color, which is blue, to be emitted from the fluorescent lamp or the semiconductor laser may be, for example, 450 nm. Meanwhile, green light emitting particles which correspond to second primary color light emitting particles which are excited by the fluorescent lamp or the semiconductor laser may be, for example, green light emitting phosphor particles made of, for example, $SrGa_2S_4$:Eu. Further, red light emitting particles which correspond to third primary color light emitting particles may be red light emitting phosphor particles made of, for example, CaS:Eu. Or else, where a semiconductor laser is used, the wavelength $\lambda_1$ of the first primary color light which corresponds to the first primary color, that is, blue, which is emitted by the semiconductor laser, may be, for example, 457 nm. In this instance, green light emitting particles which correspond to second primary color light emitting particles which are excited by the semiconductor laser may be green light emitting phosphor particles made of, for example, $SrGs_2S_4$:Eu, and red light emitting particles which correspond to third primary color light emitting particles may be red color light emitting phosphor particles made of, for example, CaS:Eu. Or else, it is possible to use, as the light source of the planar light source apparatus, a fluorescent lamp (CCFL) of the cold cathode type, a fluorescent lamp (HCFL) of the hot cathode type or a fluorescent lamp of the external electrode type (EEFL, External Electrode Fluorescent Lamp).

If the relationship between the fourth subpixel control second signal value $SG_{2-(p,q)}$ and the fourth subpixel control first signal value $SG_{1-(p,q)}$ is deviated from a certain condition, then the adjacent pixel may be changed in each working example. In particular, where the adjacent pixel is the (p,q−1)th pixel, it may be changed to the (p,q+1)th pixel or may be changed to the (p,q−1)th pixel and the (p,q+1)th pixel.

Or else, if the relationship between the fourth subpixel control second signal value $SG_{2-(p,q)}$ and the fourth subpixel control first signal value $SG_{1-(p,q)}$ is deviated from a certain condition, then such an operation that the processes in each working example are not carried out may be used. For example, where such a process as $$X_{4-(p,q)-2}=(SG_{2-(p,q)}+SG_{1-(p,q)})/2$$

is to be carried out, if the value of $|SG_{2-(p,q)}+SG_{1-(p,q)}|$ becomes equal to or higher or lower than a predetermined value $\Delta X_1$, a value based only on $SG_{2-(p,q)}$ is adopted or a value based only on $SG_{1-(p,q)}$ may be adopted as the value of $X_{4-(p,q)-2}$ to apply each working example. Or, if the value of $SG_{2-(p,q)}+SG_{1-(p,q)}$ becomes equal to or higher than another predetermined value $\Delta X_2$ and if the value of $SG_{2-(p,q)}+SG_{1-(p,q)}$ become equal to or lower than a further predetermined value $\Delta X_3$, such an operation as to carry out different processes from those in each working example may be executed.

Figure 18:
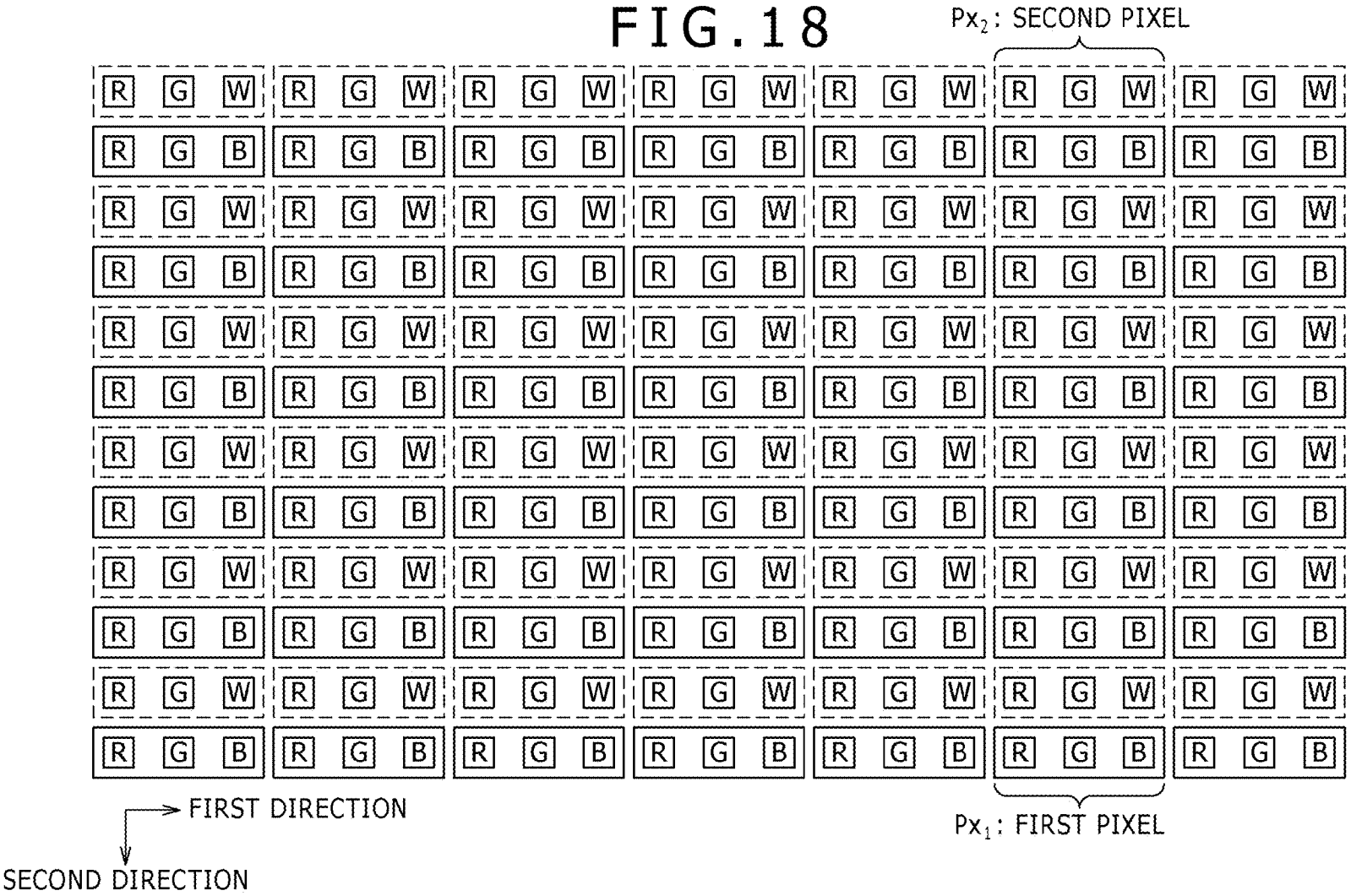

As occasion demands, the array of pixel groups described hereinabove in connection with the working example 5 or 6 may be changed in such a manner as described to execute the driving method for an image display apparatus or the driving method for an image display apparatus assembly substantially described hereinabove in connection with the working example 5 or 6. In particular, a driving method for an image display apparatus which includes an image display panel wherein totaling P×Q pixels arrayed in a two-dimensional matrix including P pixels arrayed in a first direction and Q pixels arrayed in a second direction as shown in FIG. 18 and a signal processing section may be adopted, the image display panel being configured from a plurality of first pixel columns including first pixels arrayed along the first direction and a plurality of second pixel columns disposed adjacent and alternately with the first pixel columns and including second pixels arrayed along the first direction;

the first pixel including a first subpixel for displaying a first primary color, a second subpixel for displaying a second primary color and a third subpixel for displaying a third primary color;

the second pixel including a first subpixel for displaying the first primary color, a second subpixel for displaying the second primary color and a fourth subpixel for displaying a fourth color;

the signal processing section being capable of:

calculating a first subpixel output signal to the first pixel based at least on a first subpixel input signal to the first pixel and an expansion coefficient $\alpha_0$ and outputting the first subpixel output signal to the first subpixel of the first pixel;

calculating a second subpixel output signal to the first pixel based at least on a second subpixel input signal to the first pixel and the expansion coefficient $\alpha_0$ and outputting the second subpixel output signal to the second subpixel of the first pixel;

calculating a first subpixel output signal to the second pixel based at least on a first subpixel input signal to the second pixel and the expansion coefficient $\alpha_0$ and outputting the first subpixel output signal to the first subpixel of the second pixel; and calculating a second subpixel output signal to the second pixel based at least on a second subpixel input signal to the second pixel and outputting the second subpixel output signal to the expansion coefficient $\alpha_0$ and second subpixel of the second pixel;

the driving method including the steps, further carried out by the signal processing section, of calculating a fourth subpixel output signal based on a fourth subpixel control second signal calculated from the first subpixel input signal, second subpixel input signal and third subpixel input signal to a (p,q)th, where p is 1, 2, . . . , P and q is 1, 2, . . . , Q, second pixel when the pixels are counted along the second direction and a fourth subpixel control first signal calculated from the first subpixel input signal, second subpixel input signal and third subpixel input signal to a first pixel positioned adjacent the (p,q)th second pixel along the second direction, and outputting the calculated fourth subpixel output signal to the (p,q)th second pixel; and further calculating a third subpixel output signal based at least on the third subpixel input signal to the (p,q)th second pixel and the third subpixel input signal to the first pixel adjacent the (p,q)th second pixel and outputting the calculated third subpixel output signal to the (p,q)th first pixel.

The present application contains subject matter related to that disclosed in Japanese Priority Patent Application JP 2010-017296 filed in the Japan Patent Office on Jan. 28, 2010, the entire content of which is hereby incorporated by reference.

While preferred embodiments of the present invention have been described using specific terms, such description is for illustrative purpose only, and it is to be understood that changes and variations may be made without departing from the spirit or scope of the following claims.

What is claimed is:

1. A method of driving an image display apparatus which includes (1) an image display panel with P0×Q0 pixels arrayed in a two-dimensional matrix and including P0 pixels arrayed in a first direction and Q0 pixels arrayed in a second direction and (2) a signal processing section, each of the pixels including (a) a first subpixel for displaying a first primary color, (b) a second subpixel for displaying a second primary color, (c) a third subpixel for displaying a third primary color and (d) a fourth subpixel for displaying a fourth color, the signal processing section configured to perform the steps of (a) calculating a first subpixel output signal to each of the pixels based on an first subpixel input signal to the pixel and outputting the first subpixel output signal to the first subpixel, (b) calculating a second subpixel output signal to the pixel based on a second subpixel input signal to the pixel and outputting the second subpixel output signal to the second subpixel, and (c) calculating a third subpixel output signal to the pixel based on a third subpixel input signal to the pixel and outputting the third subpixel output signal to the third subpixel, said method comprising the step, carried out by the signal processing section, of:

calculating a fourth subpixel output signal based on a fourth subpixel control second signal calculated from the first subpixel input signal, second subpixel input signal and third subpixel input signal to a (p,q)th, where p is 1, 2, . . . , P0 and q is 1, 2, . . . , Q0 when the pixels are counted along the second direction, pixel and a fourth subpixel control first signal calculated from the first subpixel input signal, second subpixel input signal and third subpixel input signal to an adjacent pixel positioned adjacent the (p,q)th pixel along the second direction, and outputting the calculated fourth subpixel output signal to the fourth subpixel of the (p,q)th pixel, wherein, a fourth subpixel control second signal value SG2-(p,q) is calculated based on Min(p,q) and a fourth subpixel control first signal value SG1-(p,q) is calculated based on Min(p,q'), Min(p,q) is a minimum value among the first subpixel input signal, second subpixel input signal and third subpixel input signal to the (p,q)th pixel, and Min(p,q') is a minimum value among the first subpixel input signal, second subpixel input signal and third subpixel input signal to the adjacent pixel positioned adjacent the (p,q)th pixel, and wherein, where $\chi$ is a constant which depends upon the image display apparatus, a maximum value Vmax(S) of brightness where a saturation S in an HSV (Hue, Saturation and Value) color space enlarged by adding the fourth color is used as a variable is calculated by the signal processing section, and the signal processing section (a) calculates the saturation S and the brightness V(S) of a plurality of pixels based on the subpixel input signal values to the plural pixels, (b) calculates an expansion coefficient $\alpha 0$ based at least on one value from among the values of Vmax(S)/V(S) calculated with regard to the plural pixels, and (c) calculates the first subpixel output signal of the (p,q)th pixel based at least on the first subpixel input signal to the (p,q)th pixel and the expansion coefficient $\alpha 0$, the second subpixel output signal being calculated based at least on the second subpixel input signal to the (p,q)th pixel and the expansion coefficient $\alpha 0$, the third subpixel output signal being calculated based at least on the third subpixel input signal to the (p,q)th pixel and the expansion coefficient $\alpha 0$, and the saturation and the brightness of the (p,q)th pixel being represented, where the saturation and the brightness are indicated by S(p,q) and V(p,q), respectively, as $$S(p,q)=(\mathrm{Max}(p,q)-\mathrm{Min}(p,q))/\mathrm{Max}(p,q)$$

$$V(p,q)=\mathrm{Max}(p,q),$$

where Max(p,q) is a maximum value among three subpixel input signal values including a first subpixel input signal value x1-(p,q), a second subpixel input signal value x2-(p,q) and a third subpixel input signal value x3-(p,q) to the (p,q)th pixel, and Min(p,q) is a minimum value among the three subpixel input signal values including the first subpixel input signal value x1-(p,q), second subpixel input signal value x2-(p,q) and third subpixel input signal value x3-(p,q) to the (p,q)th pixel.

2. A method of driving an image display apparatus which includes (1) an image display panel with P×Q pixel groups arrayed in a two-dimensional matrix and including P pixel groups arrayed in a first direction and Q pixel groups arrayed in a second direction and (2) a signal processing section, each of the pixel groups being configured from a first pixel and a second pixel along the first direction, the first pixel including a first subpixel for displaying a first primary color, a second subpixel for displaying a second primary color and a (c) third subpixel for displaying a third primary color, the second pixel including (a) a first subpixel for displaying the first primary color, (b) a second subpixel for displaying the second primary color and (c) a fourth subpixel for displaying a fourth color, the signal processing section configured to perform the steps of (a) calculating a first subpixel output signal to the first pixel based at least on a first subpixel input signal to the first pixel and outputting the first subpixel output signal to the first subpixel of the first pixel, (b) calculating a second subpixel output signal to the first pixel based at least on a second subpixel input signal to the first pixel and outputting the second subpixel output signal to the second subpixel of the first pixel, (c) calculating a first subpixel output signal to the second pixel based at least on a first subpixel input signal to the second pixel and outputting the first subpixel output signal to the first subpixel of the second pixel, and (d) calculating a second subpixel output signal to the second pixel based at least on a second subpixel input signal to the second pixel and outputting the second subpixel output signal to the second subpixel of the second pixel, said method comprising the steps, further carried out by the signal processing section, of:

calculating a fourth subpixel output signal based on a fourth subpixel control second signal calculated from the first subpixel input signal, second subpixel input signal and third subpixel input signal to a (p,q)th, where p is 1, 2, . . . , P and q is 1, 2, . . . , Q when the pixels are counted along the second direction, second pixel and a fourth subpixel control first signal calculated from the first subpixel input signal, second subpixel input signal and third subpixel input signal to an adjacent pixel positioned adjacent the (p,q)th pixel along the second direction, and outputting the calculated fourth subpixel output signal to the fourth subpixel of the (p,q)th second pixel; and further calculating a third subpixel output signal based at least on the third subpixel input signal to the (p,q)th second pixel and the third subpixel input signal to the (p,q)th first pixel and outputting the third subpixel output signal to the third subpixel, wherein, a fourth subpixel control second signal value SG2−(p,q) for the (p,q)th second pixel is obtained from Min(p, q)−2, a fourth subpixel control first signal SG1−(p,q) for an adjacent pixel positioned adjacent the (p,q)th second pixel is obtained from Min(p,q'), Min(p,q)−2 is a minimum value among three subpixel input signal values including a first subpixel input signal value x1−(p,q)−2, a second subpixel input signal value x2−(p,q)−2 and a third subpixel input signal value x3−(p,q)−2 to the (p,q)th second pixel, and Min(p,q') is a minimum value among the three subpixel input signal values including a first subpixel input signal value x1−(p,q'), a second subpixel input signal value x2−(p,q') and a third subpixel input signal value x3-(p,q') to the adjacent pixel positioned adjacent the (p,q)th second pixel.

3. The driving method for an image display apparatus according to claim 2, wherein the first pixel and the second pixel are positioned adjacent each other along the second direction.

4. The driving method for an image display apparatus according to claim 2, wherein the first pixels are positioned adjacent to each other and the second pixels are positioned adjacent each other along the second direction.

5. A method of driving an image display apparatus which includes (1) an image display panel wherein totaling P×Q pixel groups arrayed in a two-dimensional matrix including P pixel groups arrayed in a first direction and Q pixel groups arrayed in a second direction and (2) a signal processing section, each of the pixel groups being configured from a first pixel and a second pixel along the first direction, the first pixel including a first subpixel for displaying a first primary color, a second subpixel for displaying a second primary color and a third subpixel for displaying a third primary color, the second pixel including (a) a first subpixel for displaying the first primary color, (b) a second subpixel for displaying the second primary color and a (c) fourth subpixel for displaying a fourth color, the signal processing section configured to perform the steps of (a) calculating a first subpixel output signal to the first pixel based at least on a first subpixel input signal to the first pixel and outputting the first subpixel output signal to the first subpixel of the first pixel, (b) calculating a second subpixel output signal to the first pixel based at least on a second subpixel input signal to the first pixel and outputting the second subpixel output signal to the second subpixel of the first pixel, (c) calculating a first subpixel output signal to the second pixel based at least on a first subpixel input signal to the second pixel and outputting the first subpixel output signal to the first subpixel of the second pixel, and (d) calculating a second subpixel output signal to the second pixel based at least on a second subpixel input signal to the second pixel and outputting the second subpixel output signal to the second subpixel of the second pixel, said driving method comprising the steps, further carried out by the signal processing section, of:

calculating a fourth subpixel output signal based on a fourth subpixel control second signal calculated from the first subpixel input signal, second subpixel input signal and third subpixel input signal to a (p,q)th, where p is 1, 2, . . . , P and q is 1, 2, . . . , Q when the pixels are counted along the second direction, second pixel and a fourth subpixel control first signal calculated from the first subpixel input signal, second subpixel input signal and third subpixel input signal to an adjacent pixel positioned adjacent the (p,q)th pixel along the second direction, and outputting the calculated fourth subpixel output signal to the fourth subpixel of the (p,q)th second pixel; and calculating a third subpixel output signal based at least on the third subpixel input signal to the (p,q)th second pixel and the third subpixel input signal to the (p,q)th first pixel and outputting the third subpixel output signal to the third subpixel, wherein, where $\chi$ is a constant which depends upon the image display apparatus, a maximum value Vmax(S) of brightness where a saturation S in an HSV (Hue, Saturation and Value) color space enlarged by adding the fourth color is used as a variable is calculated by the signal processing section, and the signal processing section (a) calculates the saturation S and the brightness V(S) of a plurality of pixels based on the subpixel input signal values to the plural pixels, (b) calculates an expansion coefficient $\alpha 0$ based at least on one value from among the values of Vmax(S)/V(S) calculated with regard to the plural pixels, and (c) calculates the first subpixel output signal value X1−(p,q)−2 of the (p,q)th second pixel based on the first subpixel input signal value x1−(p,q)−2, expansion coefficient $\alpha 0$ and constant $\chi$, the second subpixel output signal value X2−(p,q)−2 of the second pixel being calculated based on the second subpixel input signal value x2−(p,q)−2, expansion coefficient $\alpha 0$ and constant $\chi$, the fourth subpixel output signal value X4−(p,q)−2 of the second pixel being calculated based on a fourth subpixel control second signal value SG2−(p,q), a fourth subpixel control first signal value SG1−(p,q), expansion coefficient $\alpha 0$ and the constant $\chi$, the saturation and the brightness of the (p,q)th first pixel and the saturation and the brightness of the (p,q)th second pixel being represented, where the saturation and the brightness of the first pixel are indicated by S(p,q)−1 and V(p,q)−1, respectively, and the saturation and the brightness of the second pixel are indicated by S(p,q)−2 and V(p,q)−2, respectively, as $$S(p,q)-1=(\mathrm{Max}(p,q)-1-\mathrm{Min}(p,q)-1)/\mathrm{Max}(p,q)-1$$

$$V(p,q)-1=\mathrm{Max}(p,q)-1$$

$$S(p,q)-2=(\mathrm{Max}(p,q)-2-\mathrm{Min}(p,q)-2)/\mathrm{Max}(p,q)-2$$

$$V(p,q)-2=\mathrm{Max}(p,q)-2$$

where Max(p,q)−1 is a maximum value among three subpixel input signal values including a first subpixel input signal value x1−(p,q)−1, a second subpixel input signal value x2−(p,q)−1 and a third subpixel input signal value x3−(p,q)−1 to the (p,q)th first pixel, Min(p,q)−1 is a minimum value among the three subpixel input signal values including the first subpixel input signal value x1−(p,q), second subpixel input signal value x2−(p,q)−1 and third subpixel input signal value x3−(p,q)−1 to the (p,q)th first pixel, Max(p,q)−2 is a maximum value among three subpixel input signal values including a first subpixel input signal value x1−(p,q)−2, a second subpixel input signal value x2−(p,q)−2 and a third subpixel input signal value x3−(p,q)−2 to the (p,q)th second pixel, and Min(p,q)−2 is a minimum value among the three subpixel input signal values including the first subpixel input signal value x1−(p,q)−2, second subpixel input signal value x2−(p,q)−2 and third subpixel input signal value x3−(p,q)−2 to the (p,q)th second pixel.

* * * * *